US008809753B2

(12) United States Patent
Shim

(10) Patent No.: US 8,809,753 B2
(45) Date of Patent: Aug. 19, 2014

(54) ELECTROMAGNETICALLY-COUNTERED MICROWAVE HEATING SYSTEMS AND METHODS

(76) Inventor: Youngtack Shim, Seoul (KR)

( * ) Notice: Subject to any disclaimer, the term of this patent is extended or adjusted under 35 U.S.C. 154(b) by 1075 days.

(21) Appl. No.: 12/318,544

(22) Filed: Dec. 31, 2008

(65) Prior Publication Data

US 2010/0163552 A1 Jul. 1, 2010

Related U.S. Application Data

(63) Continuation of application No. 11/510,667, filed on Aug. 28, 2006, now Pat. No. 7,876,917.

(51) Int. Cl.
*H05B 6/70* (2006.01)

(52) U.S. Cl.
USPC ..... 219/690; 219/702

(58) Field of Classification Search
USPC ..... 219/690, 694, 696, 697, 698, 699, 702, 219/715, 716, 718, 719, 720
See application file for complete search history.

(56) References Cited

U.S. PATENT DOCUMENTS

| | | | | |
|---|---|---|---|---|
| 3,885,118 | A * | 5/1975 | Valtersson | 219/699 |
| 5,756,975 | A * | 5/1998 | Harris et al. | 219/696 |
| 6,466,679 | B1 * | 10/2002 | Husung | 381/324 |
| 6,888,114 | B2 * | 5/2005 | Yagi | 219/695 |
| 7,078,913 | B1 * | 7/2006 | Pelletier | 324/640 |
| 7,876,917 | B2 * | 1/2011 | Shim | 381/189 |
| 2003/0089707 | A1 * | 5/2003 | Fagrell et al. | 219/747 |
| 2004/0208337 | A1 * | 10/2004 | Anciant | 381/410 |
| 2006/0208672 | A1 * | 9/2006 | Achenbach et al. | 315/500 |
| 2008/0035058 | A1 * | 2/2008 | Tian et al. | 118/723 AN |

FOREIGN PATENT DOCUMENTS

| | | | |
|---|---|---|---|
| EP | 792085 A | * | 8/1997 |
| SU | 852300 | * | 8/1981 |

* cited by examiner

*Primary Examiner* — Dana Ross
*Assistant Examiner* — Frederick Calvetti
(74) *Attorney, Agent, or Firm* — Stein IP, LLC

(57) ABSTRACT

Various electromagnetically-countered microwave heating system include at least one wave source irradiating harmful electromagnetic waves and at least one counter unit emitting counter electromagnetic waves for countering the harmful waves by the counter waves. Such counter units counter the harmful waves by the counter units via various mechanisms such as, e.g., matching configurations of the counter units with those of the wave sources, matching shapes of such counter waves with shapes of the harmful waves, and the like. Various methods are also illustrated to counter the harmful waves with the counter waves using the source or wave matching, to provide the counter units, and to emit suitable counter waves. Various processes are also illustrated to provide such systems, such counter units, and the like. Various electric or magnetic shields may be used alone or in conjunction with such counter units to minimize irradiation of the harmful waves.

20 Claims, 10 Drawing Sheets

ELECTROMAGNETICALLY-COUNTERED MICROWAVE HEATING SYSTEMS AND METHODS

CROSS-REFERENCES TO RELATED APPLICATIONS

The present application is a continuation of the U.S. Utility patent application which is entitled "Generic electromagnetically-countered systems and methods," which was filed on Aug. 28, 2006, and which bears the Ser. No. 11/510,667, since issued on Jan. 25, 2011, as U.S. Pat. No. 7,876,917, which is incorporated herein by reference.

FIELD OF THE INVENTION

The present invention relates to an electromagnetically-countered microwave heating system which includes at least one wave source irradiating harmful electromagnetic waves and at least one counter unit emitting counter electromagnetic waves for countering the harmful waves by the counter waves. More particularly, the present invention relates to counter units for such electromagnetically-countered microwave heating systems and to various mechanisms for countering the harmful waves by the counter units such as, e.g., by matching configurations of the counter units with those of such wave sources, matching shapes of such counter waves with shapes of the harmful waves, and the like. The present invention also relates to various methods of countering the harmful waves with the counter waves using the source and/or wave matching and various methods of providing the counter units and emitting suitable counter waves. The present invention further relates to various processes for providing such systems, such counter units thereof, and the like. The present invention relates to various electric and/or magnetic shields which may be used alone or in conjunction with such counter units to minimize irradiation of the harmful waves from the system.

BACKGROUND OF THE INVENTION

It is now well established in the scientific community that electromagnetic waves with varying frequencies irradiated by various devices may be hazardous to human health. In some cases, such electromagnetic waves in mega- and giga-hertz range may be the main culprit, whereas the 60-hertz electromagnetic waves may be the main health concern in other cases. It cannot be too emphasized that it is very difficult to shield against magnetic waves of the 60-hertz electromagnetic waves which have wavelengths amounting to thousands of kilometers and that such 60-hertz magnetic waves are omnipresent in any corner of the current civilization.

However, intensity of such electromagnetic waves typically decreases inversely proportional to a square of a distance from a source of such waves to a target. Accordingly, potentially adverse effects from such electromagnetic waves may be minimized by maintaining a safe distance from such a source. Some electrical devices, however, are intended to irradiate a massive amount of waves for various purposes, e.g., cooking foods as in microwave heating devices, emitting the waves to space as in radars, and the like. However, all of such prior art wave emitting devices have failed to provide remedies to such potential hazards.

Therefore, there is an urgent need for various counter units capable of being incorporated to various prior art microwave heating devices and radars for converting such into electromagnetically-countered microwave heating systems and radars so as to minimize irradiation of the harmful waves therefrom. There also is a need to provide a feasible solution to counter the harmful waves irradiated by various waves sources of different shapes and/or sizes. There also is a need to provide another feasible solution for countering such harmful waves defining wavefronts of various characteristics.

SUMMARY OF THE INVENTION

The present invention relates to an electromagnetically-countered microwave heating system (to be also abbreviated as the "EMC microwave heating system," as the "EMC heating system," as the "EMC system" or simply as the "system" hereinafter) with at least one wave source irradiating harmful electromagnetic waves and at least one counter unit emitting counter electromagnetic waves in order to counter the harmful waves with the counter waves, e.g., through canceling at least a portion of the harmful waves with the counter waves, by suppressing the harmful waves with the counter waves from propagating toward a target space, and the like. More particularly, the present invention relates to various counter units of the EMC systems and to various mechanisms for countering such harmful waves irradiated from various base units of the wave sources by the counter units. Therefore, such a counter unit may be shaped, sized, and/or arranged to match its configuration with configuration of the base unit of the wave source, thereby emitting such counter waves automatically matching wave characteristics of the harmful waves. Alternatively, such a counter unit may be shaped, sized, and/or disposed in an arrangement which is defined along one or more wavefronts of such harmful waves, thereby emitting the counter waves which automatically match wave characteristics of such harmful waves. The present invention also relates to various counter units which are provided as analogs of the base unit, where such an analog approximates the base unit more complex than the counter unit, where a three- or two-dimensional base unit is approximated by a two- or one-dimensional analog, and the like. The present invention also relates to multiple simple counter units which are simpler than the base unit but disposed in an arrangement approximating such a shape and/or arrangement of the base unit. The present invention also relates to the counter unit which may be shaped and/or sized in a preset relation to the configuration of the base unit and disposition thereof. In addition, the present invention relates to various countering modes where a single counter unit may counter a single base unit, may counter at least two but not all of multiple base units, may counter all of multiple base units, and so on, where multiple counter units may counter a single base unit, may counter a greater number of base units or a less number of base units, and so on. The present invention also relates to various electric and/or magnetic shields which may be used alone or in conjunction with such counter units to minimize irradiation of the harmful waves from the system. Such counter units and/or shields may be arranged for countering one or more base units of multiple wave sources of the EMC system such as, e.g., a magnetron tube, a transformer, an actuator, and various electrical parts thereof.

The present invention also relates to various methods of countering the harmful waves which are irradiated by various base units of multiple wave sources of the EMC microwave heating system with the counter waves by the source and/or wave matching. More particularly, the present invention relates to various methods forming the counter unit as an analog of the base unit and then emitting the counter waves matching such harmful waves, various methods of approximating the base unit by the simpler counter unit for the countering and various methods of approximating the base unit by multiple simpler counter units. The present invention also relates to various methods of disposing the counter unit along the wavefronts of the harmful waves and then emitting the counter waves for automatically matching such wavefronts of the harmful waves, various methods of disposing multiple counter units along the wavefronts of the harmful waves and then emitting the counter waves by the counter units for automatically matching such wavefronts, and the like. In addition, the present invention relates to various methods of manipulating the wavefronts of the counter waves by disposing the counter unit closer to and/or farther away from the target space with respect to the base unit, various methods of controlling radii of curvature of the wavefronts of the counter waves by incorporating one or multiple counter units emitting such counter waves of the same or opposite phase angles, various methods of adjusting the wavefronts of the counter waves by disposing one or multiple counter units defining the shapes similar to or different from the shapes of such base units, and the like. The present invention also relates to various methods of countering the harmful waves from one or multiple base units with the counter waves emitted by the single or multiple counter units. Accordingly, the present invention relates to various methods of emitting such counter waves from a single counter unit for the harmful waves irradiated by one or more base units, various methods of emitting such counter waves by two or more counter units for the harmful waves irradiated by a single or multiple base units, and the like. In addition, the present invention relates to various methods of minimizing irradiation of such harmful waves by incorporating such electric shields, by incorporating the magnetic shields, by incorporating one or both of such shields either alone or in conjunction with the above counter units, and the like.

The present invention further relates to various processes for providing various counter units for such EMC microwave heating systems. More particularly, the present invention relates to various processes for forming the counter units to emit the counter waves with the wavefronts similar to (or different from) such shapes of the counter units, various processes for forming the counter units as the above analogs of the base units, various processes for providing the counter units emitting such counter waves which define the similar or opposite phase angles, various processes for providing such counter units with the wavefronts shaped similar to the harmful waves, various processes for disposing the counter units in a preset arrangement and emitting therefrom the counter waves which have the wavefronts similar to such an arrangement, and the like. The present invention also relates to various processes for assigning the single counter unit to counter the harmful waves irradiated by the single base unit for a local countering or to counter such harmful waves from multiple base units for a global countering, various processes for assigning multiple counter units to counter the harmful waves irradiated from the single base unit for the global countering or to counter the harmful waves from multiple base units for the local or global countering depending upon numbers of the counter and base units. The present invention further relates to various processes for incorporating such electric and/or magnetic shields for minimizing the irradiation of such harmful waves, and various processes for minimizing the irradiation of such harmful waves with such electric and/or magnetic shields either alone or in conjunction with such counter units.

Accordingly, a primary objective of the present invention is to form an EMC microwave heating system capable of minimizing the irradiation of the harmful waves by at least one base unit of at least one wave source by countering the harmful waves with the counter waves. Accordingly, a related objective of this invention is to provide an EMC system capable of countering such harmful waves by canceling at least a portion of the harmful waves with the counter waves and/or by suppressing the harmful waves from propagating toward a preset direction with the counter waves. Another related objective of this invention is to counter the harmful waves by the counter waves not all around such base units of the EMC system but only in the target space defined on only one side of the system. In general, the target space is defined between at least one of the base units and an user of the system and/or a specific body part of the user. Another related objective of this invention is to arrange such counter waves to have the phase angles at least partially opposite to those of the harmful waves so that the counter waves cancel and/or suppress such harmful waves when propagated to the target space. Another related objective of this invention is to arrange the counter waves to have the phase angles at least partially similar to those of the harmful waves so that the counter waves cancel and/or suppress the harmful waves when propagated to the target space from an opposite side of at least one of the base units. Another related objective of this invention is to emit the counter waves by the same side or opposite sides of the base unit with respect to the target space while manipulating their phase angles such that the counter waves from different counter units counter the harmful waves in the target space.

Another objective of the present invention is to provide such an EMC system including at least one counter unit capable of emitting such counter waves. Therefore, a related objective of this invention is to match at least one feature or configuration (e.g., each meaning a shape, a size, an arrangement, and the like) of the counter unit with the feature or configuration of at least one of the base units such that the counter waves emitted by the counter unit match the harmful waves irradiated from the base unit(s). Another related objective of this invention is to match the shape of a single counter unit with the shape of a single base unit so that the counter waves emitted by the counter unit may match such harmful waves by the base unit. Another related objective of this invention is to match the shape of a single counter unit with an arrangement of multiple base units so that the counter waves emitted from the counter unit match a sum of the harmful waves irradiated by multiple base units. Another related objective of this invention is to dispose multiple counter units in an arrangement matching the shape of a single base unit so that a sum of the counter waves emitted by the counter units match the harmful waves by the base unit. Another related objective of this invention is to arrange multiple counter units in an arrangement which matches another arrangement of multiple base units such that a sum of the counter waves emitted by multiple counter units match another sum of the harmful waves by multiple base units. Another related objective of this invention is to provide such counter units while using the least amount of electrically conductive, semiconductive, and/or insulative materials, while minimizing a total volume or a size of the counter units, while minimizing a total mass of such counter units, and the like. Another related objective of this invention is to emit the counter waves by the counter units while using the least electrical energy, while drawing the least amount of electric current or voltage from the base unit(s) or other parts of the EMC system, and the like.

Another objective of the present invention is to provide an EMC system which includes therein at least one counter unit matching the shape of at least one base unit. Accordingly, a related objective of this invention is to form the counter unit as an one-, two- or three-dimensional analog of the three-dimensional base unit and to counter the single or multiple base units by the single or multiple analogs. Another related objective of this invention is to provide the counter unit as an one- or two-dimensional analog of the three-dimensional base unit and to counter the single or multiple base units by the single or multiple analogs. Another related objective of this invention is to provide the counter unit as an one- or two-dimensional analog of the two-dimensional base unit and then to counter the single or multiple base units with the single or multiple analogs. Another related objective of this invention is to form the counter unit as an one-dimensional analog of the two-dimensional base unit and to counter the single or multiple base units by the single or multiple analogs. Another related objective of this invention is to provide the counter unit as an one-dimensional analog of an one-dimensional base unit and to counter the single or multiple base units using the single or multiple analogs. Another related objective of this invention is to provide such counter units as one-, two-, and/or three-dimensional analogs of an one-, two-, and/or three-dimensional base units and then to counter the base units of the mixed dimension by the counter units of the mixed dimension. In these objectives, such counter units emit the counter waves capable of matching the harmful waves irradiated by the base units. Another related objective of this invention is to form the counter unit conforming to the shape of the base unit for matching such harmful waves with the counter waves emitted thereby. Another related objective of this invention is to form the counter unit which does not conform to the shape of the base unit but which is disposed in an arrangement for matching the harmful waves by such counter waves emitted thereby. Another related objective of this invention is to form the counter unit in a shape of one or multiple wires, strips, sheets, tubes, coils, spirals, meshes, mixtures thereof, combinations thereof, and/or arrays thereof in order to match the shape of at least one of the base units and to emit the counter waves matching the harmful waves. Another related objective of this invention is to dispose any of such counter units in a preset distance from at least one of the base units in order to match at least some wavefronts of the counter waves emitted thereby to at least some wavefronts of the harmful waves. Another related objective of this invention is to dispose any of the above counter units in a preset arrangement with respect to any of the base units for matching at least some wavefronts of the counter waves with at least some of the harmful waves.

Another objective of the present invention is to provide an EMC system which includes therein at least one counter unit having a size which operatively matches a size of at least one of such base units to match the harmful waves irradiated by the base unit with the counter waves emitted thereby. Accordingly, a related objective of this invention is to provide such a counter unit larger, wider, and/or longer than at least one of such base units, where the counter unit is disposed between the base unit and target space (to be referred to as the "front arrangement" hereinafter) for the matching. Another related objective of this invention is to provide the counter unit defining a size, a width, and/or a length similar (or identical) to those of at least one of the base units, where such a counter unit is disposed laterally or side by side to the base unit with respect to the target space (to be referred to as a "lateral arrangement" hereinafter) for such matching. Another related objective of this invention is to form the counter unit smaller, narrower, and/or shorter than at least one of the base units, where the counter unit is preferably disposed on an opposite side of the target space with respect to the base unit (to be referred to as a "rear arrangement" hereinafter) for such matching. Another related objective of this invention is to enclose at least a portion of the counter unit by at least one of the base units or, in the alternative, to enclose at least a portion of the base unit by such a counter unit (to be referred to as a "concentric arrangement" hereinafter) for such matching. Another related objective of this invention is to dispose multiple counter units in the front, lateral, rear, and/or concentric arrangement with respect to the single base unit for the matching. Another related objective of this invention is to form the single or multiple counter units disposed in the front, lateral, rear, and/or concentric arrangement relative to multiple base units for such matching. Another related objective of this invention is to provide multiple counter units all of which are to be disposed in only one of such front, lateral, rear, and concentric arrangements with respect to all of multiple base units or at least two of which are to be disposed in different (or mixed) arrangements with respect to at least two of multiple base units for the matching.

Another objective of the present invention is to provide an EMC system which incorporates at least one counter unit in a disposition (e.g., an orientation, alignment, and/or distance) matching that of at least one of such base units. Therefore, a related objective of this invention is to orient the counter unit in a direction of propagation of the harmful waves, in another direction in which the current flows in at least one of the base units, in another direction in which the voltage is applied thereacross, along a direction of the longitudinal axis thereof, in a direction of the short axis thereof for the matching, and the like. Another related objective of this invention is to provide multiple counter units all of which are oriented in one of the same directions and/or axes, at least two of which are oriented along different directions and/or axes, and all of which are oriented in different directions and/or axes for the above matching. Another related objective of this invention is to axially align the counter unit with respect to at least one of the base units (to be referred to as an "axial alignment" hereinafter) so that the counter waves emitted by the counter unit are to axially align with the harmful waves irradiated from the base unit for such matching. Another related objective of this invention is to axially misalign the counter unit with at least one of such base units (to be referred to as an "off-axis alignment" hereinafter) and then to dispose the counter unit in a preset arrangement for the matching. Another related objective of this invention is to provide multiple counter units disposed in the axial or off-axis alignment with respect to the single base unit for the matching. Another related objective of this invention is to provide a single or multiple counter units which are disposed in the axial or off-axis alignment with respect to multiple base units for the matching. Another related objective of this invention is to form multiple counter units all of which are disposed in the axial or off-axis alignment with respect to all of multiple base units or, in the alternative, at least two of which are disposed in different (or mixed) alignments with respect to at least two of multiple base units for such matching. Another related objective of this invention is to dispose the counter unit in a preset distance from at least one of the base units so that at least some wavefronts of the counter waves emitted by the counter unit match at least some wavefronts of the harmful waves from the base unit for such matching. Another related objective of this invention is to dispose a single counter unit in preset distances from each (or at least two) of multiple base units for such matching. Another related objective of this invention is to dispose multiple counter units in preset distances from the single base unit or, alternatively, at preset distances from each (or at least two) of multiple base units for the matching.

Another objective of the present invention is to provide an EMC system which includes therein at least one counter unit for emitting the counter waves which have ampitudes matching those of the harmful waves. Therefore, a related objective of this invention is to provide the counter unit emitting the counter waveswith amplitudes greater than those of the harmful waves, where this counter unit is disposed farther away from the target space with respect to at least one of the base units or in the rear arrangement for such matching. another related objective of this invention is to form the counter unit emitting the counter waves having amplitudes similar (or identical) to those of the harmful waves, where such a counter unit is preferably disposed side by side with at least one of the base units with respect to the target space or in the lateral arrangement for the matching. Another related objective of this invention is to form the counter unit emitting the counter waves with amplitudes less than those of the harmful waves, where this counter unit is preferably disposed closer to such a target space than at least one of the base units or in the front arrangement for such matching. Another related objective of this invention is to provide multiple counter units each emitting the counter waves a sum of which defines amplitudes greater than, similar to or less than those of the single base unit, than those of all of multiple base units, than those of at least two but not all of multiple counter units, and the like.

Another objective of the present invention is to provide such an EMC system including at least one counter unit capable of emitting the counter waves which match at least a portion of the harmful waves and, therefore, counter the harmful waves. Therefore, a related objective of this invention is to provide the counter unit for emitting such counter waves defining multiple wavefronts which match at least one of the wavefronts of the harmful waves in the target space. Another related objective of this invention is to dispose the counter unit along at least a portion of at least one of the wavefronts of the harmful waves and to emit the counter waves matching such a portion of the wavefront of the harmful waves. Another related objective of this invention is to dispose multiple counter units along at least a portion of at least one of the wavefronts of the harmful waves and to emit the counter waves a sum of which then matches such a portion of the wavefront of the harmful waves. Another related objective of this invention is to dispose the counter unit across at least two of such wavefronts of the harmful waves but to emit the counter waves capable of matching at least a portion of at least one of the wavefronts of the harmful waves. Another related objective of this invention is to provide multiple counter units at least two of which are disposed across at least two of the wavefronts of the harmful waves but to emit the counter waves capable of matching the portion of the wavefront of the harmful waves. Another related objective of this invention is to shape and size such a counter unit in order to emit the counter waves with radii of curvature which match those of at least a portion of the harmful waves. Another related objective of this invention is to dispose the counter unit in a preset position or at a preset distance from the base unit in which the counter waves emitted thereby define the radii of curvature which match those of at least a portion of the harmful waves. Another related objective of this invention is to shape and size multiple counter units emitting such counter waves a sum of which define the radii of curvature matching the harmful waves irradiated by the single base unit or multiple base units. Another related objective of this invention is to provide the counter unit in a shape of one or multiple wires, strips, sheets, tubes, coils, spirals, meshes, mixtures thereof, combinations thereof, and/or arrays thereof and to emit the counter waves capable of matching at least a portion of at least one wavefront of the harmful waves from at least one of the base units. Another related objective of this invention is to fabricate the counter unit into a solid shape without forming any openings or holes thereacross for such matching. Another related objective of this invention is to fabricate the counter units as the arrays defining multiple holes or openings thereacross for such matching.

Another objective of the present invention is to provide an EMC system which includes therein at least one counter unit for emitting the counter waves and for locally countering the harmful waves which are irradiated by at least one of the base units. Therefore, a related objective of this invention is to provide the single counter unit for locally countering the harmful waves from the single base unit by the counter waves emitted thereby. Another related objective of this invention is to provide multiple counter units each of which locally counters such harmful waves from only one of the same (or less) number of such base units with the counter waves emitted by each of multiple counter units. Another related objective of this invention is to provide the single counter unit (or multiple counter units) having the feature (or configuration) similar (or identical) to that of the single base unit (or multiple base units) for the local countering. Another related objective of this invention is to provide the single counter unit (or multiple counter units) emitting the counter waves defining the wavefronts matching at least one of the wavefronts of the harmful waves irradiated by the single base unit (or multiple base units) for the local countering. Another related objective of this invention is to provide multiple counter units at least one of which has the feature (or configuration) similar (or identical) to that of at least one of the base units, while at least another of which defines the wavefronts matching at least one of the wavefronts of the harmful waves from at least one of the base units for such local countering.

Another objective of the present invention is to provide an EMC system which includes therein at least one counter unit for emitting the counter waves and for globally countering the harmful waves irradiated by at least one of the base units. Therefore, a related objective of this invention is to define one or multiple counter units each emitting the counter waves for globally matching the harmful waves irradiated by only one or a less number of base units. Another related objective of this invention is to provide the single counter unit for globally countering a sum of such harmful waves from multiple base units with the counter waves. Another related objective of this invention is to provide multiple counter units each of which globally counters the harmful waves irradiated by at least two base units by the counter waves emitted by each of multiple counter units. Another related objective of this invention is to define the single counter unit (or multiple counter units) which defines the feature (or configuration) which is similar (or identical) to those of at least two (or a greater number of base units for the global countering. Another related objective of this invention is to provide the single counter unit (or multiple counter units) emitting the counter waves which define the wavefronts matching at least one of the wavefronts of the harmful waves irradiated from at least two (or a greater number on base units for the global countering. Another related objective of this invention is to provide multiple counter units at least one of which defines the feature (or configuration) similar (or identical) to those of at least two base units and at least another of which defines the wavefronts matching at least one wavefront of the harmful waves irradiated by at least two of other base units for such local countering.

Another objective of the present invention is to provide an EMC system which includes therein at least one counter unit which is disposed in a preset position or location defined with respect to at least one of the base units and/or target space. Therefore, a related objective of this invention is to dispose the counter unit on (or over) an exterior surface of at least one of the base units, to dispose the counter unit on (or below) an interior surface of at least one of the base units, to embed at least a portion of the counter unit inside at least one of the base units, and the like. Another related objective of this invention is to provide the system inside a body and to dispose the counter unit on and/or over an exterior surface of the body, to dispose the counter unit on and/or below an interior surface of the body, to embed at least a portion of the counter unit into or inside the body, to dispose the counter unit between such a body and at least one of the base units, and the like. Another related objective of this invention is to dispose the counter unit in a preset relation to the body such as, e.g., exposing at least a portion of the counter unit therethrough, enclosing the entire portion of the counter unit inside such a body, and the like.

Another objective of the present invention is to provide an EMC system which includes therein at least one counter unit emitting the counter waves propagating along preset directions. Therefore, a related objective of this invention is to arrange the counter unit to emit the counter waves always in a fixed direction with respect to at least one of the base units so that the counter waves propagate in a direction defined in a preset relation to a direction of propagation of the harmful waves, e.g., parallel to the harmful waves, perpendicular to the harmful waves, at a preset angle with respect to the harmful waves, and so on. Another related objective of this invention is to arrange the counter unit to emit the counter waves in variable directions with respect to a direction of propagation of the harmful waves, where such a counter unit is arranged to change its arrangement and/or orientation and/or to receive the current and/or voltage along variable directions for changing the direction of such counter waves. Another related objective of this invention is to arrange the counter unit to emit the counter waves in a direction which is adaptively determined by variable directions of propagation of such harmful waves, where such a counter unit may change the direction of the counter waves as described hereinabove. Therefore, such a counter unit may change an extent of countering based on its arrangement and/or orientation. Another related objective of this invention is to synchronize a propagation direction of the counter waves with that of such harmful waves based on the preset relation disclosed hereinabove. Another related objective of this invention is to arrange the counter unit to manipulate the amplitudes of the counter waves in various mechanisms similar to those for manipulating the directions thereof.

Another objective of the present invention is to provide an EMC system with at least one of the above counter units and to supply the electric current or voltage thereto for countering such harmful waves by such counter waves emitted thereby. Accordingly, a related objective of this invention is to provide the counter unit with the electric current or voltage which is supplied to the above base unit or at least one of multiple base units. Another related objective of this invention is to provide the counter unit with at least a portion but not an entire portion of the electric current or voltage supplied to such a base unit or at least one of multiple base units. Another related objective of this invention is to provide the counter unit with such a portion of the current or voltage of which the amplitudes and/or direction are modified before being supplied thereto. In all of these examples, the current or voltage supplied to the counter unit is automatically synchronized with such current or voltage supplied to the base unit or at least one of multiple base units. Another related objective of this invention is to supply the counter unit with electric current or voltage which is not the current or voltage supplied to the base unit or at least one of multiple base units but which is at least partially synchronized with the current or voltage supplied to such base units. Another related objective of this invention is to manipulate the amplitudes or directions of the current or voltage depending upon configuration and/or disposition of the counter unit. Another related objective of this invention is to electrically couple the counter unit with the base unit in a parallel, series or hybrid mode. Another related objective of this invention is to supply such electric current or voltage based upon various sequences such as, e.g., first to the base unit and then to the counter unit, first to the counter unit then to the counter unit, first to one of multiple counter units and then to the rest of the counter units or base unit, first to one of multiple base units and then to the rest of the base units or counter unit, simultaneously to the counter and base units, and the like.

It is to be understood in all of such objectives that the counter units are preferably arranged to not adversely affect other intended operations of the systems. For example, the counter units of the EMC microwave heating systems may effectively counter the harmful waves irradiated by their wave generating base units but may not adversely affect wave generating and heating capacity thereof. It is also appreciated in all of such objectives that the counter units are preferably arranged to emit such counter waves defining the phase angles at least partially opposite to those of the harmful waves for such countering but that the counter units may emit the counter waves which define the phase angles at least partially similar to those of the harmful waves when disposed on an opposite side of the base unit with respect to the target space or when the system includes multiple counter units and when it is desirable to modify the radii of curvature of the wavefronts of the counter waves. It is appreciated as well that the electric and/or magnetic shields disclosed in the co-pending Applications may also be incorporated into any of the above EMC systems either alone or in combination with the above counter units for maximally countering the harmful waves.

The basic principle of the counter units of the EMC microwave heating systems of the present invention is to emit the counter waves which form the wavefronts similar (or identical) to those of the harmful waves but define the phase angles at least partially opposite to those of such harmful waves. Therefore, by propagating the counter waves to the target space, the counter waves can effectively counter the harmful waves in such a target space by, e.g., canceling at least a portion of the harmful waves therein and/or suppressing the harmful waves from propagating theretoward. To this end, the counter units are arranged to emit the counter waves which define the wavefronts matching those of the harmful waves by various mechanisms. In one example, such counter units are shaped similar (or identical) to the base units of the waves sources, or arranged similar (or identical) to such base units and, therefore, emit the counter waves which can counter the harmful waves in the target space. In another example, such counter units are disposed along one or more of the wavefronts of the harmful waves and emit the counter waves similar (or identical) to the harmful waves and, therefore, counter the harmful waves in the target space. In these examples, the counter units emit the counter waves forming the wavefronts similar (or identical) to the shapes of the counter units themselves, and such counter waves define the phase angles at least partially opposite to the phase angles of the harmful waves. In another example, such counter units are shaped differently from the base units, but rather disposed in an arrangement in which the counter waves emitted therefrom match the harmful waves in the target space. In another example, the counter units are disposed across different wavefronts of the harmful waves but emit the counter waves which are similar (or identical) to the harmful waves and, therefore, counter the harmful waves in the target space. In the last two examples, the counter units may be arranged to emit the counter waves defining such wavefronts which may or may not be similar (or identical) to the shapes of the counter units themselves, while the counter waves have the phase angles which are at least partially opposite to those of the harmful waves.

The basic principle of the counter units of the generic electromagnetically-countered system of this invention may be implemented into various prior art devices for minimizing irradiation of the harmful waves therefrom. For example, the counter units may be implemented to any base units of electrically conductive wires, coils, and/or sheets or, in the alternative, into any electrically semiconductive and/or insulative wires, coils, and/or sheets for minimizing the irradiation of the harmful waves by countering such harmful waves by the counter waves, e.g., by canceling at least a portion of the harmful waves in the target space and/or suppressing the harmful waves from propagating toward the target space, where the counter units may be made of and/or include at least one electrically conductive, insulative or semiconductive material. The counter units may be implemented into any of such base units which define the shapes which may be formed by incorporating one or multiple wires, coils, and/or sheets, by modifying the shapes of one or multiple wires, coils, and/or sheets, where a few examples of the modified shapes may include a solenoid and toroid each formed by modifying the shape of such a coil. Therefore and in one example, the counter units may be implemented into various electronic elements such as resistors, capacitors, inductors, diodes, amplifiers, and/or memories which are provided in a millimeter scale, a micron scale, and/or a nanometer scale, for minimizing the irradiation of the harmful waves. Therefore, any prior art electronic elements with any of the counter units may be converted into the EMC electronic elements. In another example, the counter units may also be incorporated into various wave generating devices such as microwave heating ovens, radars, and the like. Therefore, any prior art microwave heating ovens and radars with any of the counter units may be converted to the EMC microwave heating systems and EMC radar systems.

It is appreciated that various counter units of the EMC systems of the present invention may be incorporated into any electrical and/or electronic devices each of which may include at least one base unit and, accordingly, may irradiate the harmful waves including electric waves (to be abbreviated as "EWs" hereinafter) and magnetic waves (to be abbreviated as "MWs" hereinafter) having frequencies of about 50 to 60 Hz and/or other EWs and MWs of higher frequencies. It is also appreciated that the EMC systems of this invention may also be incorporated into any portable or stationary electric and/or electronic devices which have at least one base unit detailed examples of which have been provided heretofore and will be provided hereinafter. It is further appreciated that such counter units may be provided in a micron-scale and incorporated to semiconductor chips and circuits such as LSI and VLSI devices and that the counter units may also be provided in a nano-scale and incorporated into various nano devices including at least one base unit which may be a single molecule or a compound, or may be a cluster of multiple molecules or compounds.

Various system, method, and/or process aspects of the EMC microwave heating systems and various embodiments thereof are now enumerated. It is appreciated, however, that following system, method, and/or process aspects of this invention may be embodied in many other different forms and, accordingly, should not be limited to such aspects and/or their embodiments which are to be set forth herein. Rather, various exemplary aspects and their embodiments described hereinafter are provided such that this disclosure will be thorough and complete, and fully convey the scope of this invention to one of ordinary skill in the relevant art.

In one aspect of the present invention, an EMC system may have a wave source and may be provided to counter harmful electromagnetic waves which are irradiated by multiple base units of the wave source by suppressing the harmful waves from propagating to a target space and/or canceling the harmful waves in the target space, where the base units are arranged to include only portions of the wave source responsible for irradiating the harmful waves and/or affecting propagation paths of the harmful waves therethrough and where the target space is defined between at least one of such base units and an user of the system.

In one exemplary embodiment of this aspect of the invention, such an EMC system may include at least one magnetron tube and at least one counter unit. The magnetron tube is a part of the wave source and arranged to form multiple resonance cavities therein and to irradiate such harmful waves from each of the cavities, where each of the cavities is arranged to serve as one of such base units. This magnetron tube is to be referred to as the "first magnetron tube" hereinafter. The counter unit is arranged to define a configuration which is identical (or similar) to at least one of the base units and to emit counter electromagnetic waves. The counter waves are arranged to have phase angles at least partially opposite to those of the harmful waves irradiated from at least one of the base units, to have wave characteristics at least partially similar to those of the harmful waves irradiated by such at least one of the base units due to the configuration and, therefore, to counter the harmful waves irradiated by such at least one of the base units due to the phase angles in the target space, where the harmful waves of this paragraph are to be referred to as the "first harmful waves" hereinafter.

In another exemplary embodiment of this aspect of the invention, an EMC system may have at least one first magnetron tube and a single counter unit. In one example, the counter unit is arranged to define a configuration of an 1-D (or 2-D, 3-D) analog of at least one of such base units and to emit the first counter waves. In another example, the counter unit is arranged to define a configuration of an 1-D (or 2-D, 3-D) analog of at least two of the base units and then to emit the first counter waves.

In another exemplary embodiment of this aspect of the invention, an EMC system may have at least one first magnetron tube and multiple counter units. In one example, at least two of the counter units are arranged to have a configuration of 1-D, 2-D or 3-D analog of at least one of such base units and to emit the first counter waves. In another example, at least two of the counter units are instead arranged to define configurations of 1-D (or 2-D, 3-D) analogs of at least two of the base units and to emit the counter waves.

In another aspect of the present invention, an EMC system may have a wave source and may be provided to counter harmful electromagnetic waves irradiated from multiple base units of the wave source by matching a shape and/or arrangement of at least one of the base units with a shape and/or arrangement of at least one counter unit of the system and by suppressing such harmful waves from propagating toward a target space and/or canceling such harmful waves in the target space, where the base units are arranged to include only portions of the wave source responsible for irradiating the harmful waves and/or affecting propagation paths of the harmful waves therethrough and where the target space is defined between at least one of the base units and an user of the system.

In one exemplary embodiment of this aspect of the invention, an EMC system may have at least one first magnetron tube and the counter unit which is arranged to have a shape which is conforming, identical or similar to that of at least one of the base units and to emit counter electromagnetic waves, where such counter waves are arranged to define phase angles at least partially opposite to those of the harmful waves irradiated by at least one of the base units, to define wave characteristics at least partially similar to those of the harmful waves irradiated by such at least one of the base units due to the shape and, accordingly, to counter the harmful waves irradiated by such at least one of the base units due to the phase angles in the target space. These counter waves are to be referred to as the "second counter waves" hereinafter.

In another exemplary embodiment of this aspect of the invention, an EMC system may include at least one first magnetron tube and the counter unit which is arranged to define a shape which does not conform to or is different from that of at least one of the base units, to be in a preset arrangement with respect to the base units, and to emit counter electromagnetic waves, where the counter waves are arranged to have phase angles at least partially opposite to those of the harmful waves irradiated from at least one of the base units, to define wave characteristics at least partially similar to those of the harmful waves irradiated by such at least one of the base units due to such an arrangement and, accordingly, to counter the harmful waves irradiated by such at least one of the base units due to the phase angles in the target space and where these counter waves are to be referred to as the "third counter waves" hereinafter.

In another exemplary embodiment of this aspect of the invention, an EMC system may include at least one first magnetron tube and the counter unit. In one example, such a counter unit is arranged to define a shape of an 1-D analog of one of such 1-D, 2-D or 3-D base units and to emit such second counter waves. In another example, the counter unit is arranged to define a shape of at least one 1-D analog of at least two of the 1-D, 2-D or 3-D base units and to emit the second counter waves. In yet another example, the counter unit is arranged to have a shape of a 2-D analog of one of the 1-D, 2-D or 3-D base units and then to emit the second counter waves. In another example, the counter unit is arranged to define a shape of at least one 2-D analog of at least two of the 1-D, 2-D or 3-D base units and to emit the second counter waves. In another example, the counter unit is arranged to define a shape of a 3-D analog of one of the 1-D, 2-D or 3-D base units and to emit the second counter waves. In another example, the counter unit is arranged to have a shape of at least one 3-D analog of at least two of the 1-D, 2-D or 3-D base units and to emit the second counter waves.

In another exemplary embodiment of this aspect of the invention, an EMC system may include at least one first magnetron tube and the counter unit. In one example, the counter unit is arranged to define a shape matching a shape of one of the base units and to emit the second counter waves. In another example, the counter unit is arranged to have a shape matching shapes of at least two of the base units and to emit the second counter waves.

In another exemplary embodiment of this aspect of the invention, an EMC system may have at least one first magnetron tube as well as multiple counter units. In one example, the counter units are arranged to define an overall shape which matches a shape of one of the base units and to emit such second counter waves. In another example, the counter units are arranged to form an overall shape matching an overall shape of at least two of the base units and to emit the second counter waves.

In another exemplary embodiment of this aspect of the invention, an EMC system may include at least one first magnetron tube and the counter unit. In one example, the counter unit is arranged to be disposed between at least two of the base units and the target space, to have a dimension which is longer than a dimension and/or an arrangement of at least one of the base units, and to emit counter electromagnetic waves. In another example, another counter unit is arranged to be disposed on an opposite side of the target space with respect to at least one of the base units, to define a dimension and/or an arrangement shorter than a dimension of at least one of the base units, and to emit counter electromagnetic waves. In both examples, the counter waves are arranged to have phase angles at least partially opposite to those of the harmful waves irradiated from at least one of the base units, to define wave characteristics at least partially similar to those of the harmful waves irradiated by such at least one of the base units due to the dimension and, accordingly, to counter such harmful waves irradiated by such at least one of the base units due to the phase angles in the target space.

In another exemplary embodiment of this aspect of the invention, an EMC system may include at least one first magnetron tube as well as multiple counter units. In one example, such counter units are arranged to be disposed between at least two of the base units and target space, to be disposed in an arrangement with a dimension longer than a dimension and/or an arrangement of at least one of the base units, and to emit counter electromagnetic waves. In another example, the counter units are arranged to be disposed on an opposite side of the target space with respect to at least one of such base units, to be in an arrangement defining a dimension and/or an arrangement which is shorter than a dimension of at least one of such base units, and to emit counter electromagnetic waves. In both of the examples, such counter waves are arranged to define phase angles at least partially opposite to those of the harmful waves irradiated by at least one of the base units, to have wave characteristics at least partially similar to those of the harmful waves irradiated by such at least one of the base units due to the dimension and, accordingly, to counter the harmful waves irradiated by such at least one of the base units due to the phase angles in the target space.

In another exemplary embodiment of this aspect of the invention, an EMC system may include at least one first magnetron tube and the counter unit. In one example, the counter unit is arranged to define a shape of a wire, a strip, a tube, a sheet, a coil, a spiral, a mesh thereof, a mixture thereof, a combination thereof, an array thereof, and the like, while at least partially conforming such a shape to a shape of at least one of the base units, and to emit the second counter waves. In another example, the counter unit is arranged to have a shape of a wire, a strip, a tube, a sheet, a coil, a spiral, a mesh thereof, a mixture thereof, a combination thereof, an array thereof, and the like, while at least partially conforming such a shape to an arrangement of at least one of the base units, and to emit the second counter waves.

In another exemplary embodiment of this aspect of the invention, an EMC system may have at least one first magnetron tube and the counter unit which is arranged to be in an arrangement which is similar to (or different from) an arrangement of at least one of such base units and to emit the third counter waves.

In another exemplary embodiment of this aspect of the invention, an EMC system may include at least one first magnetron tube and the counter unit. In one example, the counter unit is arranged to be disposed between the target space and at least two of the base units, to have a size larger than a size of each of at least two of the base units, and to emit counter electromagnetic waves. In another example, the counter unit is arranged to be disposed on an opposite side of such a target space with respect to at least one of the base units, to define a size smaller than a size of each of at least two of the base units, and to emit counter electromagnetic waves. In both examples, the counter waves are arranged to define phase angles at least partially opposite to those of the harmful waves irradiated by at least one of such base units, to define wave characteristics at least partially similar to those of the harmful waves irradiated by such at least one of the base units due to such a size and, accordingly, to counter the harmful waves irradiated from at least one of the base units due to the phase angles in the target space.

In another aspect of the present invention, an EMC system may have a wave source and may be provided to counter harmful electromagnetic waves irradiated from multiple base units of the wave source by matching a disposition of at least one of such base units with a disposition of at least one counter unit of the system and by suppressing the harmful waves from propagating toward a target space and/or canceling the harmful waves in the target space, where the base units are arranged to include only portions of such a wave source which are responsible for irradiating the harmful waves and/or affecting propagation paths of the harmful waves therethrough and where the target space is defined between at least one of the base units and an user of the system.

In one exemplary embodiment of this aspect of the invention, such an EMC system may include at least one first magnetron tube and the counter unit. The counter unit is arranged to be disposed in an alignment matching a direction of propagation of the harmful waves, a direction of electric current flowing in at least one of the base units, a direction of electric voltage applied across at least one of the base units, a direction along a longitudinal axis of at least one of the base units, and/or a direction of a short axis thereof normal to the longitudinal axis, and to emit counter electromagnetic waves. The counter waves are arranged to define phase angles at least partially opposite to those of the harmful waves irradiated from at least one of such base units, to define wave characteristics at least partially similar to those of the harmful waves also irradiated by such at least one of the base units due to the alignment and, accordingly, to counter such harmful waves irradiated by such at least one of the base units due to the phase angles in the target space.

In another exemplary embodiment of this aspect of the invention, an EMC system may have at least one first magnetron tube and the counter unit. In one example, the counter unit is arranged to be disposed in a position between at least one of such base units and target space, and to emit counter electromagnetic waves having amplitudes less than those of the harmful waves. In another example, the counter unit is arranged to be disposed in a position on an opposite side of the target space with respect to at least one of the base units and to emit counter electromagnetic waves having amplitudes greater than those of the harmful waves. In both examples, the counter waves are arranged to have phase angles at least partially opposite to those of the harmful waves irradiated by at least one of the base units, to define wave characteristics at least partially similar to those of the harmful waves also irradiated by such at least one of the base units due to the position and, accordingly, to counter such harmful waves irradiated by such at least one of the base units due to the phase angles in the target space.

In another exemplary embodiment of this aspect of the invention, an EMC system may include at least one first magnetron tube and the counter unit. In one example, the counter unit is arranged to be in a disposition enclosing therein at least a portion (or an entire portion) of at least one of the base units and to emit counter electromagnetic waves. In another example, the counter unit is arranged to be in a disposition enclosed by at least a portion (or an entire portion) of at least one of the base units and to emit counter electromagnetic waves. In another example, the counter unit is arranged to be in a disposition which is lateral (or side by side) with at least one of such base units and to emit counter electromagnetic waves. In all of these examples, the counter waves are arranged to define phase angles at least partially opposite to those of the harmful waves irradiated by at least one of the base units, to define wave characteristics at least partially similar to those of the harmful waves irradiated by such at least one of the base units due to the disposition and, accordingly, to counter the harmful waves irradiated by such at least one of the base units due to the phase angles in the target space.

In another exemplary embodiment of this aspect of the invention, an EMC system may have at least one first magnetron tube and the counter unit which is arranged to be in a disposition symmetric (or asymmetric) with respect to at least a portion of at least one of the base units and to emit counter electromagnetic waves. Such counter waves are arranged to define phase angles at least partially opposite to those of the harmful waves irradiated from at least one of the base units, to define wave characteristics at least partially similar to those of the harmful waves irradiated by such at least one of the base units due to the disposition and, accordingly, to counter the harmful waves irradiated by such at least one of the base units due to the phase angles in the target space.

In another exemplary embodiment of this aspect of the invention, an EMC system may include at least one first magnetron tube and the counter unit which is arranged to be disposed in a stationary disposition with respect to at least one of the base units and to emit counter electromagnetic waves which are arranged to define phase angles at least partially opposite to those of such harmful waves irradiated from at least one of the base units, to define wave characteristics at least partially similar to those of the harmful waves irradiated by such at least one of the base units while staying in the same disposition and, therefore, to counter the harmful waves irradiated from such at least one of the base units due to the phase angles in the target space.

In another exemplary embodiment of this aspect of the invention, an EMC system may include at least one first magnetron tube and the counter unit which is arranged to be incorporated in a mobile disposition with respect to at least one of such base units and to emit counter electromagnetic waves which are arranged to define phase angles at least partially opposite to those of such harmful waves irradiated from at least one of the base units, to define wave characteristics at least partially similar to those of the harmful waves irradiated from such at least one of the base units while moving relative to the base units and, accordingly, to counter the harmful waves by such at least one of the base units due to the phase angles in the target space.

In another aspect of the present invention, an EMC system may have a wave source and may be provided to counter harmful electromagnetic waves which form multiple wavefronts and which are irradiated by multiple base units of the wave source by counter electromagnetic waves by matching at least a portion of at least one of the wavefronts of the harmful waves with the counter waves and by suppressing such harmful waves from propagating to a target space and/or canceling the harmful waves in the target space, where such base units are arranged to include only portions of the wave source which are responsible for irradiating the harmful waves and/or affecting propagation paths of the harmful waves therethrough and where the target space is defined between at least one of such base units and an user of the system.

In one exemplary embodiment of this aspect of the invention, such an EMC system may have at least one first magnetron tube as well as at least one counter unit which is arranged to be in a preset arrangement with respect to at least one of the wavefronts of the harmful waves and then to emit the counter waves which are arranged to define phase angles at least partially opposite to those of such harmful waves, to at least partially match the portion of the wavefront of such harmful waves due to the arrangement and, accordingly, to counter the harmful waves due to the phase angles in the target space. These counter waves are to be referred to as the "fourth counter waves" hereinafter.

In another exemplary embodiment of this aspect of the invention, an EMC system may include at least one first magnetron tube and at least one counter unit. In one example, the system includes a single counter unit which is arranged to be disposed in a front arrangement and along the wavefront and to emit the fourth counter waves having amplitudes less than those of the harmful waves, where the counter unit is disposed between the target space and at least two of the base units in the front arrangement. In another example, the system instead includes multiple counter units each of which is arranged to be disposed in a front arrangement and along the wavefront and then to emit such fourth counter waves having amplitudes less than those of the harmful waves, where the counter units are disposed between the target space and at least two of the base units in the front arrangement.

In another exemplary embodiment of this aspect of the invention, an EMC system may include at least one first magnetron tube and at least one counter unit. In one example, the system includes a single counter unit which is arranged to be disposed in a rear arrangement and then to emit the fourth counter waves defining amplitudes greater than those of the harmful waves, where the counter unit is disposed on an opposite side of the target space relative to the base unit in the rear arrangement. In another example, the system instead includes multiple counter units each of which is arranged to be disposed in a rear arrangement and to emit the fourth counter waves having amplitudes greater than those of the harmful waves, where the counter units are disposed on an opposite side of the target space relative to the base units in the rear arrangement.

In another aspect of the present invention, an EMC system may have a wave source and may be provided to counter harmful electromagnetic waves irradiated from multiple base units of the wave source with counter electromagnetic waves by matching at least a portion of at least one of multiple wavefronts of the harmful waves with the counter waves and also by canceling the harmful waves by the counter waves in a target space and/or suppressing the harmful waves by the counter waves from propagating to the target space, where the base units are arranged to represent only portions of the source responsible for irradiating the harmful waves and/or affecting paths of the harmful waves therethrough and where the target space is defined between at least one of such base units and an user of the system.

In one exemplary embodiment of this aspect of the invention, such an EMC system may include at least one first magnetron tube as well as a single counter unit. In one example, such a counter unit is arranged to be disposed closer to the target space with respect to at least one of the base units, to be aligned with the portion of only one (or the portions of at least two) of the wavefronts, and to emit the fourth counter waves. In another example, such a counter unit is arranged to be disposed farther away from the target space relative to at least one of the base units, to be in an arrangement which is inverse to the portion of only one (or the portions of at least two) of the wavefronts, and to emit such fourth counter waves.

In another exemplary embodiment of this aspect of the invention, an EMC system may have at least one first magnetron tube and multiple counter units. In one example, at least two of the counter units are arranged to be disposed closer to the target space with respect to at least one of such base units, to be aligned with such a portion of only one (or the portions of at least two) of the wavefronts, and to emit such fourth counter waves. In another example, at least two of the counter units are also arranged to be disposed farther away from the target space with respect to at least one of the base units, to be in an arrangement inverse to the portion of only one (or the portions of at least two) of the wavefronts, and to emit the fourth counter waves.

In another exemplary embodiment of this aspect of the invention, an EMC system may include at least one first magnetron tube and at least one counter unit. In one example, the system includes a single counter unit which is arranged to define a dimension larger (or smaller) than a dimension of at least one of such base units, to be disposed between the target space and such at least one of the base units in an arrangement matching the portion of only one (or the portions of at least two) of the wavefronts, and to emit the fourth counter waves. In another example, the system includes multiple counter units at least two of which are arranged to define dimensions which are larger (or smaller) than a dimension of at least one of the base units, to be disposed between such at least one of the base units and the target space in an arrangement matching the portion of only one (or the portions of at least two) of the wavefronts, and to emit the fourth counter waves.

In another exemplary embodiment of this aspect of the invention, an EMC system may include at least one first magnetron tube as well as a single counter unit. In one example, the counter unit is arranged to be disposed between at least two of the base units and target space in an arrangement which is similar, identical or conforming to the portion of only one (or the portions of at least two) of the wavefronts, and then to emit such fourth counter waves. In another example, the counter unit is arranged to be disposed on an opposite side of the target space with respect to at least one of such base units in an arrangement which is similar, identical or conforming to the portion of only one (or the portions of at least two) of the wavefronts, and to emit the fourth counter waves.

In another exemplary embodiment of this aspect of the invention, an EMC system may include at least one first magnetron tube as well as multiple counter units. In one example, at least two of the counter units are arranged to be disposed between such a target space and at least two of the base units in an arrangement similar, identical or conforming to the portion of only one (or the portions of at least two) of the wavefronts, and to emit the fourth counter waves. In another example, at least two of the counter units are arranged to be disposed on an opposite side of the target space with respect to at least two of the base units in an arrangement similar, identical or conforming to the portion of only one (or the portions of at least two) of the wavefronts, and to emit the fourth counter waves.

In another exemplary embodiment of this aspect of the invention, an EMC system may include at least one first magnetron tube and at least one counter unit. In one example, such a counter unit is arranged to have a shape which is similar, identical or conforming to that of the portion of at least one of such wavefronts, to be disposed between at least two of such base units and target space in an arrangement not similar, not identical or not conforming to such at least one of the wavefronts, and to emit the fourth counter waves. In another example, such a counter unit is arranged to define a shape which is similar, identical or conforming to that of at least one of the wavefronts, to be disposed on an opposite side of the target space with respect to at least two of the base units in an arrangement not similar, not identical or not conforming to the portion of at least one of the wavefronts, and to emit the fourth counter waves. In another example, the counter unit is arranged to define a shape not similar, not identical or not conforming to that of at least one of such wavefronts, to be disposed between the target space and at least two of the base units in an arrangement which is not similar, not identical or not conforming to the portion of at least one of the wavefronts, and to emit the fourth counter waves. In another example, the counter unit is arranged to define a shape which is not similar, not identical or not conforming to that of at least one of such wavefronts, to be disposed on an opposite side of the target space with respect to at least two of the base units in an arrangement which is not similar, not identical or not conforming to the portion of at least one of the wavefronts, and then to emit the fourth counter waves.

In another exemplary embodiment of this aspect of the invention, an EMC system may include at least one first magnetron tube and at least one counter unit. In one example, such a counter unit is arranged to be in an arrangement enclosing the portion of only one (or the portions of at least two) of the wavefronts therein and to emit the fourth counter waves. In another example, the counter unit is arranged to be in an arrangement enclosed by the portion of only one (or the portions of at least two) of the wavefronts and then to emit the fourth counter waves. In another example, the counter unit is arranged to be in a lateral (or side-by-side) arrangement to the portion of only one (or the portions of at least two) of the wavefronts and to emit the fourth counter waves.

In another exemplary embodiment of this aspect of the invention, an EMC system may include at least one first magnetron tube as well as at least one counter unit. In one example, such a counter unit is arranged to emit the fourth counter waves while being aligned with the portion of only one (or portions of at least two) of such wavefronts in one arrangement defining a shape of a wire, a strip, a sheet, a tube, a coil, a spiral, a mesh thereof, a mixture thereof, a combination thereof, and/or an array thereof, and then disposed between the target space and at least one of such base units. In another example, the counter unit is arranged to emit the fourth counter waves while being disposed along the portion of only one (or the portions of at least two) of the wavefronts in one arrangement of a wire, a strip, a sheet, a tube, a coil, a spiral, a mesh thereof, a mixture thereof, a combination thereof, and/or an array thereof and disposed on an opposite side of the target space with respect to at least one of the base units.

In another exemplary embodiment of this aspect of the invention, an EMC system may include at least one first magnetron tube and at least two counter units each of which is arranged to disposed in an arrangement defined on a far side of the target space relative to at least one of such base units and to emit the fourth counter waves so that a sum of the counter waves individually emitted by such counter units defines multiple wavefronts with greater radii of curvature than radii of curvature of the wavefronts of the individual counter waves.

In another aspect of the present invention, an EMC system may have a wave source and may be provided to counter harmful electromagnetic waves irradiated from multiple base units of the wave source with counter electromagnetic waves by matching at least a portion of at least one of multiple wavefronts of the harmful waves with the counter waves and also by canceling the harmful waves by the counter waves in a target space and/or suppressing the harmful waves by the counter waves from propagating to the target space, where the base units are arranged to represent only portions of the source responsible for irradiating the harmful waves and/or affecting paths of the harmful waves therethrough and where the target space is defined between at least one of such base units and an user of the system.

In one exemplary embodiment of this aspect of the invention, such an EMC system may include at least one first magnetron tube and at least one counter unit. In one example, the system includes a single counter unit which is arranged to define a configuration matching that of only one of such base units and to emit such counter waves. In another example, the system includes multiple counter units which are disposed in an arrangement matching a configuration of only one of such base units and to emit the counter waves. In both examples, the counter waves are arranged to define phase angles at least partially opposite to those of the harmful waves, to at least partially match such a portion of the wavefront of the harmful waves due to such a configuration and, accordingly, to counter the harmful waves due to the phase angles in the target space.

In another exemplary embodiment of this aspect of the invention, an EMC system may have at least one first magnetron tube and a single counter unit. In one example, the counter unit is arranged to define a configuration matching an arrangement of at least two but not all of the base units and to emit such counter waves. In another example, the counter unit is arranged to define a configuration matching an arrangement of all of the base units and to emit the counter waves. In both examples, the counter waves are arranged to define phase angles which are at least partially opposite to those of such harmful waves, to at least partially match the portion of the wavefront of the harmful waves due to such a configuration and, accordingly, to counter the harmful waves due to the phase angles in the target space.

In another exemplary embodiment of this aspect of the invention, an EMC system may include at least one first magnetron tube and multiple counter units. In one example, at least two (or all) of the counter units are arranged to be in an arrangement matching an arrangement of at least two but not all of the base units and then to emit such counter waves. In another example, at least two (or all) of the counter units are arranged to be in an arrangement matching an arrangement of all of such base units and to emit the counter waves. In both examples, such counter waves are arranged to define phase angles at least partially opposite to those of such harmful waves, to at least partially match the portion of the wavefront of the harmful waves due to the configuration and, therefore, to counter the harmful waves due to the phase angles in the target space.

In another exemplary embodiment of this aspect of the invention, an EMC system may include at least one first magnetron tube and at least one counter unit. In one example, the system includes a single counter unit which is arranged to have a preset shape, to be arranged in a preset arrangement with respect to at least one of the base units, and to emit the counter waves, where the shape and/or arrangement may match the portion of only one (or the portions of at least two) of the wavefronts. In another example, such a system has multiple counter units all (or at least two but not all) of which are arranged to define an overall preset shape, to be in a preset arrangement with respect to at least one of the base units, and to emit the counter waves, where the shape and/or arrangement is arranged to match the portion of only one (or the portions of at least two) of such wavefronts. In both examples, the counter waves are arranged to have multiple wavefronts at least one of which may be similar (or identical) to the portion of the wavefront of the harmful waves due to the shape and/or arrangement, to define phase angles at least partially opposite to those of such harmful waves and, accordingly, to counter the harmful waves due to the phase angles in the target space.

In another exemplary embodiment of this aspect of the invention, an EMC system may include at least one first magnetron tube and at least one counter unit. In one example, the system includes a single counter unit which is shaped, sized, and disposed to emit such counter waves which are also arranged to match the portion of only one (or the portions of at least two) of the wavefronts of such harmful waves irradiated from only one (or at least two) of the base units. In another example, such a system includes multiple counter units all (or at least two but not all) of which are disposed, shaped, and sized to emit the counter waves a sum of which is arranged to match the portion of only one (or the portions of at least two) of the wavefronts of such harmful waves irradiated from only one (or at least two) of the base units. In both examples, such counter waves are arranged to define multiple wavefronts at least one of which is at least partially similar to (or identical to) the portion of only one (or the portions of at least two) of the wavefronts of the harmful waves due to a disposition, a shape, and/or a size of the counter unit(s), to define phase angles at least partially opposite to those of such harmful waves, and to counter such harmful waves due to the phase angles in the target space.

In another aspect of the present invention, an EMC system may have a wave source and may be provided to counter harmful electromagnetic waves which are irradiated from multiple base units of the wave source with counter electromagnetic waves which are emitted by at least one counter unit of such a system by matching at least a portion of at least one of multiple wavefronts of such harmful waves with the counter waves and by suppressing the harmful waves with the counter waves from propagating toward a target space and/or canceling such harmful waves by the counter waves in the target space, where the base units are arranged to represent only portions of the source responsible for irradiating the harmful waves and/or affecting paths of the harmful waves therethrough, while the target space is defined between at least one of the base units and an user of the system.

In one exemplary embodiment of this aspect of the invention, such an EMC system may include at least one first magnetron tube and at least one counter unit which is then arranged to have a preset shape and a preset size, to be in a preset arrangement which is aligned with the portion of only one (or the portions of at least two) of the wavefronts, and to emit the counter waves, where the counter waves are arranged to have phase angles at least partially opposite to those of the harmful waves, to match the portion of only one (or the portions of at least two) of the wavefronts of the harmful waves and, accordingly, to counter the harmful waves due to the phase angles in the target space.

In another exemplary embodiment of this aspect of the invention, an EMC system may include at least one first magnetron tube as well as multiple counter units. In one example, such counter units are arranged to be in a disposition defined between at least two of the base units and target space, to be in an arrangement which is aligned with the portion of only one (or the portions of at least two) of the wavefronts of the harmful waves and, therefore, to emit the counter waves. In another example, such counter units which are arranged to be in a disposition defined on an opposite side of the target space with respect to the base units, to be in an arrangement which is at least partially inverse to the portion of only one (or at least two portions of at least two) of the wavefronts of the harmful waves, and to emit the counter waves. In both examples, a sum of the counter waves emitted by at least two of the counter units is arranged to have phase angles at least partially opposite to those of the harmful waves, to match the portion of only one (or portions of at least two) of the wavefronts of the harmful waves due to the arrangement and/or disposition and, therefore, to counter the harmful waves due to the phase angles in the target space.

In another aspect of the present invention, an EMC microwave heating system may further be provided to counter harmful electromagnetic waves irradiated from multiple base units of at least one wave source of the system by canceling the harmful waves in a target space and/or suppressing the harmful waves from propagating thereto, where the base units are arranged to include only portions of the wave source which are responsible for irradiating the harmful waves and/or affecting paths of the harmful waves therethrough and where the target space is defined between at least one of such base units and an user of the system.

In one exemplary embodiment of this aspect of the invention, an EMC system includes at least one first magnetron tube and at least one counter unit. In one example, the counter unit is arranged to define a configuration which is identical or similar to at least one of the base units and to emit the first counter waves. In another example, the counter unit is arranged to define a shape which is identical, similar or conforming to that of at least one of the base units and to emit the second counter waves. In another example, the counter unit is arranged to define a shape different from or not conforming to that of at least one of the base units, to be in a preset arrangement with respect to the base units, and to emit the third counter waves. In another example, such a counter unit is arranged to be in a preset arrangement with respect to at least one of the wavefronts of the harmful waves and then to emit the fourth counter waves. In another example, the counter unit is arranged to define a preset shape and a preset size, where the harmful waves form multiple wavefronts therealong and where the counter unit is arranged to be in a preset arrangement aligned with at least a portion of only one (or portions of at least two) of the wavefronts of the harmful waves and to emit the counter waves which are then arranged to define phase angles at least partially opposite to those of the harmful waves, to match the portion of only one (or the portions of such at least two) of the wavefronts of the harmful waves due to the arrangement and, therefore, to counter the harmful waves due to the phase angles in the target space. This counter unit, counter waves, and harmful waves will be respectively referred to as the "fifth counter unit," the "fifth counter waves," and the "fifth harmful waves" hereinafter. In another example, the system includes multiple counter units which are arranged to be in a disposition defined between at least two of the base units and target space, where the harmful waves are arranged to define multiple wavefronts, where the counter unit is arranged to be in an arrangement aligned with at least a portion of only one (or portions of at least two) of such wavefronts of the harmful waves and, accordingly, to emit the counter waves, and where a sum of the counter waves emitted from at least two of the counter units is arranged to define phase angles at least partially opposite to those of the harmful waves, to match the portion of only one (or the portions of at least two) of the wavefronts of the harmful waves due to the disposition and, accordingly, to counter such harmful waves due to the phase angles in the target space. Such a counter unit, counter waves, and harmful waves are to be respectively referred to as the "sixth counter unit," the "sixth counter waves," and the "sixth harmful waves" hereinafter. In another example, the system similarly includes multiple counter units which are arranged to be in a disposition defined on an opposite side of the target space with respect to at least one of the base units, where the harmful waves are arranged to have multiple wavefronts, where the counter unit is arranged to be in an arrangement which is at least partially inverse to at least a portion of only one (or portions of at least two) of the wavefronts of the harmful waves, and then to emit the counter waves, and where a sum of the counter waves emitted by at least two of the counter units is arranged to have phase angles which are at least partially opposite to those of the harmful waves, to match the portion of only one (or the portions of at least two) of the wavefronts of the harmful waves due to the disposition and, accordingly, to counter the harmful waves due to such phase angles in the target space. This counter unit, counter waves, and harmful waves are to be respectively referred to as the "seventh counter unit," "seventh counter waves," and "seventh harmful waves" hereinafter.

In another exemplary embodiment of this aspect of the invention, an EMC system also includes a body, at least one transformer, at least one diode, at least one magnetron tube, at least one stirrer, at least one waveguide, at least one actuator, and at least one counter unit. The body is arranged to include a chamber and at least one door, where such a chamber is arranged to form therein a cooking space, while the door is arranged to couple with the chamber and to open and close such a chamber. Such a body will be referred to as the "first body" hereinafter. The transformer is arranged to receive AC electric energy from a line source and to increase the AC energy to a preset level while irradiating the harmful waves and serving as one of the base units. This transformer is to be referred to as the "first transformer" hereinafter. The diode is arranged to receive such AC energy from the transformer and to convert the AC energy into DC electric energy while irradiating the harmful waves and serving as one of the base units. The magnetron tube is arranged to receive the DC energy through the diode and to irradiate the harmful waves while serving as another of the base units. The waveguide is also arranged to be operatively coupled to the magnetron tube and chamber and to guide at least a portion of the harmful waves irradiated by the magnetron tube to the chamber while serving as another of the base units, where this waveguide is to be referred to as the "first waveguide" hereinafter. The stirrer is arranged to be movably incorporated inside or over the chamber and to reflect the harmful waves, thereby serving as one of such base units. The actuator is arranged to receive the AC or DC energy and to rotate the stirrer while irradiating the harmful waves and serving as another of the base units, where this actuator is to be referred to as the "first actuator" hereinafter. In one example, the counter unit is arranged to define a configuration identical (or similar) to at least one of such base units and to emit the first counter waves. In another example, the counter unit is arranged to have a shape similar, identical or conforming to that of at least one of the base units and to emit the second counter waves. In another example, the counter unit is arranged to define a shape different from or not conforming to that of at least one of the base units, to be in a preset arrangement with respect to the base units, and to emit the third counter waves. In another example, the counter unit is also arranged to be in a preset arrangement with respect to at least one of the wavefronts of the harmful waves and then to emit the fourth counter waves. In another example, the counter unit is arranged to define a preset shape and a preset size as the fifth counter units and to emit the fifth counter waves to counter the fifth harmful waves. In another example, the system includes multiple counter units which are arranged to be in a disposition defined between at least two of the base units and target space as the sixth counter unit and to emit the sixth counter waves to counter the sixth counter waves. In another example, such a system includes multiple counter units which are arranged to be in a disposition which is defined on an opposite side of the target space relative to at least one of the base units as the seventh counter unit and to emit the seventh counter waves to counter the seventh harmful waves.

In another exemplary embodiment of this aspect of the invention, such an EMC system includes the first body, at least one first transformer, at least one magnetron tube, at least one first waveguide, at least one first actuator, and at least one counter unit, where such a magnetron tube is arranged to operate on the DC energy and to irradiate the harmful waves while serving as one of the base units. In one example, the counter unit is arranged to have a configuration identical (or similar) to at least one of the base units, to be incorporated on or inside the door and/or body, and to emit such first counter waves, whereby the counter unit is capable of minimizing an amount of the harmful waves which are irradiated through the door and/or body. In another example, the counter unit is arranged to define a shape similar, identical or conforming to that of at least one of the base units, to be incorporated on or inside the door and/or body, and to emit the second counter waves, whereby the counter unit is also capable of minimizing an amount of such harmful waves which are irradiated through the door and/or body. In another example, the counter unit is arranged to have a shape which is different from or not conforming to that of at least one of the base units, to be in a preset arrangement with respect to the base units, to be incorporated on or inside at least one of the door and body, and then to emit the third counter waves, whereby the counter unit is capable of minimizing an amount of such harmful waves which are irradiated through the door and/or body. In another example, the counter unit is arranged to be in a preset arrangement with respect to at least one of the wavefronts of the harmful waves, to be disposed on or in the door and/or body, and to emit such fourth counter waves, whereby the counter unit is capable of minimizing an amount of the harmful waves irradiated through the door and/or body. In another example, the counter unit is arranged to define a preset shape and a preset size and to be incorporated on or inside at least one of the door and body as the fifth counter unit, whereby such a counter unit is capable of countering the fifth harmful waves by the fifth counter waves and capable of minimizing an amount of the fifth harmful waves irradiated through the door and/or body. In another example, the system includes multiple counter units which are arranged to be in a disposition defined between at least two of the base units and target space and to be incorporated on and/or inside the door and/or body as the sixth counter unit, whereby the counter unit is capable of countering the sixth harmful waves by the sixth counter waves and also capable of minimizing an amount of such harmful waves irradiated through the door and/or body. In another example, the system also includes multiple counter units which are in a disposition defined on an opposite side of the target space with respect to at least one of the base units and to be incorporated on and/or inside the door and/or body as the seventh counter unit, whereby the counter unit is capable of countering the seventh harmful waves by the seventh counter waves and also capable of minimizing an amount of the harmful waves which are irradiated through the door and/or body.

Embodiments of such system aspects of the present invention may include one or more of the following features, and configurational and/or operational variations and/or modifications of the above systems also fall within the scope of the present invention.

At least one of the base units may include at least one wire and/or strip which may be made of and/or include at least one conductive, semiconductive, and/or insulative material. At least one of the base units may include at least one winding made from a wire and/or a strip which may also be made of and/or include at least one conductive, semiconductive, and/or insulative material.

The actuator may be a DC motor, an universal motor, a single- (or three-) phase synchronous AC motor, a single- (or three-) phase induction AC motor, a stepping motor, a linear motor, a brushless DC motor, a switch reluctance motor, a torque motor, a printed circuit motor, a servo motor, a coreless DC motor, and the like. The transformer may be at least one of a step-up transformer, a step-down transformer, an isolating transformer, a current and/or voltage transformer, a polyphase transformer, an autotransformer, a variable transformer, a resonant transformer, a pulse transformers, and an RF transformer. The system may include a Klystron tube instead of the magnetron tube. The signals may be electrical signals, optical signals, magnetic signals, and the like.

Such harmful waves may include carrier-frequency waves having frequencies less than from about 50 Hz to 60 Hz, extremely low-frequency waves of frequencies less than 300 Hz, other waves having frequencies less than 1 kHz, 5 kHz, 10 kHz, 20 kHz, 50 kHz, 100 kHz, 500 kHz, 1 MHz, 10 MHz, 50 MHz, 100 MHz, 500 MHz, 1 GHz, 5 GHz, 10 GHz, 50 GHz, 100 GHz, 500 GHz, 1 THz, and the like, where the counter waves may define frequencies similar to (or greater than, less than) those of such harmful waves. The harmful waves may be ultra low-frequency waves having frequencies less than 3 kHz, very low-frequency waves with frequencies less than 30 kHz, low-frequency waves defining frequencies less than 300 kHz, and the like, where such counter waves may have frequencies similar to (or greater than, less than) those of such harmful waves. The target space may be formed on one side of the counter unit and at least one of such base units, around a preset angle around the counter unit or at least one of the base units, between the counter unit and at least one of the base units, and the like.

The countering may include the above canceling and/or suppressing. Such a counter unit may receive the electric energy and actively emit the counter waves or, in the alternative, may not receive the electric energy but passively emit the counter waves due to an electromagnetic induction caused by the magnetic flux flowing in the core. The counter unit may counter the harmful waves by a local countering in which the counter unit may counter only one of the base units or, in the alternative, may counter the harmful waves in a global countering in which the counter unit may counter at least two of such base units. The counter unit may include at least one electric conductor in which the current may flow, at least one electric conductor and/or insulator across which such voltage may be applied, and the like.

The counter unit may be disposed side by side or stacked with at least one of the base units, may wind around at least one of the base units along a preset length, may concentrically enclose at least one of the base units therein, may be enclosed inside at least one of the base units, may instead be axially aligned with at least one of the base units, and the like. Such a counter unit may be spaced from at least one of the base units at a preset distance, may mechanically, electrically or magnetically couple with at least one of the base units, may define an unitary article with at least one of such base units, and the like. Such a counter unit may be retained by at least one support and maintain its shape while emitting the harmful waves or, in the alternative, may vary its shape while emitting such counter waves. The configuration and/or disposition of the counter unit may be determined based on whether the counter unit is to match a configuration of at least one of the base units or to match at least one of the wavefronts of the harmful waves.

Such a counter unit may define the shape identical to, similar to or different from that of at least one of the base units, that of the wave source, and so on. The counter unit may have a shape of the wire, strip, sheet, tube, coil, spiral, mesh, mixture of at least one of such shapes, combination thereof, array thereof, and so on. The array may form a bundle of at least two of the shapes, a braid thereof, a coil thereof, a mesh thereof, and the like. The shape of the counter unit may (or not) conform to that of at least one of the base units, that of the wave source, and the like. The counter unit may form the 1-D, 2-D, and/or 3-D analogs of at least one of the base units, of the wave source, and the like. Such a counter unit may form only one of the analogs or at least two of the analogs or, alternatively, multiple counter units may define only one of the analogs or at least two of the analogs. Such an analog may maintain a similarity with at least one of such base units, with the source, and the like. At least two of the analogs as a whole may maintain a similarity with at least one of the base units, the wave source, and the like. At least two portions of the counter unit and/or at least two counter units may define the same shape of different sizes, different shapes of similar or different sizes, and the like. The counter unit may also define at least substantially uniform shape and/or size along at least a substantial portion thereof along its longitudinal axis, may define the shape and/or size changing along the portion and/or axis, and the like. The size of the counter unit may (or not) conform to that of at least one of the base units, to the wave source, and the like. The counter units may be disposed in the arrangement which may be identical to, similar to or different from the shape of at least one of the base units, the shape of the wave source, the arrangement of at least two of such base units, the arrangement of the wave source, and the like. At least two of the counter units may be in an arrangement which conforms (or not) to the shape of at least one of the base units, the shape of the wave source, the arrangement of at least two of the base units, the arrangement of the wave sources, and the like. The counter units may be disposed in a symmetric (or asymmetric) arrangement with respect to each other, at least one of the base units, the wave source, and the like. The counter unit may be aligned with (or misaligned from) the propagation direction of the harmful waves, the direction of the electric energy (i.e., current or voltage), the longitudinal axis of at least one of such base units, the short axis of at least one of the base units, one of the axes of the wave source, and the like. All of (or only some of, one of, none on the counter units may be aligned with (or misaligned from) at least one of the directions and/or axes. The counter unit and at least one of the base units may be disposed at an identical or similar distance from the target space. At least a portion of the counter unit and/or at least one of the base units may be disposed in another of the units or, in the alternative, the counter unit and at least one of the base units may be axially disposed along a single common axis of at least two of the units, and the like. The counter units may be in an angular arrangement defined around the longitudinal axis of at least one of the base units, the wave source, and the like. Such a counter unit may also be movably or stationarily disposed closer to (or farther away from) the target space than at least one of the base units, such a wave source, and the like. The counter unit and/or at least one of the base units may be disposed on the same side of the target space or, in the alternative, the counter unit may be disposed on opposite sides of the target space. The counter unit may conform to only one of the base units or at least two of the base units or, in the alternative, at least two of the counter units may conform to only one of the base units or at least two of the base units.

Such a counter unit may counter the harmful waves irradiated from only one of the magnetron tube, actuator, transformer, diode, and the like. The counter unit may also counter the harmful waves irradiated from at least two of the magnetron tube, actuator, transformer, and diode. The system may include multiple counter units each of which may counter the harmful waves irradiated by each one of the magnetron tube, actuator, and transformer. The system may include multiple counter units each of which may be disposed closer to each one of the magnetron tube, actuator, and transformer. Such a counter unit may be disposed on an exterior or interior of and/or embedded in at least one of the base units, the wave source, and the like. The counter unit may also be disposed on, in or inside the door, a front or a rear of the body, a top or bottom of the body, and the like. At least a (or an entire) portion of at least one of the base units may be exposed through the wave source or may be disposed in the wave source. At least a (or an entire) portion of the counter unit may also be exposed through such a body or may be disposed inside the body. Such a counter unit may be directly coupled to the door or body, at least one of such base units, and/or other parts of the system, may be indirectly coupled thereto through at least one coupler, and the like.

Such a counter unit and at least one of the base units may be made of and/or include at least one common material, may be made of and/or include at least one same materials, or may not include any common material. The counter unit may be arranged to emit the counter waves by using the least amount of material, while consuming the least amount of the current and/or voltage, and the like. Such base units may be supplied with source current and/or voltage, where the current or voltage may be supplied to the counter unit as counter current or voltage, where only a portion of the source current or voltage may be supplied to the counter unit as the counter current or voltage, where an amplitude and/or a direction of at least a portion of the source current or voltage may be altered and supplied to the counter unit as the counter current or voltage, where external current or voltage may be formed and synchronized with the source current or voltage, and supplied to the counter unit as the counter current or voltage, and the like. The counter units may be supplied with identical counter currents or voltages, with different counter currents or voltages, and the like. The counter unit and at least one of the base units may electrically couple to each other in a series mode, in a parallel mode or in a hybrid mode or, alternatively, may not be directly coupled to each other. The counter units may be electrically coupled to each other in a series mode, in a parallel mode or in a hybrid mode or, alternatively, may not be directly coupled to each other. All (or only some) of the counter units may be electrically coupled to at least one of the base units in the same mode or, in the alternative, none of the counter units may be electrically coupled to at least one of the base units in the same mode. Such counter waves may define amplitudes greater than, similar to or less than those of the harmful waves depending upon the disposition thereof with respect to at least one of the base units. The counter unit and at least one of such base units may define substantially identical, similar or different resonance frequencies or, in the alternative, may define the identical, similar or different resonance frequencies. In addition, at least a portion of a single counter unit and/or at least one of the multiple counter units may define resonance frequencies different from those of the rest thereof.

The system may include at least one of the magnetic shields described hereinabove or in the co-pending Applications. The magnetic shields may be disposed in, on, over, around, and/or through at least one of the counter and/or base units. The magnetic shields may define shapes which may at least partially conform to the shapes of the counter unit and/or base units or, alternatively, may define shapes which may be at least partially different from shapes of the counter unit and/or base units. The magnetic shield may have at least one path member with a relative magnetic permeability greater than 1,000, 10,000, 100,000 or 1,000,000. The magnetic shield may also include at least one magnet member defining at least one South pole. The magnetic shield may include at least one shunt member which may directly or indirectly couple with the magnet member, where the shunt member may define the relative magnetic permeability which may be greater than 1,000, 10,000, 100,000, 1,000,000, and the like. The magnetic shield described hereinabove or disclosed in the co-pending Applications may be incorporated into any of the devices described hereinabove.

The system may include at least one of the electric shields described hereinabove or in the co-pending Applications, where the electric shields described hereinabove or disclosed in the co-pending Applications may be incorporated to any of the devices described hereinabove. The magnetic and/or electric shields may form shapes and/or sizes which may be maintained uniform along the longitudinal axis of the counter unit and/or base units or which may change therealong. The shapes and/or sizes of the magnetic and/or electric shields may also be identical to, similar to or different from those of the counter unit and/or base units. The system may include multiple magnetic and/or electric shields. At least two of such magnetic and/or electric shields may also shield against the magnetic waves and/or electric waves of the harmful waves with same or different frequencies in same or different extents. The magnetic and/or electric shields may be disposed over at least a portion (or entire portion) of the counter and/or base units.

In another aspect of the present invention, a method may be provided for countering harmful electromagnetic waves irradiated by multiple base units of at least one wave source of a microwave heating system by emitting counter electromagnetic waves, through adjusting shapes of the counter waves, and through canceling the harmful waves with the counter waves in the target space and/or suppressing the harmful waves by the counter waves from propagating to the target space, where the wave source includes a magnetron tube, a transformer, and/or an electric actuator, where such base units are arranged to include only portions of the wave source responsible for irradiating such harmful waves and/or affecting paths of the harmful waves therethrough, where the target space is formed between an user and at least one of the base units, where such counter waves propagate while forming at least one first wavefront, and where the harmful waves propagate while forming at least one second wavefront.

In one exemplary embodiment of this aspect of the invention, a method may have the steps of: providing at least one counter unit for emitting such counter waves (the "first providing" hereinafter); extending the counter unit to be wider (or longer) than at least one of the base units in a single wave source; disposing the counter unit between at least one of such base units and user while aligning a width (or length) of the counter unit with at least a portion of the second wavefront; and emitting the counter waves aligned with and at least partially similar to the harmful waves due to such extending and disposing, thereby countering the harmful waves therewith in the target space. Such extending and disposing may be replaced by the steps of: extending the counter unit to be wider (or longer) than at least two of the base units of at least two different wave sources; and disposing the counter unit between at least one of the base units and user while aligning a width (or length) of the counter unit with at least a portion of the second wavefront. Such extending and disposing may also be replaced by the steps of: extending the counter unit to be narrower (or shorter) than at least one of the base units; and disposing the counter unit on an opposite side of the space relative to at least one of such base units while aligning a width (or a length) of the counter unit with at least a portion of the second wavefront.

In another exemplary embodiment of this aspect of the invention, a method may have the steps of: providing a single counter unit for emitting such counter waves; assessing at least one location in the target space where at least a portion of the first wavefront best matches at least a portion of the second wavefront; and disposing the counter unit in the location to emit the counter waves, thereby countering the harmful waves with the counter waves in the target space.

In another exemplary embodiment of this aspect of the invention, a method may have the steps of: providing at least two counter units each capable of emitting the counter waves; emitting from the counter units the counter waves having phase angles similar (or identical) to each other while forming a first sum of the first wavefronts of the counter waves emitted by the counter units; finding a relation between a distance between such counter units and an increase in a radius of curvature of the first wavefront of such a first sum; selecting the distance between the counter units for a preset radius of curvature; assessing at least two locations for the counter units in the target space where at least a portion of the first sum matches at least a portion of the second wavefront; and disposing the counter units in the locations spaced by the distance, thereby countering the harmful waves with the counter waves in the target space. Such emitting and finding may be replaced by the steps of: emitting from the counter units the counter waves having phase angles at least partially opposite to each other and defining a first sum of the first wavefronts of the counter waves emitted from such counter units; and then finding a relation between a distance between such counter units and a decrease in a radius of curvature of the first wavefront of the first sum.

In another aspect of the present invention, a method may also be provided to counter harmful electromagnetic waves irradiated by multiple base units of at least one wave source of a microwave heating system by matching at least one feature of at least one of the base units and by canceling the harmful waves in a target space and/or suppressing the harmful waves from propagating toward the target space, where the wave source includes a magnetron tube, a transformer, and/or an actuator, where the base units are arranged to include only portions of the wave source which are responsible for irradiating the harmful waves and/or affecting paths of such harmful waves therethrough, where the target space is formed between an user and at least one of the base units, while such a feature includes at least one of a shape, a size, and an arrangement.

In one exemplary embodiment of this aspect of the invention, a method may have the steps of: providing at least one counter unit capable of emitting counter electromagnetic waves; configuring the counter unit to match the feature of at least one of such base units of a single wave source; emitting the counter waves similar to the harmful waves due to the configuring; and disposing the counter unit in a location for best matching the harmful waves in the target space with the counter waves, thereby countering the harmful waves with the counter waves therein. Such configuring may be replaced by one of the steps of: configuring the counter unit to match the feature of at least two of the base units of at least two different wave sources; configuring the counter unit to define a configuration which is simpler than that of at least one of such base units of a single wave source while keeping the feature; configuring the counter unit to define a configuration simpler than that of at least two of the base units of at least two different wave sources while maintaining the feature; configuring the counter unit to define a configuration more complex than that of at least one of the base units while at least minimally maintaining the feature; configuring the counter unit to have a dimension defined by a less number of unit axes than at least one of such base units while at least minimally keeping the feature; configuring the counter unit to have a dimension which is defined by a greater number of unit axes than that of at least one of the base units while at least minimally maintaining the feature, and the like.

In another exemplary embodiment of this aspect of the invention, a method may have the steps of: providing a single counter unit capable of emitting counter electromagnetic waves; configuring the counter unit to define a configuration simpler than that of only one of the base units while maintaining the feature; emitting the counter waves which are similar to the harmful waves due to the configuring; and disposing the counter unit in a location for best matching such harmful waves in the target space with the counter waves, thereby countering the harmful waves with the counter waves therein. The above configuring may also be replaced by one of the steps of: configuring the counter unit to have a configuration simpler than that of at least two of the base units of at least two different wave sources while maintaining the feature; configuring the counter unit to define a configuration similar (or identical) to an arrangement of all (or at least two but not all) of such base units of a single wave source while keeping the feature; configuring the counter unit to have a configuration which is similar (or identical) to an arrangement of all (or at least two but not all) of such base units of at least two different wave sources while keeping the feature; configuring the counter unit to be formed in a dimension which is defined by a less number of mutually orthogonal unit axes than an arrangement of all (or at least two but not all) of the base units while maintaining the feature; configuring the counter unit to be formed in a dimension defined by a greater number of mutually orthogonal unit axes than an arrangement of all (or at least two but not all) of the base units while maintaining the feature, and the like.

In another exemplary embodiment of this aspect of the invention, a method may have the steps of: providing multiple counter units each capable of emitting counter electromagnetic waves; arranging at least two of the counter units in a configuration simpler than that of only one of the base units while maintaining the feature; emitting the counter waves similar to the harmful waves due to the arranging; and disposing such counter units in locations for matching the harmful waves in the target space with the counter waves, thereby countering the harmful waves by the counter waves therein. The above arranging may also be replaced by one of the steps of: arranging at least two of the counter units in a configuration simpler than that of at least two of the base units of at least two different wave sources while maintaining the feature; arranging at least two of such counter units in a configuration which is similar (or identical) to an arrangement of all (or at least two but not all) of such base units of a single wave source while keeping the feature; arranging at least two of the counter units in a configuration which is similar (or identical) to an arrangement of all (or at least two but not all) of such base units of at least two different wave sources while maintaining the feature; arranging the counter units in an arrangement defining a dimension which is formed by a less number of mutually orthogonal unit axes than an arrangement of at least one of the base units while maintaining the feature; and arranging the counter units in an arrangement with a dimension formed by a greater number of mutually orthogonal unit axes than an arrangement of at least one of the base units while maintaining the feature.

In another exemplary embodiment of this aspect of the invention, such a method may have the steps of: providing a smaller number of the counter units than the base units of a single wave source; arranging such counter units while approximating an arrangement of all (or at least two but not all) of the base units and while maintaining the feature; emitting the counter waves which are similar to the harmful waves due to the arranging; and then disposing the counter unit in a location for matching the harmful waves in the target space with the counter waves, thereby countering the harmful waves by the counter waves therein. Such providing and arranging may be replaced by the steps of: providing a smaller number of the counter units than the base units of at least two different wave sources; and arranging such counter units while approximating an arrangement of all (or at least two but not all) of the base units and while maintaining the feature. Such providing and arranging may also be replaced by the steps of: providing a greater number of the counter units than the base units of a single wave source; and arranging the counter units while disposing at least two of such counter units around at least one of the base units and while maintaining the feature. Such providing and arranging may also be replaced by the steps of: providing a greater number of the counter units than the base units of at least two different wave sources; and arranging the counter units while disposing at least two of the counter units around at least one of the base units and while maintaining the feature.

In another exemplary embodiment of this aspect of the invention, a method may have the steps of: providing at least one counter unit capable of emitting counter electromagnetic waves; configuring the counter unit to move with respect to at least one of the base units; emitting such counter waves by the counter unit; finding a relation between a distance between the counter unit and at least one of the base units and matching between the counter and harmful waves; assessing a location in which the counter waves best match the harmful waves; and then moving the counter unit to the location to match the harmful waves in the target space with the counter waves, thereby countering the harmful waves by the counter waves therein.

In another aspect of the present invention, a method may be provided for countering harmful electromagnetic waves irradiated by multiple base units of at least one wave source of a microwave heating system by emitting counter electromagnetic waves and matching the harmful waves therewith and by canceling the harmful waves in a target space and/or suppressing such harmful waves from propagating toward the target space, where the wave source has a magnetron tube, a transformer, and an actuator, where the base units are arranged to include only portions of such a wave source responsible for irradiating the harmful waves and/or affecting paths thereof therethrough, where the target space is defined between at least one of the base units and an user of the system, where the counter waves propagate while defining at least one first wavefront, and where the harmful waves define at least one second wavefront.

In one exemplary embodiment of this aspect of the invention, a method may have the steps of: the first providing; disposing the counter unit along at least a portion of the second wavefront of such harmful waves irradiated from only one of the base units; and then emitting the counter waves while matching at least a portion of the second wavefront with at least a portion of the first wavefront in the target space due to such disposing, thereby countering the harmful waves with such counter waves therein. Such disposing may be replaced by one of the steps of: disposing the counter unit along at least a portion of the second wavefront of the harmful waves irradiated by all (or at least two but not all) of such base units; disposing the counter unit along at least a portion of the second wavefront of the harmful waves irradiated by at least one of the base units of a single wave source; and disposing the counter unit along at least a portion of the second wavefront of the harmful waves irradiated by at least two of the base units of at least two different wave sources.

In another exemplary embodiment of this aspect of the invention, a method may have the steps of: the first providing; configuring the counter unit to match a shape and/or arrangement thereof with a shape and/or arrangement of the first wavefront; disposing the counter unit along (or across) at least a portion of the second wavefront; and emitting such counter waves while matching at least a portion of the second wavefront with at least a portion of the first wavefront in the target space due to such configuring and disposing, thereby countering the harmful waves by the counter waves therein. The above configuring and disposing may also be replaced by the steps of: configuring the counter unit to define a shape and/or arrangement at least partially different from (or not conforming to) at least one of a shape and an arrangement of the first wavefront; and then disposing the counter unit across (or along) at least two different and spaced apart portions of the second wavefront.

In another exemplary embodiment of this aspect of the invention, a method may have the steps of: the first providing; disposing multiple counter units in an arrangement along at least a portion of the second wavefront; configuring the counter units to match its arrangement with an arrangement of the first wavefront; and then emitting such counter waves while aligning at least a portion of the second wavefront with at least a portion of the first wavefront in the target space due to such disposing and configuring, thereby countering the harmful waves by the counter waves therein. The disposing and configuring may also be replaced by the steps of: disposing multiple counter units in an arrangement across (or along) at least two different portions of the second wavefront; and configuring the counter units to mismatch the arrangement thereof with an arrangement of the first wavefront.

In another exemplary embodiment of this aspect of the invention, a method may have the steps of: the first providing; placing the counter unit between the target space and at least one of such base units; comparing a shorter radius of curvature of the first wavefront to a longer radius of curvature of the second wavefront; and then disposing the counter unit in a location of the target space where the radii of curvature of the first and second wavefronts best match each other, thereby countering such harmful waves with the counter waves therein. Such placing and comparing may be replaced by the steps of: placing the counter unit on an opposite side of the target space with respect to at least one of the base units; and then comparing a longer radius of curvature of the first wavefront to a shorter radius of curvature of the second wavefront.

In another exemplary embodiment of this aspect of the invention, a method may have the steps of: the first providing; configuring the counter unit to move relative to at least one of such base units; finding a relation between a distance between the counter unit and at least one of the base units and matching between radii of curvature of the first and second wavefronts; assessing a location where the first and second wavefronts match each other; and then moving the counter unit to the location for matching the harmful waves in the target space with the counter waves, thereby countering such harmful waves with the counter waves therein.

In another aspect of the present invention, a method may be provided for countering harmful electromagnetic waves irradiated by multiple base units of at least one wave source of a microwave heating system through emitting counter electromagnetic waves from at least one counter unit and by propagating the counter waves along a preset direction toward the harmful waves, where the wave source includes a magnetron tube, a transformer, an actuator, and the like, where the base units are arranged to include only portions of the source responsible for irradiating such harmful waves and/or affecting paths of the harmful waves therethrough, and where the target space is defined between at least one of the base units and an user of the system.

In one exemplary embodiment of this aspect of the invention, a method may have the steps of: configuring the counter waves to define shapes similar to those of the harmful waves and to have at least partially opposite phase angles (the "first configuring" hereinafter); enclosing at least a portion of at least one of the base units by (or in) at least a portion of the counter unit; and emitting such counter waves while enclosing the harmful waves in the target space, thereby countering the harmful waves with the counter waves therein. The above enclosing may also be replaced by the step of: disposing multiple counter units around at least one of the base units.

In another exemplary embodiment of this aspect of the invention, a method may have the steps of: the first configuring; disposing at least a portion of the counter unit inside at least one of such base units; and emitting the counter waves while being enclosed by the harmful waves in the target space, thereby countering the harmful waves by the counter waves therein. The disposing may be replaced by the step of: enclosing at least a portion of the counter unit by at least two of the base units.

In another exemplary embodiment of this aspect of the invention, a method may have the steps of: the first configuring; disposing the counter unit lateral to at least one of the base units; and emitting the counter waves to the target space along with the harmful waves, thereby countering the harmful waves with the counter waves therein. Such disposing may also be replaced by one of the steps of: disposing the counter unit along a longitudinal axis of at least one of such base units and also away therefrom; and enclosing at least a portion of one of the counter unit and at least one of the base units by another of the units.

In another exemplary embodiment of this aspect of the invention, a method may have the steps of: the first configuring; aligning the counter unit in a direction of propagation of such harmful waves; and emitting the counter waves to the target space along with the harmful waves, thereby countering the harmful waves by the counter waves therein. Such aligning may be replaced by one of the steps of: aligning the counter unit along a direction of electric current and/or voltage applied to at least one of the base units; aligning the counter unit with a longitudinal axis of at least one of the base units; and aligning the counter unit with a short axis of at least one of the base units.

In another exemplary embodiment of this aspect of the invention, a method may have the steps of: the first configuring; disposing the counter unit between at least one of such base units and target space; emitting by the counter unit the counter waves with amplitudes less than those of the harmful waves; and propagating the counter waves toward the target space along with the harmful waves, thereby countering the harmful waves with the counter waves therein. Such disposing and emitting may be replaced by the steps of: disposing the counter unit on an opposite side of the target space with respect to at least one of the base units; and emitting by the counter unit with the counter waves defining amplitudes greater than those of the harmful waves.

In another exemplary embodiment of this aspect of the invention, a method may have the steps of: the first configuring; disposing the counter unit between at least one of such base units and target space; extending the counter unit to a width greater than that of at least one of the base units along a direction normal to a direction of propagation of the harmful waves; and emitting such counter waves toward the target space along with the harmful waves, thereby countering the harmful waves by the counter waves therein. Such disposing and extending may be replaced by the steps of: disposing the counter unit on an opposite side of the target space with respect to at least one of the base units; and extending the counter unit to a width less than that of at least one of such base units along a direction normal to a direction of propagation of the harmful waves.

In another aspect of the present invention, a method may be provided for countering harmful electromagnetic waves irradiated by multiple base units of at least one wave source of a microwave heating system by emitting counter electromagnetic waves and by canceling the harmful waves with the counter waves in a target space and/or suppressing the harmful waves with the counter waves from propagating toward the target space, where such a wave source includes a magnetron tube, a transformer, and/or an actuator, where the base units are arranged to include only portions of such a wave source which are responsible for irradiating the harmful waves and/or affecting paths of such harmful waves therethrough, and where the target space is formed between an user and base units.

In one exemplary embodiment of this aspect of the invention, a method may have the steps of: providing a single counter unit for emitting the counter waves; the first configuring; and countering the harmful waves which are irradiated from only one of the base units by the counter waves.

In another exemplary embodiment of this aspect of the invention, a method may have the steps of: providing a single counter unit for emitting the counter waves; the first configuring; and countering a sum of the harmful waves irradiated from all (or at least two but not all) of the base units of a single wave source with the counter waves. Such countering may be replaced by the step of: countering a sum of the harmful waves irradiated by all (or at least two but not all) of the base units of at least two different wave sources with the counter waves.

In another exemplary embodiment of this aspect of the invention, a method may have the steps of: providing multiple counter units for emitting the counter waves; the first configuring; and countering the harmful waves which are irradiated from only one of the base units by a sum of all of the counter waves emitted by all of the counter units.

In another exemplary embodiment of this aspect of the invention, a method may have the steps of: providing multiple counter units for emitting the counter waves the first configuring; and countering a sum of the harmful waves irradiated from all (or at least two but not all) of the base units of a single wave source with a sum of the counter waves emitted from at least two of such counter units. Such countering may be replaced by the step of: countering a sum of the harmful waves irradiated from all (or at least two but not all) of the base units of at least two different wave sources with a sum of the counter waves emitted from at least two of the counter units.

In another exemplary embodiment of this aspect of the invention, a method may have the steps of: providing at least two counter units for emitting the counter waves; configuring at least one of the counter units to move with respect to the other thereof; the first configuring; and moving such at least one of the counter units relative to at least one of the base units in the emitting, thereby countering the harmful waves irradiated by only one of the base units by the counter waves emitted from a different number of the counter units.

In another aspect of the present invention, another method may be provided to counter harmful electromagnetic waves which are irradiated by at least one base unit of at least one wave source of a microwave heating system by emitting counter electromagnetic waves toward the harmful waves, where the wave source includes a magnetron tube, a transformer, and an/or actuator and where the base unit is arranged to be shaped into at least one curvilinear wire.

In one exemplary embodiment of this aspect of the invention, a method may have the steps of: the first providing; shaping the counter unit into a wire, strip, and/or sheet; disposing the counter unit along and close to the wire; and supplying electric energy to the base unit of the wire and counter unit in opposite directions while emitting the counter waves by the counter unit for countering the harmful waves by the counter waves (the "first supplying" hereinafter). Such disposing may be replaced by the step of: braiding the counter unit around and close to the wire.

In another exemplary embodiment of this aspect of the invention, a method may have the steps of: providing multiple counter units each of which is shaped as a wire, strip, and/or sheet; disposing the counter units around and also close to the wire; and, the first supplying. The above disposing may be also replaced by the step of: braiding each of the counter units around and close to the wire in the same or different directions.

In another exemplary embodiment of this aspect of the invention, a method may have the steps of: the first providing; shaping the counter unit into at least one coil and/or spiral; winding the counter unit around the wire; and the first supplying. Such shaping and winding may be replaced by the steps of: shaping the counter unit into a sheet and/or a mesh; and winding the counter unit around the wire. Such shaping and winding may instead be replaced by the steps of: shaping the counter unit into an annular tube with a lumen; and disposing the wire inside the lumen of the counter unit.

In another exemplary embodiment of this aspect of the invention, a method may have the steps of: identifying multiple wavefronts of such harmful waves defined around the wire; disposing at least one counter unit along at least one of the wavefronts; and emitting by such a counter unit the counter waves of multiple wavefronts similar (or identical) to the wavefronts of the wire, thereby countering the harmful waves with the counter waves.

In another aspect of the present invention, another method may be provided to counter harmful electromagnetic waves which are irradiated by at least one base unit of at least one wave source of a microwave heating system by emitting counter electromagnetic waves toward the harmful waves, where the wave source includes a magnetron tube, a transformer, and an/or actuator and where the base unit is arranged to be shaped into at least one curvilinear strip.

In one exemplary embodiment of this aspect of the invention, a method may have the steps of: the first providing; shaping the counter unit as a wire, a strip, and/or a sheet; and supplying electric energy to the base unit of the strip (or sheet) and counter unit in opposite directions while emitting the counter waves by the counter unit in order to counter the harmful waves by the counter waves (the "second supplying" hereinafter). Such shaping may be replaced by one of the steps of: disposing the counter unit along and close to the strip (or sheet); and braiding the counter unit around and close to the strip (or sheet).

In another exemplary embodiment of this aspect of the invention, a method may have the steps of: providing multiple counter units each of which is shaped into a wire, strip, and/or sheet; disposing the counter units around and close to the strip (or sheet); and the second supplying. Such disposing may be replaced by the step of: braiding each counter unit around and close to the strip (or sheet) in one of same and different directions.

In another exemplary embodiment of this aspect of the invention, a method may have the steps of: the first providing; shaping the counter unit into at least one coil and/or spiral; winding the counter unit around the strip (or sheet); and the second supplying. The shaping and winding may be replaced by the steps of: shaping the counter unit into a sheet and/or a mesh; and winding such a counter unit around the strip (or sheet). Such shaping and winding may be replaced by the steps of: shaping the counter unit as a pair of strips (or sheets); and disposing the wire between the strips (or sheets).

In another exemplary embodiment of this aspect of the invention, a method may have the steps of: identifying multiple wavefronts of the harmful waves around the strip (or sheet); disposing at least one counter unit along at least one of the wavefronts; and emitting from the counter unit such counter waves of multiple wavefronts similar (or identical) to such wavefronts of the strip (or sheet), thereby countering the harmful waves with the counter waves.

In another aspect of the present invention, a method may be provided for countering harmful electromagnetic waves which are irradiated by at least one base unit of at least one wave source of a microwave heating system by emitting counter electromagnetic waves toward the harmful waves, where the wave source includes a magnetron tube, a transformer, and/or an actuator and where the base unit is arranged to be shaped into at least one curvilinear coil.

In one exemplary embodiment of this aspect of the invention, a method may have the steps of: the first providing; shaping the counter unit as a toroid by disposing opposing ends of the coil close to each other; supplying the electric energy in the coil; and supplying electric energy to the wave source of the coil and counter unit in opposite directions while emitting the counter waves by the counter unit for countering the harmful waves by the counter waves.

In another exemplary embodiment of this aspect of the invention, a method may have the steps of: the first providing;

shaping the counter unit as a wire, a strip, and/or a spiral which is smaller than the coil of the base unit; winding the coil of the base unit around the counter unit; and then the fourth supplying. Such shaping and winding may be replaced by the steps of: shaping the counter unit as another coil smaller than the coil of the base unit; and then winding the coil of the base unit around the counter unit.

In another exemplary embodiment of this aspect of the invention, a method may have the steps of: the first providing; shaping the counter unit as another coil; disposing the coils of the counter and base units adjacent to each other; and the fourth supplying. Such disposing may be replaced by the step of: braiding the coils of the counter and base units.

In another exemplary embodiment of this aspect of the invention, a method may have the steps of: identifying multiple wavefronts of the harmful waves formed around the coil; disposing at least one counter unit along at least one of the wavefronts; and emitting by the counter unit the counter waves of multiple wavefronts which are similar or identical to the wavefronts of the tube, thereby countering the harmful waves with the counter waves.

Embodiments of such method aspects of the present invention may include one or more of the following features, and configurational and/or operational variations and/or modifications of the above methods also fall within the scope of the present invention.

Such countering may include the step of: countering the harmful waves but preserving audible sound waves. The countering may include at least one of the steps of: suppressing at least a portion of the harmful waves from propagating to the target space with the counter waves; and canceling the portion of the harmful waves by the counter waves in the target space. Such countering may include at least one of the steps of: countering the harmful waves with frequencies less than about 50 Hz to 60 Hz; countering the harmful waves of frequencies less than about 300 Hz; countering the harmful waves of frequencies less than about 1 kHz, and the like. The countering may include at least one of the steps of: countering the harmful waves with frequencies less than about 10 kHz; countering such harmful waves of frequencies less than about 100 kHz; countering the harmful waves of frequencies less than about 1 MHz, 10 MHz, 100 MHz, 1 GHz, 10 GHz, 100 GHz, 1 THz, and so on. The countering may include at least one of the steps of: countering such harmful waves in only a portion of a preset frequency range while preserving the rest thereof; countering magnetic waves of the harmful waves; countering an entire portion of the harmful waves, and the like. The affecting may include at least one of the steps of: including a permanent magnet; incorporating a highly magnetically permeable material; applying the electric voltage; flowing the electric current, and the like.

Such extending may include one of the steps of: lengthening the counter unit along its length; widening the counter unit along its width, and the like. The providing may include at least one of the steps of: forming the counter unit into a shape of a wire, a strip, a sheet, a tube, a coil, a spiral, and a mesh; forming the counter unit into one of a mixture of the shapes, a combination of the shapes, and an array of the shapes, and the like. The forming may include at least one of the steps of: enclosing at least a portion of at least one of the base units with an array (or a bundle) of multiple wires of the counter unit; enclosing the portion of at least one of the base units by an array (or bundle) of multiple strips of the counter unit; enclosing therein the portion of at least one of the base units by an array (or bundle) of multiple sheets of the counter unit; enclosing the portion of at least one of the base units by an array (or bundle) of multiple tubes of the counter unit; winding with at least one coil of the counter unit about the portion of at least one of the base units; winding the portion of at least one of the base units by an array (or bundle) of multiple coils; enclosing the portion of at least one of the base units by at least one annular mesh of the counter unit, and the like. The forming the counter unit may include at least one of the steps of: extending a single wire for at least a portion of the counter unit; extending an array (or bundle) of multiple wires for the portion; extending a single strip for the portion; extending an array (or bundle) of multiple strips for the portion; extending a single sheet therefor; extending an array (or bundle) of multiple sheets for such a portion; extending a single tube therefor; extending a bundle (or array) of multiple tubes therefor; winding a single coil therefor; winding a bundle (or array) of multiple coils therefor; extending a single annular mesh therefor; and extending an array (or bundle) of multiple annular meshes therefor.

The providing may include one of the steps of: exposing the counter unit through the base unit; hiding the counter unit under (or inside) the base unit, and the like. The providing may include at least one of the steps of: fixedly disposing the counter unit; movably disposing the counter unit, and so on. The providing may include one of the steps of: forming the base and counter units of a same material; forming the base and counter units of different materials; including at least one but not all of materials in the base and counter units, and the like. The providing may include one of the steps of: arranging the base and counter units to have similar (or identical) resonance frequencies; arranging the base and counter units to define different resonance frequencies, and the like.

The disposing may include at least one of the steps of: disposing the counter unit laterally (or side by side) with at least one of the base units; enclosing at least one of the counter and base units with another of the units; axially aligning the base and counter units, and the like. Such enclosing may include one of the steps of: disposing the counter unit indirectly over (or around) at least one of such base units; disposing the counter unit directly on and/or around at least one of the base units, and the like. The enclosing may include at least one of the steps of: arranging at least two of the counter units concentrically; electrically coupling the counter units in one of a series mode, a parallel mode, a hybrid mode, and the like. The aligning may also include one of the steps of: aligning the counter unit with the longitudinal axis of at least one of the base units; aligning such a counter unit with the short axis of at least one of such base units; aligning the counter unit along the direction of the current flowing in (or voltage applied across) at least one of the base units, aligning such a counter unit with the direction of propagation of the harmful waves, and the like.

The configuring the counter unit may include at least one of the steps of: controlling a shape of the counter unit; controlling a size thereof; and controlling an arrangement thereof. The defining such a second wavefront may also include at least one of the steps of: forming the second wavefront with the harmful waves irradiated from only one of the base units; forming the second wavefront with the harmful waves irradiated from at least two but not all of the base units; forming the second wavefront with the harmful waves irradiated from all of the base units, and the like. The defining such a second wavefront may also have at least one of the steps of: forming the second wavefront with the harmful waves irradiated from only one of the wave sources; forming the second wavefront with the harmful waves irradiated from at least two but not all of such wave sources; forming the second wavefront with the harmful waves irradiated from all of the wave sources, and the like. Such configuring and/or arranging may be performed to the harmful waves irradiated by only one of the base units, irradiated by at least two but not all of the base units, and/or irradiated by all of the base units. The configuring and/or arranging may be performed to the harmful waves irradiated by only one of the wave sources, irradiated by at least two but not all of the wave sources, irradiated by all of the wave sources, and the like.

The disposing may include at least one of the steps of: controlling an orientation of the counter unit with respect to at least one of the base units (or target space); controlling an alignment of such a counter unit with respect thereto; controlling a first distance between the counter unit and base unit (or target space); and controlling a second distance between the counter units. Such disposing may be performed to the harmful waves irradiated from only one of the base units, irradiated from at least two but not all of the base units, irradiated by all of the base units, and the like. The disposing may be performed to the harmful waves irradiated from only one of the wave sources, irradiated from at least two but not all of the wave sources, irradiated from all of the wave sources, and the like.

The emitting may also include one of the steps of: manipulating the phase angles of the counter waves to be at least similar (or identical) to those of the harmful waves when the counter and harmful waves propagate in at least partially opposite directions; manipulating the phase angles of the counter waves to be at least opposite to those of such harmful waves when the counter and harmful waves propagate along at least similar directions; and manipulating the phase angles of the counter waves to be transverse to those of the harmful waves when the counter and harmful waves propagate along directions which may be transverse to each other. The emitting may include at least one of the steps of: controlling amplitudes of the counter waves to be greater or less than those of the harmful waves when measured in the target space; manipulating such amplitudes of the counter waves to be similar or identical to those of the harmful waves when measured at the base unit, and the like. The emitting may include at least one of the steps of: propagating the counter waves in the same direction as that of the harmful waves; propagating the counter waves in a direction different from that of the harmful waves irradiated by each of base units but along the same direction as that of a sum of such harmful waves from the base units, and so on. The emitting may include the step of: controlling phase angles of the counter waves to be at least partially (or substantially) opposite to those of the harmful waves.

Such matching may include one of the steps of: matching the counter waves with the harmful waves irradiated by only one of the base units; matching the counter waves with the harmful waves irradiated by at least two but not all of such base units; matching the counter waves with the harmful waves irradiated by all of the base units, and the like. Such matching may include one of the steps of: matching the counter waves with the harmful waves irradiated from only one of such wave sources; matching the counter waves with the harmful waves irradiated by at least two but not all of the wave sources; and matching the counter waves with the harmful waves irradiated by all wave sources.

The method may also include one of the steps of: flowing the current in an entire portion of the base unit; flowing the current in only a portion of the base unit; applying the voltage across an entire portion of the base unit; and applying the voltage across only a portion of the base unit. The method may include one of the steps of: flowing the current in a single direction through the base or counter units; flowing the current in different directions along different portions of the base or counter units; applying the voltage in a single direction through the base or counter units; applying the voltage along different directions along different portions of the base or counter units, and the like. The method may include the step of: providing multiple base units for the harmful waves, and the flowing may include one of the steps of: flowing the currents with the same amplitudes along a same direction in all of the base (or counter) units; flowing the currents of the same amplitudes in different directions along the base (or counter) units; flowing the currents of different amplitudes in the same direction in all of the base (or counter) units; flowing the currents of different amplitudes in different directions in the base (or counter) units, and the like. The method may include the step of: providing multiple base units for the harmful waves, while the applying may include one of the steps of: applying the voltages of the same amplitudes along a same direction in all of the base (or counter) units; applying the voltages of the same amplitudes in different directions along the base (or counter) units; applying the voltages of different amplitudes in the same direction in all of the base (or counter) units; applying the voltages of different amplitudes in different directions in the base (or counter) units, and the like.

Such flowings may include one of the steps of: flowing the currents of the same (or different) amplitudes in the counter unit; flowing in the counter unit another current which may not be derived from the current supplied to the base unit but may have a temporal pattern at least partially similar to that of the current supplied to the base unit; flowing along the counter unit another current which may be derived not from the current to the base unit and may have a temporal pattern different from that of the current to the base unit, and the like. The flowing such currents may include one of the steps of: flowing the currents in the base unit and then in the counter unit; flowing the currents in the counter unit and then in the base unit; flowing the currents at least simultaneously in the base and counter units, and the like.

In another aspect of the present invention, a microwave heating system may be provided for countering harmful electromagnetic waves which are irradiated by multiple base units of at least one wave source thereof by emitting counter electromagnetic waves to the harmful waves, by controlling a configuration of the counter unit, and by suppressing the harmful waves with such counter waves from propagating toward a target space and/or canceling the harmful waves with the counter waves in the target space, where such a wave source includes a magnetron tube, a transformer, and/or an actuator, where the base units are arranged to include only portions of the wave source responsible for irradiating the harmful waves and/or affecting paths of the harmful waves therethrough, while the target space is formed between an user of the system and at least one of the base units.

In one exemplary embodiment of this aspect of the invention, such a system may be made by a process including the steps of: arranging at least one counter unit to have a width longer than that of the base unit; disposing the counter unit between the wave source and user while aligning its width with at least a portion of a wavefront of the harmful waves; configuring the counter unit to emit such counter waves defining wave characteristics similar to the harmful waves but having at least partially opposite phase angles thereto; and aligning the counter unit to propagate the counter waves toward the target space, thereby countering the harmful waves by the counter waves therein (to be referred to as the "first aligning" hereinafter). Such arranging and disposing may be replaced by the steps of: arranging at least one counter unit to define a width narrower than the base unit; and disposing the counter unit on an opposite side of the target space with respect to the wave source while aligning its width with at least a portion of a wavefront of the harmful waves.

In another exemplary embodiment of this aspect of the invention, a system may be made by a process including the steps of: identifying multiple wavefronts of the harmful waves; configuring a single counter unit to emit the counter waves defining multiple wavefronts which have phase angles at least partially opposite to those of the harmful waves and which are also capable of matching the wavefronts of the harmful waves when disposed at a preset distance from the base unit; disposing the counter unit in the distance from the base unit; and the first aligning.

In another exemplary embodiment of this aspect of the invention, a system may be made by a process including the steps of: providing at least two counter units; configuring such counter units to emit the counter waves which define similar (or identical) phase angles and have a first set of multiple wavefronts each corresponding to a sum of at least two wavefronts generated by the counter units; finding a relationship between a distance between such counter units and an increase in a radius of curvature of each of the wavefronts of the first set; identifying a second set of multiple wavefronts of the harmful waves; configuring the counter units to match the radii of curvature of the wavefronts of the first set with those of the wavefronts of the second set when disposed at preset distances from the base unit; disposing the counter units in the distances; and then the first aligning. The above configuring and finding may also be replaced by the steps of: configuring the counter units to emit the counter waves defining at least partially opposite phase angles and a first set of multiple wavefronts each corresponding to a sum of at least two wavefronts generated by the counter units; and finding a relationship between a distance between the counter units and a decrease in a radius of curvature of each of the wavefronts of the first set.

In another aspect of the present invention, a microwave heating system may be provided for countering harmful electromagnetic waves which are irradiated by multiple base units of at least one wave source thereof by emitting counter electromagnetic waves to the harmful waves, by matching at least one feature of the system with that of at least one of the base units, and by suppressing the harmful waves from propagating toward a target space and/or canceling the harmful waves with the counter waves in the target space, where such a source includes a magnetron tube, a transformer, and/or an actuator, where the base units are arranged to represent only portions of the wave source which are responsible for irradiating the harmful waves and/or affecting paths of the harmful waves therethrough, and where the target space is defined between at least one of the base units and an user of the system.

In one exemplary embodiment of this aspect of the invention, such a system may be made by a process including the steps of: arranging at least one counter unit to match such a feature of the base unit; configuring the counter unit to emit the counter waves similar (or identical) to the harmful waves due to the arranging but having phase angles at least partially opposite to those of the harmful waves (to be referred to as the "second countering" hereinafter); and the first aligning. The above arranging may be replaced by one of the steps of: arranging at least one counter unit to define a configuration simpler than that of the base unit while at least minimally maintaining the feature; arranging at least one counter unit to define a configuration more complex than that of the base unit while at least minimally maintaining such a feature; arranging at least one counter unit to have a dimension defined by a less number of unit axes than the base unit while at least minimally maintaining the feature; and arranging at least one counter unit to have a dimension which is defined by a greater number of unit axes than that of the base unit while at least minimally maintaining the feature.

In another exemplary embodiment of this aspect of the invention, a system may be made by a process including the steps of: arranging a single counter unit to define a configuration simpler than that of a single base unit while maintaining the feature; the second countering; and the first aligning. The above arranging may be replaced by one of the steps of: arranging a single counter unit to define a configuration similar (or identical) to an arrangement of multiple base units while maintaining such a feature; arranging a single counter unit to define a dimension formed by less mutually orthogonal unit axes than an arrangement of multiple base units while maintaining the feature; and arranging a single counter unit to define a dimension formed by more mutually orthogonal unit axes than a dimension of multiple base units while maintaining the feature.

In another exemplary embodiment of this aspect of the invention, a system may be made by a process including the steps of: providing multiple counter units; arranging at least two of the counter units in a configuration simpler than that of a single base unit while maintaining the feature; configuring the counter units to emit the counter waves similar to (or identical to) the harmful waves due to such arranging but to defining phase angles at least partially opposite to those of such harmful waves; and aligning the counter units to propagate the counter waves to the target space, thereby countering the harmful waves by the counter waves therein. The above arranging may also be replaced by one of the steps of: arranging at least two of the counter units in a configuration which is similar (or identical) to an arrangement of multiple base units while maintaining such a feature; arranging the counter units in an arrangement defining a dimension which is formed by less mutually orthogonal unit axes than a dimension of a single base unit while maintaining such a feature; and arranging the counter units in an arrangement defining a dimension formed by more mutually orthogonal unit axes than a dimension of multiple base units while maintaining the feature.

In another exemplary embodiment of this aspect of the invention, a system may be made by a process including the steps of: providing less counter units than such base units; approximating an arrangement of the base units by the counter units while maintaining such a feature; configuring such counter units to emit the counter waves which are similar to (or identical to) the harmful waves due to the approximating but define phase angles at least partially opposite to those of the harmful waves; and aligning the counter units to propagate the counter waves to the target space, thereby countering the harmful waves by the counter waves therein. The above providing and approximating may also be replaced by the steps of: providing more counter units for less base units; and approximating an arrangement of the base units by the counter units while disposing at least two of the counter units around at least one of the base units and maintaining the feature.

In another exemplary embodiment of this aspect of the invention, a system may be made by a process including the steps of: arranging at least one counter unit to move with respect to the base unit; configuring the counter unit to emit the counter waves similar (or identical) to the harmful waves but defining phase angles at least partially opposite to those of the harmful waves; finding a relation between a distance from the counter unit to the base units and an extent of matching between such counter and harmful waves; and then moving the counter unit a location where the extent attains its maximum, thereby countering the harmful waves by the counter waves in the target space.

In another aspect of the present invention, a microwave heating system may be provided for countering harmful electromagnetic waves which are irradiated by multiple base units of at least one wave source thereof by emitting counter electromagnetic waves toward the harmful waves and then matching the harmful waves thereby, and by suppressing the harmful waves with the counter waves from propagating toward a target space and/or canceling the harmful waves with the counter waves in the target space, where such a wave source includes a magnetron tube, a transformer, and/or an actuator, where the base units are arranged to include only portions of the wave source responsible for irradiating the harmful waves and/or affecting their paths therethrough, while such a target space is defined between an user of the system and at least one of the base units.

In one exemplary embodiment of this aspect of the invention, such a system may be made by a process including the steps of: identifying a first set of multiple wavefronts of such harmful waves; disposing at least one counter unit along at least one of the wavefronts; configuring the counter unit to emit the counter waves forming a second set of multiple wavefronts similar to (or identical to) the first set of the wavefronts in the target space due to the disposing; and the first aligning.

In another exemplary embodiment of this aspect of the invention, a system may be made by a process including the steps of: identifying multiple wavefronts of such harmful waves; configuring at least one counter unit to emit the counter waves defining multiple wavefronts similar to a shape and/or an arrangement of the counter unit; disposing the counter unit along at least one of the wavefronts of the harmful waves; and arranging the counter unit to emit such counter waves of which wavefronts are aligned with those of the harmful waves in the target space based upon the configuring, thereby countering the harmful waves by the counter waves therein. The above configuring and disposing may be replaced by the steps of: configuring at least one counter unit to emit the counter waves with multiple wavefronts different from at least one of a shape and an arrangement of the counter unit; and disposing such a counter unit across (or along) at least two of the wavefronts of the harmful waves based on the configuring.

In another exemplary embodiment of this aspect of the invention, such a system may be made by a process including the steps of: identifying multiple wavefronts of the harmful waves; disposing multiple counter units in an arrangement along at least one of the wavefronts; configuring the counter units to emit such counter waves with multiple wavefronts similar to the arrangement of the counter units; and arranging the counter units to emit such counter waves of which wavefronts are aligned with those of the harmful waves in the target space based on the configuring, thereby countering the harmful waves by the counter waves therein. The above disposing and configuring may be replaced by the steps of: disposing multiple counter units in an arrangement across (or along) at least two of the wavefronts; and configuring the counter units to emit the counter waves with multiple wavefronts different from the arrangement of the counter units.

In another exemplary embodiment of this aspect of the invention, a system may be made by a process including the steps of: identifying multiple wavefronts of such harmful waves; configuring at least one counter unit to emit such counter waves with multiple wavefronts each defining a radius of curvature; locating the counter unit between the base unit and target space; comparing shorter radii of curvature of the wavefronts of such counter waves with longer radii of curvature of the harmful waves; and configuring the counter unit to be disposed in a location where the radii of curvature of the wavefronts of the counter waves are configured to match those of the wavefronts of the harmful waves in the target space, thereby countering the harmful waves by the counter waves therein. The above locating and comparing may further be replaced by the steps of: locating the counter unit on an opposite side of the target space relative to the base unit; and comparing longer radii of curvature of the wavefronts of the counter waves to shorter radii of curvature of the harmful waves.

In another exemplary embodiment of this aspect of the invention, a system may be made by a process including the steps of: arranging at least one counter unit to move with respect to the base unit; configuring the counter unit to emit the counter waves similar (or identical) to the harmful waves but have phase angles at least partially opposite to those of the harmful waves; finding a relationship between a distance between the counter and base units and matching between radii of curvature of the counter waves and those of the harmful waves; assessing a location in which the wavefronts of the counter and harmful waves best match each other; and moving the counter unit to the location for best matching the harmful waves in the target space by such counter waves, thereby countering the harmful waves by the counter waves therein.

In another aspect of the present invention, a microwave heating system may be provided for countering harmful electromagnetic waves which are irradiated by multiple base units of at least one wave source thereof by suppressing such harmful waves from propagating to a target space and/or canceling the harmful waves in the target space, where the wave source includes a magnetron tube, a transformer, and/or an actuator, where the base units include only portions which are responsible for irradiating the harmful waves and/or affecting paths of the harmful waves therethrough, while the target space is defined between at least one of the base units and an user of the system.

In one exemplary embodiment of this aspect of the invention, such a system may be made by a process including the steps of: arranging at least one counter unit to have a shape which is identical (or similar) to the base unit and to emit counter electromagnetic waves, and configuring such counter waves to have phase angles at least partially opposite to those of the harmful waves, to define wave characteristics at least partially similar to those of the harmful waves due to the shape and, therefore, to counter the harmful waves due to the opposite phase angles in the target space (to be referred to as the "third configuring" hereinafter).

In another exemplary embodiment of this aspect of the invention, a system may be made by a process including the steps of: arranging a single counter unit to define a shape of an 1-D (or 2-D, 3-D) analog of the base unit and to emit counter electromagnetic waves; and the third countering. Such arranging may be replaced by the step of: arranging a single counter unit to define a shape of an 1-D (or 2-D, 3-D) analog of at least two of multiple base units and to emit counter electromagnetic waves.

In another exemplary embodiment of this aspect of the invention, a system may be made by a process including the steps of: arranging multiple counter units at least two of which are configured to define shapes of 1-D (or 2-D, 3-D) analogs of such a base unit and to emit counter electromagnetic waves; and the third countering. The above arranging may also be replaced by one of the steps of: arranging multiple counter units at least two of which are configured to define shapes of 1-D (or 2-D, 3-D) analogs of at least two but not all of multiple base units and then to emit counter electromagnetic waves; and arranging multiple counter units at least two of which are configured to define shapes of 1-D (or 2-D, 3-D) analogs of each of multiple base units and to emit counter electromagnetic waves.

More product-by-process claims may be constructed by modifying the foregoing preambles of the apparatus and/or method claims and by appending thereonto such bodies of the apparatus and/or method claims. In addition, such process claims may include one or more of the above features of the apparatus and/or method claims of the present invention.

As used herein, the term "units" collectively refers to both of a "base unit" and a "counter unit" of an electromagnetically-countered microwave heating system of the present invention, where such a system is to be abbreviated as the "EMC microwave heating system," as the "EMC heating system," as the "EMC system" or simply as the "system" hereinafter. Such a classification between the "units" is primarily based on their intended functions. That is, the "base unit" represents various parts of the EMC system which are to perform various intended functions of the system such as, e.g., generating microwaves, converting and/or generating electric energy required for generation of the microwaves, and the like. It is to be understood that all "base units" irradiate such harmful waves while performing their intended functions and that these "base units" are always incorporated in the above system and in various prior art devices for similar purposes. In contrary, the "counter unit" represents those parts of the system which are to perform countering functions such as, e.g., canceling at least a portion of the harmful waves in the target space and/or suppressing or preventing such a portion of the harmful waves from propagating toward the target space. When desirable, such a "counter unit" may also be arranged to perform various functions intended for the "base unit" and, therefore, serve as an extra "base unit" which also performs the countering function. This unit, however, is to be deemed as the "counter unit" within the scope of this invention unless otherwise specified. Within the scope of this invention, the "base unit" is therefore omnipresent in any prior art wave-generating devices, while the "counter unit" is neither physically not functionally present in these prior art devices.

The "base unit" is to be distinguished from a "wave source" within the scope of this invention. More particularly, the "wave source" collectively refers to portions of the EMC system irradiating such harmful waves, whereas the "base unit" specifically refers only to the portions of the "wave source" which are directly responsible for irradiating the harmful waves and/or affecting propagation paths of the harmful waves. For example, a magnetron tube, a transformer, an actuator, and various electrical parts of the EMC microwave heating system are the "wave source" thereof, while the "base units" of such an EMC system includes, e.g., resonance cavities of the magnetron tube, waveguides, primary and secondary coils of the transformer, a rotor and/or a stator of the actuator, various capacitors and diodes, and the like. A body and a door of the system may also qualify as the "base units" as long as they may affect the propagation paths of the harmful waves. However, various couplers of the EMC system qualify as portions of the "wave source" but not portions of such "base units," for they neither generate the harmful waves nor affect the propagation paths of such harmful waves. Accordingly, a shape of the "wave source" is generally different from that of the "base unit," where the "base unit" may define the shape simpler or more complex than that of the "wave source." However, the "base unit" may be deemed as a subset of the "wave source" and, therefore, the "base unit" almost always defines a size which is smaller than or at most equal to that of its "wave source."

As used herein, the term "configuration" collectively refers a shape, size, and/or arrangement, while the term "disposition" collectively includes orientation, alignment, and/or distance. Accordingly, the "configuration" of the (counter or base) unit may refer to the shape of the unit, the size of the unit, and/or arrangement of the unit with respect to the other of the base and counter units. Similarly, the "disposition" of the unit may refer to the orientation and/or alignment of such a unit with respect to the other of the base and counter units, to the target space, to a direction of propagation of the harmful or counter waves, to a direction of the electric current flowing in or voltage applied across such a unit or the other of the base and counter units, and the like. The "disposition" of the unit may also refer to the distance to the other of the base and counter units therefrom, to the target space, and the like. When the system include multiple counter units, the "disposition" thereof may include the distance between at least two of such counter units.

Within the scope of the present invention, the term "wire" collectively refers to an article with a shape of a wire, a fiber, a filament, a rod, and/or a strand, and shapes of any other similarly elongated articles each of which may be straight or curved (i.e., curvilinear), and each of which may be formed into a loop, a coil, a roll, a spiral, a mesh, and the like. The term "strip" collectively refers to an article with a shape of a strip, a bar, a pad, and/or a tape, and shapes of any other planar or curved articles with large aspect ratios (i.e., ratios of lengths to widths or heights), each of which may be arranged straight or curved, each of which may be arranged in a two- or three-dimensional configuration, each of which may be arranged into a loop, a coil, a roll, a spiral, a mesh, and the like. In addition, the term "sheet" collectively refers to an article with a shape of a sheet, a slab, a foil, a film, a plate, and/or a layer, and shapes of any other articles which are wider than the "strip," each of which may be planar (i.e., two-dimensional or 2-D) or curved (i.e., three-dimensional or 3-D), each of which may be formed in a segment, a roll, and the like. The term "tube" collectively refers to an article which may define any of the shapes described hereinabove and to be described hereinafter and forming at least one lumen therethrough. Such a "tube" may be arranged straight or curved, may be arranged into a loop, a coil, a roll, a spiral, a mesh, and the like. The term "coil" collectively refers to an article defining a shape of a helix and/or a spring, and shapes of any other articles winding around an object along a longitudinal or short axis of such an object at a constant distance from the object, and the like. The "coil" may be arranged straight or curved, may also be arranged into a loop (such as a toroid), a coil, a roll, a spiral, a mesh, and the like. The term "spiral" collectively refers to an article defining a shape of another helix and/or spring which may, however, expand or shrink along the longitudinal oe short axis of an object, and shapes of any other articles winding around such an object at varying distances, and the like. It is appreciated that a planar "spiral" may be formed on a single curvilinear plane which is normal to the longitudinal or short axis of the object. The term "mesh" collectively refers to an article with a shape a mesh, a net, a screen, a quilt, a fabric, and/or a garment, and shapes of any other articles which may be formed into a networking structure, a woven structure, an interwoven structure, and the like. The term "bundle" collectively refers to an article defining a shape of two or more of the same or different elongated shapes which are aligned side by side or laterally in such a manner that a cross-section of the "bundle" or a "bundled article" may include at least two of such shapes therein. The term "braid" collectively refers to an article with a shape of two or more of the same of different elongated shapes which are braided in such a manner that the "braid" or a "braided article" may consist of at least two of such shapes in a cross-section normal to a longitudinal and/or short axis thereof, where examples of such articles may include, but not be limited to, a thread, a yarn, any other articles made by prior art braiding techniques, and the like. It is to be understood that at least a portion of each of such articles formed according to the above terms in this paragraph may be arranged to be solid, hollow or porous such as, e.g., a foam, a sponge, and the like. It is also appreciated that each of such articles formed according to the foregoing terms of this paragraph may be arranged to include (or define) at least one hole, gap or opening.

Similarly and as used herein, the term "mixture" collectively refers to a liquid, a solution, a sol, a gel, an emulsion, a suspension, a slurry, and/or a powder, each of which may include therein multiple particles, particulates, grains, granules, filings, fragments, and/or pellets each of which may also have shapes of spheres, ellipsoids, cylinders, flakes, "wires," "strips," and the like, and each of which may be in a range of millimeters, microns or nanometers. When appropriate, such a "mixture" may include at least one solvent, at least one chemically, electrically, and/or magnetically inert filler for the purpose of providing mechanical strength and/or integrity thereto, and so on.

In addition, the term "combination" refers to a collection of different shapes examples of which may include, but not be limited to, the above wire, strip, sheet, tube, coil, spiral, mesh, their braid, and their bundle. The term "array" similarly refers to the collection of such shapes. However, the "array" refers to the "collection" which in addition forms multiple holes or openings therethrough.

As used herein, the terms "axial," "radial," and "angular" will be used in reference to a center axis of the system. Based thereupon, the term "axial direction" refers to a direction along the center axis of the system, while the term "radial direction" means another direction which is normal to such an "axial direction" and, therefore, which represents a direction extending away and outwardly from the center of the system. It is appreciated that such a "radial direction" may be other directions which extend away and outwardly from the center of the system and may be transverse but not necessarily perpendicular to the "axial direction." The term "angular direction" refers to another direction revolving about the "axial direction" in a clockwise or counterclockwise manner.

It is appreciated that definitions related to various electric and magnetic shields of this invention are similar to those as have been provided in the aforementioned co-pending Applications. Therefore, such definitions are deleted herein for simplicity of illustration.

Unless otherwise defined in the following specification, all technical and scientific terms used herein have the same meaning as commonly understood by one of ordinary skill in the art to which the present invention belongs. Although the methods or materials equivalent or similar to those described herein can be used in the practice or in the testing of the present invention, the suitable methods and materials are described below. All publications, patent applications, patents, and/or other references mentioned herein are incorporated by reference in their entirety. In case of any conflict, the present specification, including definitions, will control. In addition, the materials, methods, and examples are illustrative only and not intended to be limiting.

Other features and/or advantages of the present invention will be apparent from the following detailed description, and from the claims.

DETAILED DESCRIPTION OF THE PREFERRED EMBODIMENTS

Figure 1A:
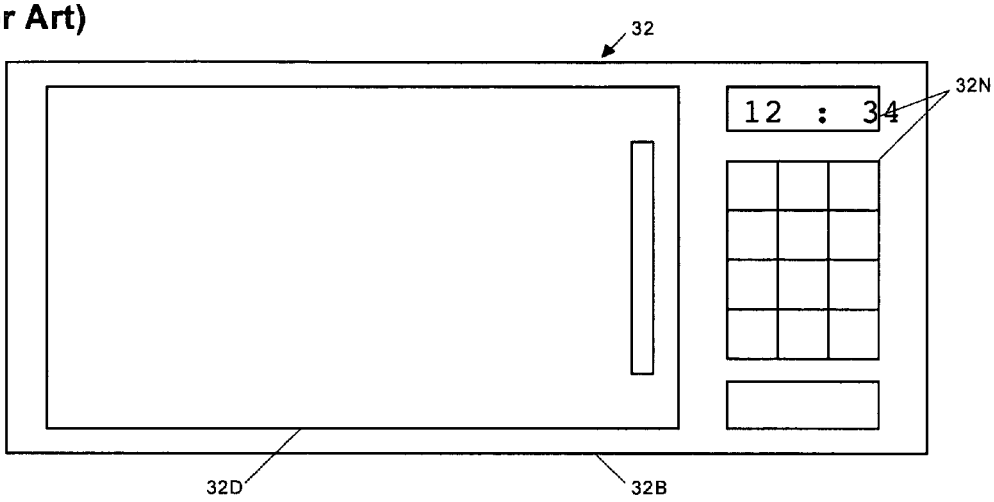
FIG. 1A (Prior Art)
FIGS. 1A to 1F are various front and top views of a prior art microwave heating device and its magnetron tube.

The present invention relates to an electromagnetically-countered microwave heating system (to be also abbreviated as the "EMC microwave heating system," as the "EMC heating system," as the "EMC system" or simply as the "system" hereinafter) with at least one wave source irradiating harmful electromagnetic waves and at least one counter unit emitting counter electromagnetic waves in order to counter the harmful waves with the counter waves, e.g., through canceling at least a portion of the harmful waves with the counter waves, by suppressing the harmful waves with the counter waves from propagating toward a target space, and the like. More particularly, the present invention relates to various counter units of the EMC systems and to various mechanisms for countering such harmful waves irradiated from various base units of the wave sources by the counter units. Therefore, such a counter unit may be shaped, sized, and/or arranged to match its configuration with configuration of the base unit of the wave source, thereby emitting such counter waves automatically matching wave characteristics of the harmful waves. Alternatively, such a counter unit may be shaped, sized, and/or disposed in an arrangement which is defined along one or more wavefronts of such harmful waves, thereby emitting the counter waves which automatically match wave characteristics of such harmful waves. The present invention also relates to various counter units which are provided as analogs of the base unit, where such an analog approximates the base unit more complex than the counter unit, where a three- or two-dimensional base unit is approximated by a two- or one-dimensional analog, and the like. The present invention also relates to multiple simple counter units which are simpler than the base unit but disposed in an arrangement approximating such a shape and/or arrangement of the base unit. The present invention also relates to the counter unit which may be shaped and/or sized in a preset relation to the configuration of the base unit and disposition thereof. In addition, the present invention relates to various countering modes where a single counter unit may counter a single base unit, may counter at least two but not all of multiple base units, may counter all of multiple base units, and so on, where multiple counter units may counter a single base unit, may counter a greater number of base units or a less number of base units, and so on. The present invention also relates to various electric and/or magnetic shields which may be used alone or in conjunction with such counter units to minimize irradiation of the harmful waves from the system. Such counter units and/or shields may be arranged for countering one or more base units of multiple wave sources of the EMC system such as, e.g., a magnetron tube, a transformer, an actuator, and various electrical parts thereof.

The present invention also relates to various methods of countering the harmful waves which are irradiated by various base units of multiple wave sources of the EMC microwave heating system with the counter waves by the source and/or wave matching. More particularly, the present invention relates to various methods forming the counter unit as an analog of the base unit and then emitting the counter waves matching such harmful waves, various methods of approximating the base unit by the simpler counter unit for the countering and various methods of approximating the base unit by multiple simpler counter units. The present invention also relates to various methods of disposing the counter unit along the wavefronts of the harmful waves and then emitting the counter waves for automatically matching such wavefronts of the harmful waves, various methods of disposing multiple counter units along the wavefronts of the harmful waves and then emitting the counter waves by the counter units for automatically matching such wavefronts, and the like. In addition, the present invention relates to various methods of manipulating the wavefronts of the counter waves by disposing the counter unit closer to and/or farther away from the target space with respect to the base unit, various methods of controlling radii of curvature of the wavefronts of the counter waves by incorporating one or multiple counter units emitting such counter waves of the same or opposite phase angles, various methods of adjusting the wavefronts of the counter waves by disposing one or multiple counter units defining the shapes similar to or different from the shapes of such base units, and the like. The present invention also relates to various methods of countering the harmful waves from one or multiple base units with the counter waves emitted by the single or multiple counter units. Accordingly, the present invention relates to various methods of emitting such counter waves from a single counter unit for the harmful waves irradiated by one or more base units, various methods of emitting such counter waves by two or more counter units for the harmful waves irradiated by a single or multiple base units, and the like. In addition, the present invention relates to various methods of minimizing irradiation of such harmful waves by incorporating such electric shields, by incorporating the magnetic shields, by incorporating one or both of such shields either alone or in conjunction with the above counter units, and the like.

The present invention further relates to various processes for providing various counter units for such EMC microwave heating systems. More particularly, the present invention relates to various processes for forming the counter units to emit the counter waves with the wavefronts similar to (or different from) such shapes of the counter units, various processes for forming the counter units as the above analogs of the base units, various processes for providing the counter units emitting such counter waves which define the similar or opposite phase angles, various processes for providing such counter units with the wavefronts shaped similar to the harmful waves, various processes for disposing the counter units in a preset arrangement and emitting therefrom the counter waves which have the wavefronts similar to such an arrangement, and the like. The present invention also relates to various processes for assigning the single counter unit to counter the harmful waves irradiated by the single base unit for a local countering or to counter such harmful waves from multiple base units for a global countering, various processes for assigning multiple counter units to counter the harmful waves irradiated from the single base unit for the global countering or to counter the harmful waves from multiple base units for the local or global countering depending upon numbers of the counter and base units. The present invention further relates to various processes for incorporating such electric and/or magnetic shields for minimizing the irradiation of such harmful waves, and various processes for minimizing the irradiation of such harmful waves with such electric and/or magnetic shields either alone or in conjunction with such counter units.

The basic principle of the counter units of the EMC microwave heating systems of the present invention is to emit the counter waves which form the wavefronts similar (or identical) to those of the harmful waves but define the phase angles at least partially opposite to those of such harmful waves. Therefore, by propagating the counter waves to the target space, the counter waves can effectively counter the harmful waves in such a target space by, e.g., canceling at least a portion of the harmful waves therein and/or suppressing the harmful waves from propagating theretoward. To this end, the counter units are arranged to emit the counter waves which define the wavefronts matching those of the harmful waves by various mechanisms. In one example, such counter units are shaped similar (or identical) to the base units of the waves sources, or arranged similar (or identical) to such base units and, therefore, emit the counter waves which can counter the harmful waves in the target space. In another example, such counter units are disposed along one or more of the wavefronts of the harmful waves and emit the counter waves similar (or identical) to the harmful waves and, therefore, counter the harmful waves in the target space. In these examples, the counter units emit the counter waves forming the wavefronts similar (or identical) to the shapes of the counter units themselves, and such counter waves define the phase angles at least partially opposite to the phase angles of the harmful waves. In another example, such counter units are shaped differently from the base units, but rather disposed in an arrangement in which the counter waves emitted therefrom match the harmful waves in the target space. In another example, the counter units are disposed across different wavefronts of the harmful waves but emit the counter waves which are similar (or identical) to the harmful waves and, therefore, counter the harmful waves in the target space. In the last two examples, the counter units may be arranged to emit the counter waves defining such wavefronts which may or may not be similar (or identical) to the shapes of the counter units themselves, while the counter waves have the phase angles which are at least partially opposite to those of the harmful waves.

The basic principle of the counter units of the generic electromagnetically-countered system of this invention may be implemented into various prior art devices for minimizing irradiation of the harmful waves therefrom. For example, the counter units may be implemented to any base units of electrically conductive wires, coils, and/or sheets or, in the alternative, into any electrically semiconductive and/or insulative wires, coils, and/or sheets for minimizing the irradiation of the harmful waves by countering such harmful waves by the counter waves, e.g., by canceling at least a portion of the harmful waves in the target space and/or suppressing the harmful waves from propagating toward the target space, where the counter units may be made of and/or include at least one electrically conductive, insulative or semiconductive material. The counter units may be implemented into any of such base units which define the shapes which may be formed by incorporating one or multiple wires, coils, and/or sheets, by modifying the shapes of one or multiple wires, coils, and/or sheets, where a few examples of the modified shapes may include a solenoid and toroid each formed by modifying the shape of such a coil. Therefore and in one example, the counter units may be implemented into various electronic elements such as resistors, capacitors, inductors, diodes, amplifiers, and/or memories which are provided in a millimeter scale, a micron scale, and/or a nanometer scale, for minimizing the irradiation of the harmful waves. Therefore, any prior art electronic elements with any of the counter units may be converted into the EMC electronic elements. In another example, the counter units may also be incorporated into various wave generating devices such as microwave heating ovens, radars, and the like. Therefore, any prior art microwave heating ovens and radars with any of the counter units may be converted to the EMC microwave heating systems and EMC radar systems.

It is appreciated that various counter units of the EMC systems of the present invention may be incorporated into any electrical and/or electronic devices each of which may include at least one base unit and, accordingly, may irradiate the harmful waves including electric waves (to be abbreviated as "EWs" hereinafter) and magnetic waves (to be abbreviated as "MWs" hereinafter) having frequencies of about 50 to 60 Hz and/or other EWs and MWs of higher frequencies. It is also appreciated that the EMC systems of this invention may also be incorporated into any portable or stationary electric and/or electronic devices which have at least one base unit detailed examples of which have been provided heretofore and will be provided hereinafter. It is further appreciated that such counter units may be provided in a micron-scale and incorporated to semiconductor chips and circuits such as LSI and VLSI devices and that the counter units may also be provided in a nano-scale and incorporated into various nano devices including at least one base unit which may be a single molecule or a compound, or may be a cluster of multiple molecules or compounds.

Various aspects and/or embodiments of various systems, methods, and/or processes of this invention will now be described more particularly with reference to the accompanying drawings and text, where such aspects and/or embodiments thereof only represent different forms. Such systems, methods, and/or processes of this invention, however, may also be embodied in many other different forms and, accordingly, should not be limited to such aspects and/or embodiments which are set forth herein. Rather, various exemplary aspects and/or embodiments described herein are provided so that this disclosure will be thorough and complete, and fully convey the scope of the present invention to one of ordinary skill in the relevant art.

Unless otherwise specified, it is to be understood that various members, units, elements, and parts of various systems of the present invention are not typically drawn to scales and/or proportions for ease of illustration. It is also to be understood that such members, units, elements, and/or parts of various systems of this invention designated by the same numerals may typically represent the same, similar, and/or functionally equivalent members, units, elements, and/or parts thereof, respectively.

Figure 1B:
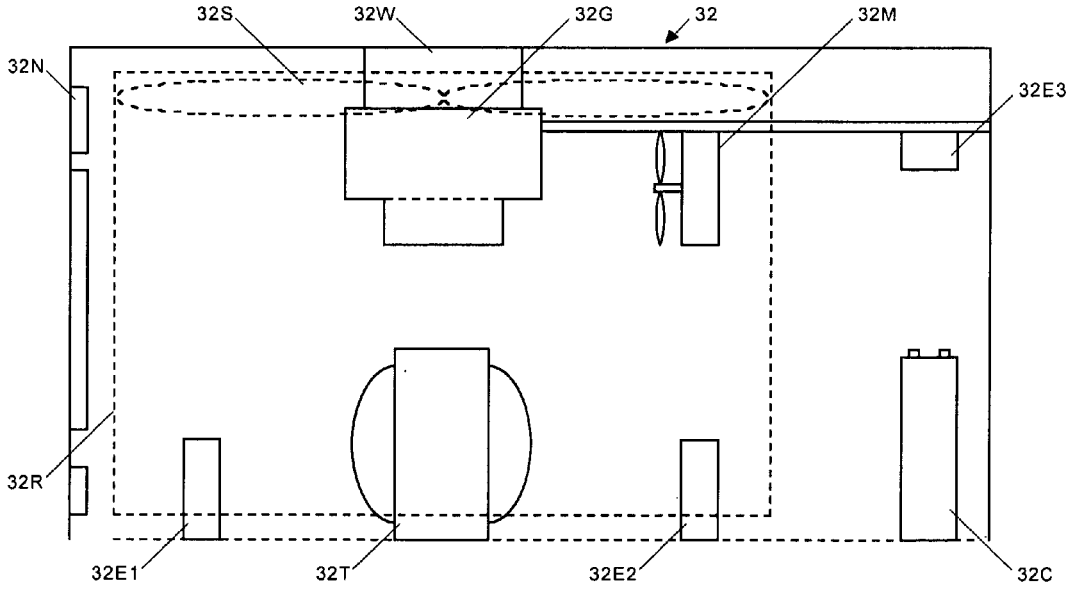
FIG. 1B (Prior Art)

FIGS. 1A and 1B show respectively a front view and a side view of a conventional microwave heating device and its magnetron tube, where a typical microwave heating device 32 includes a body 32B on a front portion of which a controller 32N and its input and output units are provided. The body 32B also defines a cooking chamber 32R which is covered by a revolving door 32D. Inside the body 32B are incorporated various electric units such as, e.g., a magnetron tube 32G, an actuator or motor 32M, a transformer 32T, a capacitor 32C, and various electric elements such as a triac 32E1, a diode 32E2, fuses 32E3, and the like. The microwave heating device 32 uses such components to produce microwave energy for heating and cooking. Generally speaking, such components of the microwave heating device 32 may be divided into two sections, i.e., a control section and a high-voltage section. The control section consists of a timer (a part of the controller 32N), a power (or output) control unit (another part of the controller 32N), and various interlock and protection devices. The components in the high-voltage section serve to step up electric energy of a low voltage level to a high voltage level which is converted to the microwave energy. For example, a typical high-voltage section converts an AC line voltage of 110 or 220 volts up to a DC voltage of about 4,000 volts at 300 mA.

In operation and as shown in FIG. 1B, the electric energy from a source outlet travels through a power cord and enters the microwave heating device 32 through a series of fuses 32E3 and safety protection circuits 32E1 which are designed to deactivate the device 32 in the event of electrical short circuit and/or overheating condition inside the chamber 32R. When all components are in their normal conditions, the electric energy passes through the interlock 32E1, timer circuits 32N, and the like. As the door 32D is closed, an electrical path is established through a series of safety interlock switches 32E1. Setting the oven timer 32N and starting a cook operation extends this energy path to the control circuits 32N. Generally, the controller 32N includes either an electromechanical relay or switch called the triac 32E1. Sensing that all components are ready, the controller 32N generates a signal causing the relay or triac 32E1 to activate, thereby producing the energy path to the high-voltage transformer 32T. By adjusting an on-off ratio of this activation signal, the controller 32N manipulates application of the energy to the transformer 32T, thereby also controlling an on-off ratio of the magnetron tube 32G and an output power of the device 32. In the high-voltage section, the transformer 32T converts the line voltage of about 115 volts to approximately 3,000 volts, where the diode 32E2 and capacitor 32C convert this high AC voltage into a DC voltage. The magnetron tube 32G receives this DC energy and generates the undulating microwaves of electromagnetic cooking energy. The microwave energy is transmitted into a metal channel called a waveguide 32W which feeds the microwave energy into the cooking chamber 32R. A stirrer or an antenna 32S may also be disposed over or inside the cooking chamber 32R in order to evenly disperse the microwave energy throughout all areas of the chamber 32R. Some microwaves impinge directly onto a food disposed inside the cooking chamber 32R, while others bounce off metal walls and/or flooring of the chamber 32R. The door 32D typically includes a metal screen so that the microwaves or, more particularly, electric waves of the microwaves may be reflect off the door 32D. Therefore, the microwave energy reaches all surfaces of the food in every direction. When the door 32D is opened or the timer 32N reaches zero, the controller 32N terminates supply of the electric energy to the magnetron tune 32G and the generation of the microwave energy also stops.

Figure 1C:
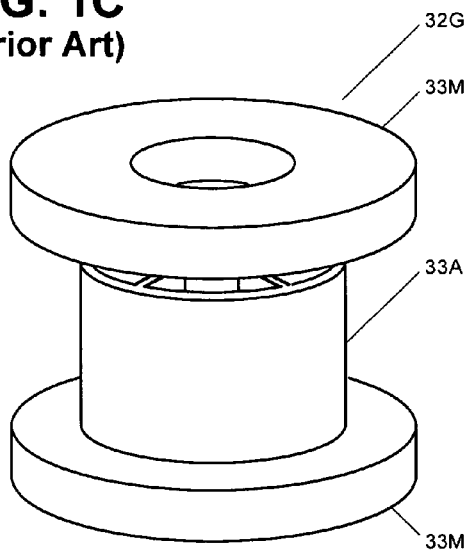
FIG. 1C (Prior Art)
Figure 1E:
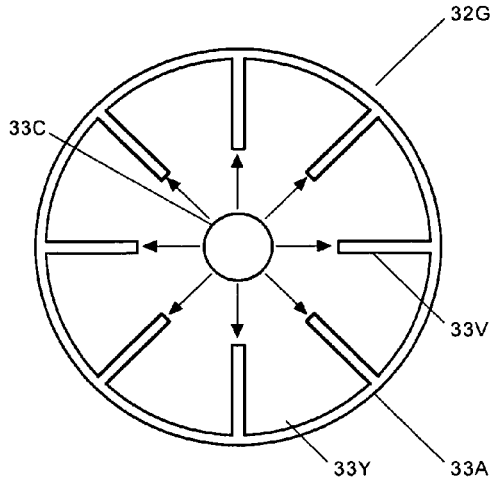
FIG. 1E (Prior Art)
Figure 1D:
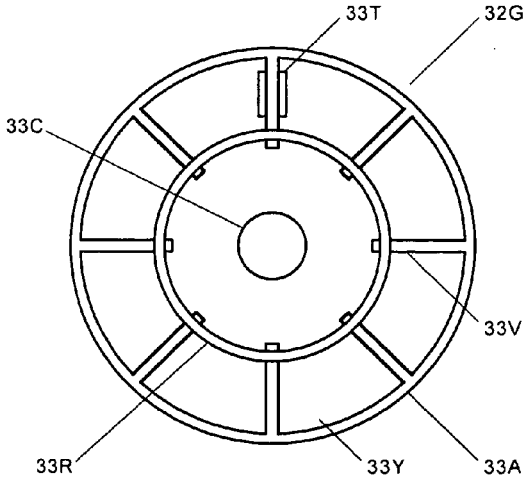
FIG. 1D (Prior Art)
Figure 1F:
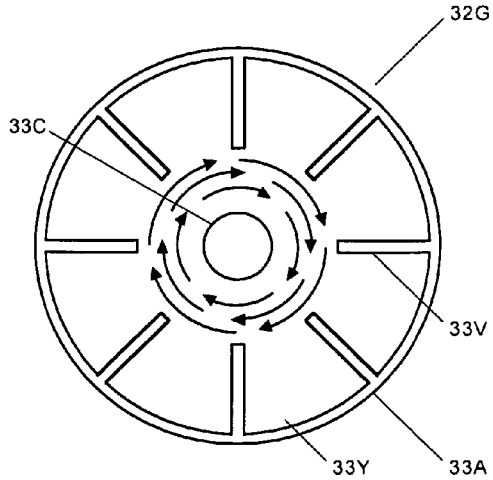
FIG. 1F (Prior Art)

FIG. 1C is a perspective view of a typical magnetron tube, whereas FIGS. 1D to 1F are cross-sectional top views of the magnetron tube and illustrate operating mechanisms of such a magnetron tube. As shown in FIG. 1C, the magnetron tube 32G includes a pair of permanent magnets 33M and an annular anode 33A is interposed between such magnets 33M. The magnets 33M are arranged to generate steady magnetic fields along a center axis of the anode 33A, e.g., by abutting a top of such an anode 33A with the N pole of the top magnet 33M and also abutting a bottom of the anode 33A with the S pole of the bottom magnet 33M. As shown in FIG. 1D which is the cross-sectional top view of a top section of the magnetron tube 32G, the anode 33A defines a hollow cylinder of a metal (e.g., iron) and includes multiple (generally an even number on vanes 33V each extending inwardly into a center of the anode 33A by a preset depth. Therefore, the vanes 33V form open trapezoidal-shaped areas (or resonance cavities) 33Y between each pair of adjacent vanes 33V. As will be described below, shapes and sizes of such cavities 33Y serve as tuned circuits and determine output frequencies of the microwaves generated by the magnetron tube 32G. The anode 33A typically operates in such a way that each cavity 33Y operate in opposite polarities to another cavity 33Y on its either side. As a result, the cavities 33Y are connected in parallel with respect to the output microwaves. In the center of the anode 33A is disposed a cathode (or a filament) 33C which extends by an approximately same length as the anode 33A. The cathode 33C is also supported by larger and rigid leads (not included in the figure) which are meticulously sealed into the magnetron tube 32G and properly shielded. One or multiple short rings 33R are then coupled to the vanes 33V in order to maintain each resonance cavity 33Y in a proper polarity. At least one connector 33T is also implemented for coupling the waveguide with the magnetron tube 32G, where the microwaves generated by such a tube 32G are then routed into the waveguide and guided therealong.

In operation and as described in FIGS. 1E and 1F, the electric current is supplied to the cathode 33C which is heated up to a certain preheat temperature. The cathode 33C then generates electrons which tend to move toward the positively-charged anode 33A along electric fields which are defined between the cathode 33C and anode 33A. Without any magnetic fields, the electrons would travel to the anode 33A along straight paths as shown in FIG. 1E. Because a pair of permanent magnets 33M are arranged to generate the magnetic fields in a direction perpendicular to the sheet, such electrons experience a force exerting at a right angle and, therefore, travel to the anode 33A along circular or, more specifically, spiral paths as shown in FIG. 1F. As the electrons swirl inside the anode 33A and around the resonance cavities 33V, the magnetron tune 32G emits the microwaves in the frequency range of about 2,450 MHz which are guided through the waveguide into the cooking chamber. Other configurational and operational details of conventional microwave heating devices are also provided in various references, a few examples of which are *The Complete Microwave Oven Service handbook*, Microtech, Gonzalez, Fla., U.S. and a website www.gallawa.com.

Such a conventional microwave heating device not only emits the microwaves for the cooking but also irradiates the harmful waves of various frequency ranges. For example, the magnetron tube may irradiate such low-frequency harmful waves when pulsed by the DC electric energy at a certain frequency, when turned off and on depending on a temperature in the cooking chamber, an extent of heating provided by the user, and the like. Even if the magnetron tube may operate on the perfect DC energy, the electrons swirling inside the tube inevitably irradiates such low-frequency harmful waves of which frequencies may be decided by detailed configurations of the resonance cavities, common or individual spaces formed outside such cavities, and the like. In this respect, the magnetron tube is more likely than not the primary source of the harmful waves irradiated from the prior art microwave heating device, and various parts of such a tube serve as the primary base units. In addition thereto, the microwave heating device includes secondary wave sources such as, e.g., the transformer, the actuator, and various other electrical and/or electronic parts in which the electric current flows and/or across which the electric voltage is applied and, accordingly, various parts of such secondary wave sources serve as the secondary base units which also irradiate the low-frequency harmful waves.

In order to counter such harmful waves irradiated from various base units of the conventional microwave heating devices, various counter units are incorporated to emit counter electromagnetic waves (to be abbreviated as the "counter waves" hereinafter) and to counter such harmful waves with the counter waves, e.g., by canceling at least a portion of the harmful waves with such counter waves in a target space, suppressing the harmful waves from propagating toward the target space, and the like. Thereby, the conventional microwave heating devices incorporated with one or more of the counter units of this invention are converted into the EMC microwave heating systems (or simply the EMC systems) of this invention. Various counter units and their countering mechanisms therefor are now enumerated. It is to be understood, however, that following counter units and/or countering mechanisms of this invention may be embodied in many other different forms and, accordingly, should not be limited only to such units and/or mechanisms which are to be set forth herein. Rather, various exemplary counter units and/or countering mechanisms described hereinafter are provided such that this disclosure is thorough and complete, and fully conveys the scope of the present invention to one of ordinary skill in the relevant art.

In a generic aspect of this invention, an EMC system includes at least one wave source and at least one counter unit and then counters the harmful waves irradiated by various wave sources with the counter waves emitted by the counter units. Each of the wave sources always includes at least one base unit which is the real source of such harmful waves, i.e., by irradiating the harmful waves, by affecting propagation paths of the harmful waves while maintaining and/or altering their amplitudes and/or phase angles, and the like, where examples of such base units may include, but not be limited to, conductive (or semiconductive) articles which are provided as wires, strips, plates, rings thereof, coils thereof, spirals thereof, and/or meshes thereof all of which emit such harmful waves when the electric current flows therein, insulative articles provided as wires, strips, plates, rings thereof, coils thereof, spirals thereof, and/or meshes thereof all of which can not carry the electric current but emit the harmful waves when the electric voltage is applied thereacross, permanent magnets which may affect the directions, paths, and/or amplitudes of such harmful waves, and the like. The wave source further includes at least one optional part which mechanically supports or retains such base units but which neither irradiates nor affects the propagation paths of the harmful waves, where examples of the optional part may include, but not be limited to, cases enclosing the base units, protective covers, couplers, any parts in which such current does not flow, any parts across which the voltage is not applied, and the like. The counter unit is then arranged to emit such counter waves for countering the counter waves, e.g., by canceling the harmful waves therewith in the target space, by suppressing the harmful waves therewith from propagating toward the target space, and the like. The counter unit may be arranged to counter the harmful waves along every direction from the base units of the wave source, e.g., above, below and around the base units. However, such an embodiment may be costly to implement, may not be feasible, and may not be necessary, particularly when the EMC system is to be used in a specific orientation by an user who is to be protected from such harmful waves. In such a case, the counter is arranged to counter the harmful waves only around a specific target space (or area) which is generally defined between the base unit and the user (or a specific body part thereof).

In order for the counter waves to counter (i.e., cancel and/or suppress) such harmful waves, there are a few prerequisite which the counter waves must satisfy. The first is the phase angles of the counter waves. In general, such counter waves preferably define the phase angles which are at least partially or substantially opposite to those of the harmful waves so that the counter waves may cancel and/or suppress the harmful waves when propagated to the target space from the same side as at least one of the base units. Alternatively, the counter waves may have the phase angles which are at least partially similar (or identical) to those of the harmful waves such that the counter waves cancel and/or suppress such harmful waves when propagated to the target space from an opposite side of at least one of the base units. When the system includes multiple counter units, each counter unit may emit the counter waves defining the same, similar or different phase angles. The next is the amplitudes of the counter waves. Contrary to the phase angles, the counter waves may also define amplitudes which effectively counter such harmful waves in the target space. When disposed closer to the target space than at least one of the base unit, the counter unit may emit the counter waves of the amplitudes which are less than those of the harmful waves. By the same token, the counter unit disposed farther from the target space than at least one of the base units may then emit the counter waves of the amplitudes greater than those of such harmful waves, while the counter unit disposed flush with at least one of the base units with respect to the target space may emit the counter waves of the similar or same amplitudes as such harmful waves. When the system includes multiple counter units, all of such counter units may be disposed in similar distances from at least one of the base units and/or target space or, in the alternative, at least two of the counter units may be disposed in different distances from at least one of the base units and/or target space. In addition to such distances and/or dispositions, such counter waves may define various intensities depending upon whether the counter waves counter such harmful waves throughout an entire portion of the target space or, alternatively, only at preset positions inside such a target space. For example, the counter unit preferably emits the counter waves capable of countering the harmful waves throughout the target space when the user is situated anywhere in such a target space. When the user is to be situated only in preset positions of the target space, however, the counter unit may be shaped, sized, arranged, and disposed to emit the counter waves which best counter the harmful waves in such positions but not with an efficiency in other parts of the target space.

Once the counter unit is arranged to emit the counter waves defining proper phase angles and amplitudes, such a counter unit may be shaped, sized, arranged, and disposed in order to counter the harmful waves depending on detailed countering mechanisms.

In one example, the counter unit may be shaped, sized, and/or arranged similar (or identical) to at least one of such base units, where such a mechanism is to be referred to as a "source matching" hereinafter. The basic concept of the "source matching" is that the counter unit may emit the counter waves defining wavefronts similar to a configuration (i.e., a shape, a size, and/or an arrangement) of the counter unit and that the wavefronts of the counter waves automatically match the wavefronts of the harmful waves, whereby the counter waves may counter the harmful waves due to the similarity between the configurations of the counter unit and at least one of such base units. When the system includes multiple base units, the single counter unit may be arranged to emit the counter waves which are capable of countering the harmful waves irradiated by one of the base units or countering a sum of the harmful waves irradiated from at least two or all of such base units. When the system includes multiple counter units, the counter units may emit the counter waves capable of countering the harmful waves which are irradiated by the single base unit or multiple base units. When the system includes multiple counter units and multiple base units, such counter waves emitted from each counter unit may counter the harmful waves irradiated from each base unit, a sum of the counter waves emitted from at least two counter units may counter the harmful waves which are irradiated from one of such base units, the counter waves emitted by a single counter unit may counter a sum the harmful waves from at least two of the base units, a sum of the counter waves from all of such counter units may counter a sum of the harmful waves irradiated from all of the base units, and the like. It is preferred in such a "source matching" that the counter unit emit the counter waves with the wavefronts which generally define the configuration similar to that of the counter unit. It is, however, possible that such a counter unit emits the counter waves with the wavefronts which have the configuration different from that of the counter unit, that the wavefronts of a sum of the counter waves emitted by multiple counter units may have the configuration different from the configuration of each counter unit or the arrangement of the counter units, and the like, as long as the counter waves may counter the harmful waves in such a target space.

In another example, the counter unit may be disposed (i.e., oriented, aligned, and/or positioned) in such a manner that at least one wavefront of the counter waves may match at least one wavefront of the harmful waves, where such a mechanism will be referred to as a "wave matching" hereinafter. The basic concept of the "wave matching" lies in the that the counter waves may counter the harmful waves when the counter unit is disposed in such a position to match the wavefronts of such counter waves with the wavefronts of the harmful waves as far as the configuration of the counter unit may be properly adjusted to satisfy such "wave matching." When the system includes multiple base units, a single counter unit may be arranged to emit the counter waves capable of matching and countering the harmful waves irradiated by one of the base units or, alternatively, matching and countering a sum of the harmful waves irradiated by at least two or all of the base units. When such a system includes multiple counter units, the counter units may emit the counter waves capable of countering the harmful waves emitted by a single base unit or multiple base units. When the system includes multiple counter units and multiple base units, the counter waves emitted by each counter unit may counter the harmful waves irradiated by each base unit, a sum of the counter waves emitted by at least two counter units may counter the harmful waves irradiated by one of the base units, the counter waves from a single counter unit may counter a sum the harmful waves irradiated by at least two of the base units, a sum of the counter waves from all of the counter units may counter a sum of the harmful waves irradiated by all of the base units, and the like, as far as at least a portion of at least one of such wavefronts of the counter waves may match and counter at least a portion of at least one of the wavefronts of the harmful waves in the target space.

Various counter units constructed based on the source matching and/or wave matching are to be disclosed hereinafter. It is appreciated in the source matching that there does not exist one-to-one correlations between the configuration of the counter unit and the configuration of the counter waves emitted thereby. That is, the counter waves of a certain configuration (or wave characteristics) may be obtained by a single counter unit which defines a certain shape and size and which is provided in a certain arrangement, by another counter unit which defines a similar shape and size but is provided in another arrangement, by another counter unit which has a different shape and size but is provided in a similar arrangement, by at least two counter units defining preset shapes and sizes and provided in a preset arrangement, by the same number of counter units defining different shapes and/or sizes or in a different arrangement, by a different number of counter units with similar shapes and/or sizes or in a similar arrangement. It is similarly appreciated in the above wave matching that there does not exist an one-to-one correlation between the disposition of the counter unit and the wavefronts of the counter waves emitted by the counter unit. In other words, the wavefronts with certain shapes may be obtained by a single counter unit which defines a certain configuration and is disposed in a certain position with respect to at least one of such base units and/or target space, by another single counter unit which defines another configuration and is disposed in another position, by at least two counter units which have preset configurations and are disposed in preset positions, by the same number of counter units which have different configurations and which are disposed in different positions, by a different number of counter units which define different configurations and are disposed in different positions, and the like. It is, therefore, appreciated that such counter units may be embodied in many other different forms and should not be limited to following aspects and/or their embodiments which are to be set forth herein. Rather, various exemplary aspects and/or embodiments described herein are provided so that this disclosure will be thorough and complete, and fully convey the scope of the present invention to one of ordinary skill in the relevant art.

In another aspect of the present invention, a single generic counter unit may be provided for a single generic base unit to counter the harmful waves from the base unit by the counter waves from the counter unit. FIGS. 2A to 2F show top schematic views of exemplary electromagnetic countering mechanisms in each of which a single counter unit emits the counter waves capable of countering the harmful waves which are irradiated from a single base unit of a single wave source according to the present invention, where the base unit is a point source in FIGS. 2A to 2C and 2F, while the base unit is an elongated source in FIGS. 2D and 2E. It is appreciated that these figures, however, may also be interpreted in different perspectives. For example, such figures may be interpreted as the top cross-sectional views, where the base units of FIGS. 2A to 2C and 2F are wires extending perpendicular to the sheet, and the base units of FIGS. 2D and 2E are strips or rectangular rods also extending normal to the sheet. In another example, the figures may be interpreted as sectional views of more complex articles, where the base units of FIGS. 2A to 2C and 2F may correspond to sections of coils, spirals, meshes, and the like, while the base units of FIGS. 2D and 2E may similarly correspond to sections of curvilinear rods or strips. It is also appreciated in these figures that such base units are enclosed in the wave sources which may be cases or other parts of such a system which do not irradiate such harmful waves. It is further appreciated in all of these figures that the EMC systems are disposed in such a way that the target space is formed to the right side of the counter and base units.

Figure 2A:
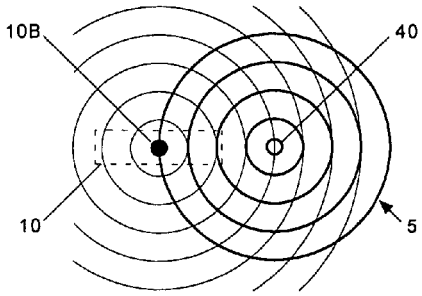
FIGS. 2A to 2F are top schematic views of exemplary electromagnetic countering mechanisms in each of which a single counter unit emits counter waves to counter harmful waves irradiated by a single base unit of a single wave source according to the present invention.
Figure 2D:
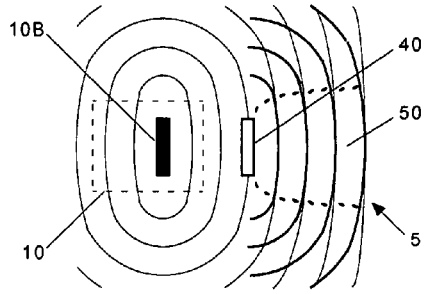

In one exemplary embodiment of such an aspect of the invention and as described in FIG. 2A, an EMC system 5 includes a single rectangular wave source 10 and a single counter unit 40, where the source 10 includes therein a single base unit 10B defining a shape of a point source. The counter unit 40 is similarly shaped as another point source and disposed to the right side of the base unit 10B. In this arrangement, the counter unit 40 emits the counter waves of which wavefronts are identical to those of the harmful waves irradiated by the base unit 10B. Because the counter unit 40 is disposed closer to a hypothetical target space on the right side of the figure, such counter wavefronts always define radii of curvature smaller than those of the harmful wavefronts. Accordingly, the counter unit 40 may counter (i.e., cancel or suppress) the harmful waves only along a line connecting the counter and base units 40, 10B or in its vicinity. It is appreciated that such an embodiment corresponds to the source matching which turns out to be ineffective due to a discrepancy in the radii of curvature of the wavefronts of the counter and harmful waves.

In another exemplary embodiment of this aspect of the invention and as depicted in FIG. 1B, an EMC system 5 includes a single counter unit 40 and a single rectangular wave source 10 with a single base unit 10B disposed therein. The base unit 10B is similar to that of FIG. 2A, however, the counter unit 40 is elongated, oriented vertically along its length, and disposed on the right side of the base unit 10B. Due to its elongated shape, the counter unit 40 emits the counter waves whose wavefronts are also elongated vertically and, therefore, define the radii of curvature which are greater than those of FIG. 2A and which match those of the harmful waves. Accordingly, such a counter unit 40 defines a target space 50 across which the counter waves counter the harmful waves to a preset extent. It is to be understood that such an embodiment corresponds to the wave matching mechanism in that the counter unit 40 is shaped similar to one of the harmful wavefronts.

Figure 2B:
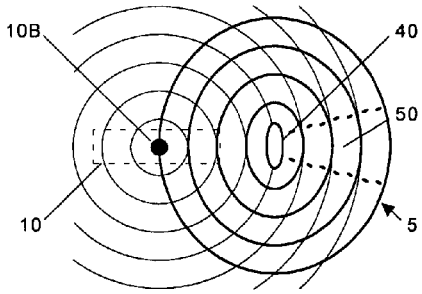
Figure 2E:
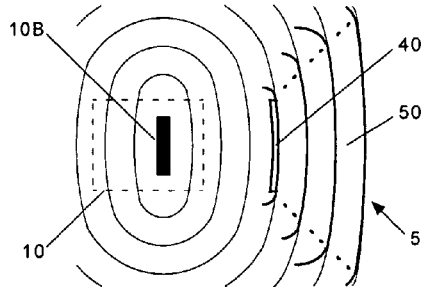
Figure 2C:
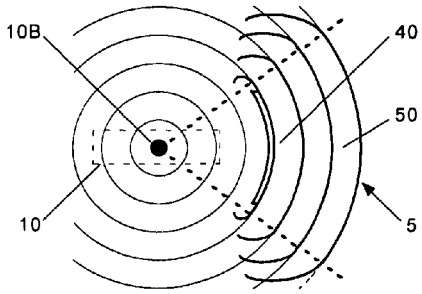

In another exemplary embodiment of this aspect of the invention and as depicted in FIG. 2C, an EMC system 5 includes a single counter unit 40 and a single rectangular wave source 10 with a single base unit 10B disposed therein. The base unit 10B is similar to that of FIG. 2A, however, the counter unit 40 is shaped and sized to conform to one wavefront of such harmful waves. That is, the counter unit 40 is shaped as an arc and disposed in an orientation concave to the right side of the figure or to the target space 50. Because of its arcuate shape, such a counter unit 40 emits the counter waves of which wavefronts are also arcuate and, therefore, define the radii of curvature which are similar or identical to those of the harmful waves. Therefore, the counter unit 40 defines a target space 50 across which the counter waves counter the harmful waves to a preset extent. It is appreciated that such an embodiment corresponds to another wave matching mechanism and that the counter waves emitted from this arcuate counter unit 40 better match such harmful wavefronts and define the target space 50 which expands over a wider angle around the base unit 10B than those of FIGS. 2A and 2B.

In another exemplary embodiment of this aspect of the invention and as depicted in FIG. 2D, an EMC system 5 includes a single counter unit 40 and a single rectangular wave source 10 with a single base unit 10B. Contrary to those of the above, this base unit 10B is rectangular and oriented vertically along its length or its long axis, and irradiates the harmful waves of which wavefronts define vertical and relatively straight portions which are attributed to the length or long axis of the base unit 10B. The counter unit 40 is shaped and sized similar or identical to the base unit 10B, and disposed in the same orientation as the base unit 10B. This orientation may be viewed to dispose the counter unit 40 along the vertical straight portions of the wavefronts of the harmful waves. The counter unit 40 also emits the counter waves whose wavefronts define vertical and relatively straight portions, similarly due to the length or long axis thereof. Because such portions of the counter wavefronts match those of the harmful wavefronts, the counter unit 40 forms the target space 40 to the right side. This embodiment corresponds to the source matching, wave matching or their combination. It is to be understood that the counter unit of FIG. 2A is shaped and sized as the base unit but ineffective due to a discrepancy in the radii of curvature between the wavefronts of the counter and source waves. The counter unit 40 of this embodiment is similarly shaped and sized as the base unit 10B but efficiently counter such harmful waves in the target space 50. The primary reason of this countering lies in the fact that both of the harmful and counter waves define along their wavefronts the vertical straight portions which generally do not depend upon the radii of curvature thereof. Otherwise, configuring the counter unit 40 similar to the base unit 10B and then disposing such a counter unit 10 between the base unit 10B and target space generally do not provide an efficient countering, where further details of this front arrangement are to be provided below. It is appreciated that such an embodiment corresponds to the source matching in which the counter unit 40 is shaped, sized, and/or arranged similar (or identical) to the base unit 10B.

In another exemplary embodiment of this aspect of the invention and as depicted in FIG. 2E, an EMC system 5 includes a single counter unit 40 and a single rectangular wave source 10 with a single base unit 10B which is similar to that shown in FIG. 2D. The counter unit 40, however, is shaped and sized to conform to one wavefront of such harmful waves. Similar to that of FIG. 2C, the counter unit 40 is shaped as an arc and disposed in an orientation concave to the right side of the figure or target space 50. Because of its arcuate shape, such a counter unit 40 emits such counter waves of which wavefronts are also arcuate and, therefore, define the radii of curvature which are similar or identical to those of the harmful waves, not only along their vertical straight portions but also along their curved portions, mainly due to the arcuate shape of the counter unit 40. Accordingly, such a counter unit 40 defines a target space 50 which also expands over a wide angle therearound and across which the counter waves effectively counter such harmful waves. It is to be understood that this embodiment corresponds to another wave matching mechanism.

Figure 2F:
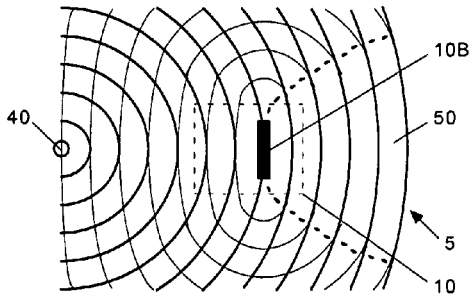

In another exemplary embodiment of this aspect of the invention and as depicted in FIG. 2F, an EMC system 5 includes a single counter unit 40 and a single rectangular wave source 10 which has a single base unit 10B therein. Both of the counter and base units 40, 10B are identical to those of FIG. 2A. However, the counter unit 40 is disposed on an opposite side of a target space 50 with respect to the base unit 10B and aligned with the base unit 10B as are the cases with the preceding figures. In this arrangement, the counter unit 40 emits the counter waves of which wavefronts are identical to those of the harmful waves irradiated by the base unit 10B. Because the counter unit 40 is disposed farther away from the target space 50, such counter wavefronts define the radii of curvature which approach and then match those of the harmful wavefronts when disposed at a proper distance from the base unit 10B. Accordingly, the counter unit 40 disposed in this rear arrangement may effectively counter the harmful waves and defines the target space 50 expanding over a wide angle around the base unit 10B. It is appreciated that the sole difference between the counter units of FIGS. 2A and 2F is their dispositions, i.e., one disposed in the "front arrangement" of FIG. 2A and another disposed in the "rear arrangement" of FIG. 2F. It is also appreciated that the rear arrangement is not necessarily superior to the front arrangement and that further details of selecting the proper arrangement are to be provided below. It is further appreciated that this embodiment corresponds to the wave matching in which the counter unit 40 is disposed at the position for matching the harmful wavefronts with the counter wavefronts.

Although not included in the figures, a single counter unit may be disposed in an arrangement flush with the base unit with respect to the target space, flush with a direction of propagation of the harmful waves, flush with another direction along which electric current flows in the base or counter unit, flush with another direction in which electric voltage is applied across the base or counter units, and so on. In this "lateral" arrangement, the radii of curvature of the counter wavefronts automatically match those of the harmful wavefronts and, therefore, the counter waves effectively match and then counter the harmful waves in the target space. For this arrangement, however, the wave source has to provide a space in which the counter unit may be incorporated. Therefore, the counter unit may be implemented inside the wave source and close to the base unit thereof when applicable. Otherwise, the counter unit may instead be disposed over, below or beside the wave source and as close to the base unit as possible. It is appreciated, however, that the counter unit disposed next to the base unit may propagate the counter waves onto the base unit and obstruct normal operation of the base unit. Accordingly, the lateral arrangement is preferably selected only when such an arrangement may not obstruct the normal operation of the base unit, wave source including such or EMC system including such. When the lateral arrangement does not affect the operation of the base unit but the counter unit may not be disposed close to the base unit due to space limitations, two or more counter units may be disposed on opposing sides (e.g., left and right, top and bottom, front and rear, and the like) of such a base unit and as close to the base unit as possible. Such counter units may also be arranged to emit the counter waves a sum of which may be symmetric or skewed toward a preset direction based on the wave characteristics of the harmful waves.

In another aspect of the present invention, multiple generic counter unit may be provided for a single generic base unit for countering the harmful waves irradiated by the base unit with the counter waves emitted by all of such counter units or emitted by at least two but not all of such counter units. FIGS. 2G to 2L are top schematic views of exemplary electromagnetic countering mechanisms in each of which multiple counter units emit counter waves to counter harmful waves irradiated from a single base unit of a single wave source according to the present invention, where the base unit is a point source in FIGS. 2G to 2K, while the base unit is an elongated source in FIG. 2L. It is appreciated that these figures, however, may also be interpreted in different perspectives. For example, such figures may be viewed as the top cross-sectional views, where the base units of FIGS. 2G to 2K are wires extending perpendicular to the sheet, and the base unit of FIG. 2L is a strip or a rectangular rod also extending normal to the sheet. In another example, the figures may be interpreted as sectional views of more complex articles, where the base units of FIGS. 2G to 2K may correspond to sections of coils, spirals, meshes, and the like, whereas the base unit of FIG. 2L may similarly correspond to sections of curvilinear rods or strips. It is also appreciated in these figures that such base units are enclosed in the wave sources which may be cases or other parts of such a system which do not irradiate such harmful waves. It is further appreciated in all of these figures that the EMC systems are disposed in such a way that the target space is formed to the right side of the counter and base units.

Figure 2G:
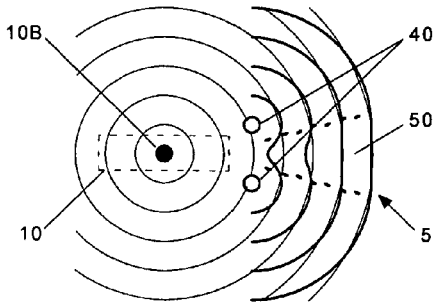
FIGS. 2G to 2L are top schematic views of exemplary electromagnetic countering mechanisms in each of which multiple counter units emit counter waves to counter harmful waves irradiated by a single base unit of a single wave source according to the present invention.
Figure 2J:
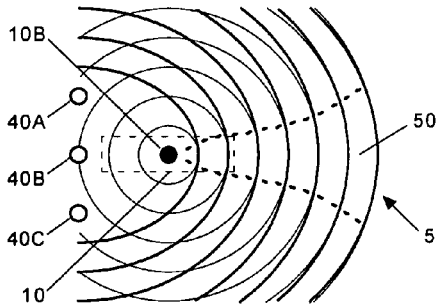

In one exemplary embodiment of such an aspect of the invention and as described in FIG. 2G, an EMC system 5 includes two counter units 40 and a single wave source 10 including a single base unit 10B. The base unit 10B is similar to those of FIGS. 2A to 2C, while a pair of counter units 40 are disposed between the base Ni 10B and a target space 50. Such counter units 40 are also disposed symmetric to the base unit 10B and flush with each other with respect thereto, i.e., the counter units 40 are disposed at an equal distance from the base unit 10B and/or target space 50. Such counter units 40 are arranged to emit the counter waves of the same phase angles so that the wavefronts of the counter waves from each counter unit 40 are superposed onto each other while increasing their amplitudes. As the counter waves propagate, their wavefronts which correspond to a sum of each set of wavefronts from each counter unit 40 increase their radii of curvature as if they are emitted by the elongated counter units of FIGS. 2B to 2E. Therefore, the counter wavefronts match the harmful wavefronts, and the pair of counter units 40 match and counter the base unit 10B while defining the target space 50 expanding over a limited angle therearound. It is to be understood that disposing two or more counter units 40 result in flattening the wavefronts of the counter waves and increasing the radii of curvature of the superposed portions of the counter wavefronts. It is further appreciated that this arrangement corresponds to the wave matching in which multiple counter units 40 are disposed along one wavefront of the harmful waves.

Figure 2H:
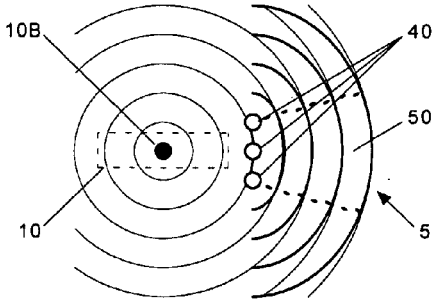

In another exemplary embodiment of this aspect of the invention and as depicted in FIG. 2H, an EMC system 5 includes three counter units 40 and a single wave source 10 enclosing therein a single base unit 10B. The base unit 10B is similar to those of FIGS. 2A to 2C, while the counter units 40 are similar to those of FIG. 2G such that all counter units 40 are disposed between the base unit 10B and target space 50 and flush with the base unit 10B. However, the system 5 includes one more counter unit 40 so that an array of three counter units 40 approximate the wavefronts of such harmful waves better than those of FIG. 2G. Accordingly, the counter units 40 emit the counter waves which better counter the base unit 10B and define the target space 50 expanding over a wider angle therearound than those of FIG. 2G. It is appreciated that disposing three counter units 40 result in further flattening the superposed wavefronts of the counter waves and also result in increasing the radii of curvature of such portions of the wavefronts of the counter waves. It is also appreciated that this arrangement is another wave matching where all three counter units 40 are disposed along one wavefront of the harmful waves.

In another exemplary embodiment of this aspect of the invention and as depicted in FIG. 21, an EMC system 5 includes two counter units 40 and a single wave source 10 including a single base unit 10B which is similar to those of FIGS. 2A to 2C. Two counter units 40 are disposed on opposite sides of the base unit 10B at an equal distance therefrom and also flush with the base unit 10B with respect to a target space 50. Similar to those of all of the preceding embodiments, such counter units 40 emit the counter waves defining the similar or identical phase angles so that the counter waves emitted by each of such counter units 40 superpose onto each other for not only increasing their amplitudes but also flattening the superposed portions of their wavefronts while increasing the radii of curvature of such wavefronts. Accordingly, the counter units 40 counter the harmful waves and define the target space 50 spanning around a rather limited angle therearound. It is appreciated that this arrangement is rather the source matching than the wave matching in that the counter units 40 are disposed in the symmetric arrangement and effect the elongated counter unit arranged flush with the base unit 10B.

In another exemplary embodiment of this aspect of the invention and as depicted in FIG. 2J, an EMC system 5 includes three counter units 40 and a single wave source 10 enclosing therein a single base unit 10B which is similar to those of FIGS. 2A to 2F. Contrary to those of FIG. 2H, three counter units 40 are disposed on an opposite side of a target space 50 with respect to the base unit 10B. The counter units 40 are arranged flush with each other relative to the base unit 10B and target space 50 and also spaced away from each other at an equal distance. Similar to those of FIGS. 2G to 21, both of outer counter units 40A, 40C are arranged to emit the counter waves defining the phase angles at least partially opposite to those of the harmful waves so that superposed portions of the wavefronts of the counter waves are flattened while increasing their radii of curvature. Contrary to those of the preceding figures, a middle counter unit 40B is arranged to emit the counter waves defining the phase angles which are at least partially similar to those of such harmful waves and opposite to those of the counter waves emitted by the outer counter units 40A, 40C. Therefore, a net effect of incorporating the middle counter unit 40B is to sharpen the curvature of the superposed portions of the wavefronts of a sum of the counter waves and to define the target space 50 expanding around a narrower angle around the base unit 10B, as manifest in a comparison between the target spaces 50 of FIGS. 2F and 2J. That is, by incorporating multiple counter units 40A-40C emitting the counter waves of the phase angles opposite to each other, it is feasible to precisely manipulate the wavefronts of the sum of such counter waves and their radii of curvature for better matching the wavefronts of the harmful waves. It is appreciated that such an embodiment may corresponds to the source matching, wave matching or a combination thereof.

The counter units 40A-40C of this embodiment may be incorporated in different arrangements. For example, only two counter units may be included to emit the counter waves with opposite phase angles, where resulting wavefronts of the sum of the counter waves are not symmetric but skewed to one or an opposite side. In addition, the distances between the counter units may be manipulated to adjust the wavefronts of a sum of the counter waves regardless of the number of the counter units. Moreover, the counter units emitting the counter waves defining the phase angles similar to those of the harmful waves may be employed as the outer units to further sharpen the superposed portions of the counter waves.

Figure 2K:
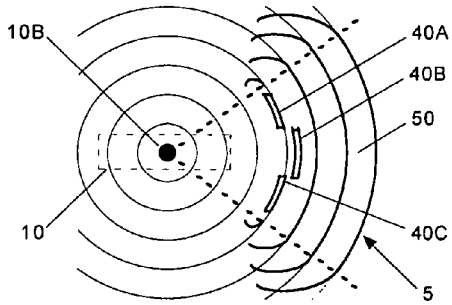
Figure 2I:
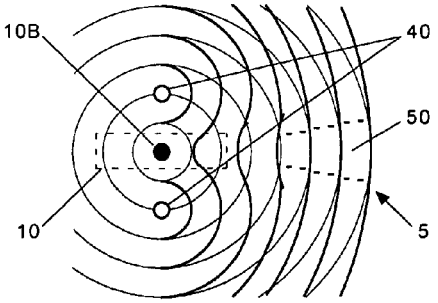
Figure 2L:
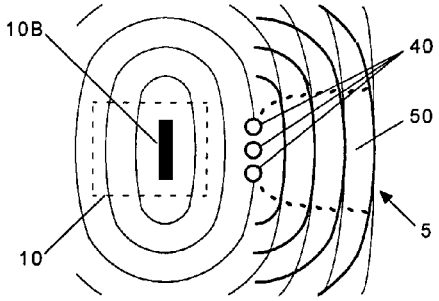

In another exemplary embodiment of this aspect of the invention and as depicted in FIG. 2K, an EMC system 5 includes three counter units 40 and a single wave source 10 enclosing therein a single base unit 10B which is similar to those of FIGS. 2A to 2C. The counter units 40A-40C are also similar to those of FIG. 2H so that all of such counter units 40A-40C are disposed between the base unit 10B and target space 50 and similar to each other, that the counter units 40A-40C emit the counter waves of the same or similar phase angles, and so on. However, each counter unit 40A-40C is arranged to form an arcuate article shaped and sized to match a portion of a wavefront of the counter waves. In addition, both of upper and lower counter units 40A, 40C are spaced away from each other and also disposed along one wavefront of the harmful waves, whereas a middle counter unit 40B is disposed between the upper and lower counter units 40A, 40C and along an adjacent wavefront of the harmful waves in such a manner that superposed portions of the wavefronts of a sum of the counter waves are flattened while defining larger radii of curvature and match the wavefronts of the harmful waves, thereby forming a target space 50 which expands over a wide angle around the base unit 10B. It is to be understood that this arrangement is another wave matching where all three counter units 40A-40C are disposed along multiple wavefront of the harmful waves.

In another exemplary embodiment of this aspect of the invention and as depicted in FIG. 2L, an EMC system 5 includes three counter units 40 and a single wave source 10 enclosing therein a single base unit 10B. While the base unit 10B is similar to those of FIGS. 2D and 2E, the counter units 40 are similar to those of FIG. 2H and emit the counter waves which are flattened and define vertical straight portions therealong. Therefore, the counter waves match the vertical straight portions of the harmful waves and define a target space 50 similar to that of FIG. 2D. It is appreciated that this embodiment is another source matching in which three counter units 40 approximate the elongated base unit 10B.

In another aspect of the present invention, a single generic counter unit may also be provided for multiple generic base units for countering the harmful waves from such base units by the counter waves from the counter unit. In one example, such a counter unit may be arranged to counter a sum of the harmful waves irradiated by each base unit, where detailed disposition of the counter unit may depend upon configurations and/or dispositions of the base units, amplitudes and/or directions of the harmful waves irradiated by such base units, and the like. Based thereupon, the counter unit may be disposed symmetrically to all or at least some of the base units, may be incorporated in the front, rear or lateral arrangement, and the like, where such arrangements are generally referred to an "global or overall countering" hereinafter. In another example, the counter unit is rather arranged to counter the harmful waves irradiated by only one of multiple base units, where such an arrangement is generally referred to as "local or individual countering" hereinafter. This local countering may only be effective when other uncountered base units irradiate negligible amounts of such harmful waves, when other uncountered base units irradiate non-negligible amounts of the harmful waves to other directions than the target space, and the like. Otherwise, it is preferred to manipulate the counter unit to counter the harmful waves of the uncountered base units, to include additional counter units for countering those harmful waves, and the like.

It is appreciated that various countering mechanisms described hereinabove for a single base unit may equally be applied to the system with multiple base units in the global countering mechanism. That is, the above countering mechanisms may be applied not to such harmful waves irradiated by the single base unit but to a sum of the harmful waves irradiated by multiple base units. When the system is to operate in the local countering mechanism, such mechanisms may be applied to each of multiple base units as well regardless of an exact number of such base units.

In another aspect of the present invention, multiple generic counter units may also be provided for multiple generic base units for countering the harmful waves from such base units by the counter waves from the counter units. In one example, multiple counter units are provided in the same number as the base units and each counter unit is arranged to counter only one of such base units in the local countering mechanism. Alternatively, at least one of such counter units may counter only one of such base units based upon the local countering mechanism, while at least one another of the counter units may counter at least two of the base units in the global countering mechanism. In another example, a less number of counter units are provided such that each counter unit is arranged to counter at least two of the base units based on the global countering mechanism, that at least one of the counter units counters one of the base units based on the local countering mechanism while at least one another of the counter units counters at least two of the base units in the global countering mechanism, and the like. In another example, a greater number of counter units are provided such that each base unit may be countered by at least two of the counter units, that at least one of the counter units counters one of the base units in the local countering mechanism and at least one another of the counter units may counter at least two of such base units in the global countering mechanism, and so on. In all of these examples, any of the above front, rear or lateral countering mechanisms may be used by the counter units, where such countering mechanisms may be same or different for each counter unit.

Configurational and/or operational variations of the EMC systems and/or their counter units as well as configurational and/or operational modifications of the EMC systems and/or their counter units as exemplified in FIGS. 2A to 2L also fall within the scope of the present invention.

As described above, a typical EMC system includes at least one wave source and at least one counter unit, where the wave source in turn includes or encloses at least one base unit therein and where the counter unit may include at least one optional electric connector such as a lead wire and at least one optional coupler for coupling the counter unit to other parts of the system. The EMC system includes at least one body which encloses at least a portion of the base units, at least a portion of the counter unit, and the like.

More specifically, the counter unit consists of various parts such as at least one body, at least one optional support, and the like. The body of the counter unit qualitatively corresponds to the base unit of the wave source in that such a body is the sole component of the counter unit which emits the counter waves when the electric current flows therein, as the electric voltage is applied thereacross, and the like. Accordingly, such a body may preferably be made of and/or include at least one electric conductor when the electric current is to flow therein, may be made of and/or include any electrically conductive, semiconductive, and/or insulative material as the electric voltage is to be applied thereto, and the like. The support serves to mechanically support the body and/or retain the body therein for mechanical protection and/or electrical isolation. The counter unit may also include an optional insert which is typically used to augment amplitudes of such counter waves, particularly when the counter unit includes at least one coil of conductive wire into which the insert is disposed. The insert may be made of and/or include ferromagnetic materials and/or other various magnetic materials such as, e.g., paramagnetic materials, diamagnetic materials, and ferrimagnetic materials, where the ferromagnetic materials are the preferred materials. It is appreciated that such a counter unit is typically arranged to maintain its configuration while emitting such counter waves, where this fixed configuration may be embodied by forming the body of the counter unit of rigid materials, by fixedly coupling the body of the counter unit to the support, and so on. In the alternative, the counter unit may be arranged to change its shape while emitting such counter waves, where this variable configuration may be embodied by forming the body of the counter unit of elastic or deformable materials, by movably coupling the body of the counter unit to the support, and the like. It is to be understood that the counter unit emitting the counter waves is to be opposed by at least one of the base units irradiating the harmful waves of an opposite magnetic polarity. Accordingly, such a counter unit tends to move while emitting the counter waves and a special provision may have to be implemented when it is desirable to fix the counter unit during its operation.

The counter may be provided in various configurations which typically refer to shapes, sizes, arrangements, and the like. In general, the configuration of the counter unit depends upon the above countering modes (such as the source matching and wave matching) and/or countering mechanisms (such as the front, rear or lateral arrangement, local or global matching, and the like) which generally depend on the configurational characteristics of the base units, wave characteristics of the harmful waves, and the like. The configuration of the counter unit depends on the shapes, sizes, orientation, and/or dispositions of the target spaces which are to be formed on one side of the counter unit.

The shape of the counter unit may be arranged to be identical or similar to the shape of at least one of the base units, where the counter unit is to be constructed to emit the counter waves matching the harmful waves automatically. The shape of the counter unit may be arranged to be different from the shape of at least one of the base units as well, where the counter unit may be fabricated in other shapes, may be wound around at least one of such base units, may enclose therein at least a portion of at least one of the base units, may be enclosed within at least a portion of at least one of the base units, and the like. Such a counter unit may define a shape of a wire, a strip, a sheet, a tube, a coil, a spiral, and/or a mesh, may define a combination of two or more of such shapes without defining any holes or openings therethrough, may define an array of two of more of such shapes while defining multiple holes and/or openings therethrough, and the like, where examples of the combinations and/or arrays may include, but not be limited to, a bundle including multiple identical or different shapes which bundle each other, a braid of multiple identical or different shapes braided along each other, and the like. The counter unit may also be made of a mixture which includes at least two materials and which are also provided in any of the above shapes, combinations, and/or arrays. It is appreciated that the coil (including a solenoid or a toroid), spiral, mesh, and/or arrays thereof may be particularly useful in the wave matching as will be described below. It is also appreciated that all of multiple counter units may define the same shape or that at least two but not all of such counter units may define the same shape. Alternatively, all of such counter units may define different shapes.

The counter unit may further be shaped to conform to at least one of the base units so that the counter waves emitted by the counter unit better match such harmful waves, where the counter unit may be conformed to at least one of the base units while approximating such a base unit or providing details to such a base unit. Alternatively, the counter unit may be shaped to not conform to the base units while manipulating such counter waves to match the harmful waves. This arrangement may be embodied when a single counter unit counters multiple base units, when multiple counter units counter a single base unit, and the like. It is to be understood in such an arrangement that a single counter unit or multiple counter units may be provided with such electrical energy (e.g., electric current or voltage) for emitting such counter waves capable of matching and countering the harmful waves in the target space. It is also appreciated that all of multiple counter units may conform to one or more of the base units or that at least two but not all of the counter units may conform to one or more of the base units. In the alternative, all of the counter units may not conform to any of such base units.

When one or multiple counter units are shaped similar or identical to one or multiple base units, the counter units are preferably arranged to approximate the base units. When the base unit forms a three-dimensional (or 3-D) shape, the counter unit may be constructed as a three-dimensional analog with a similar shape or simpler shape, a two-dimensional (or 2-D) analog or an one-dimensional (or 1-D) analog. When the base unit defines a 2-D shape, the counter unit may be fabricated as a 2-D of a similar or simpler shape or 1-D analog. When the base unit forms an 1-D shape, the counter unit may be provided as another 1-D analog defining a similar or simpler shape. When a single counter unit has to counter multiple base units, the counter unit may approximate only a major base unit as one of such analogs, may approximate at least two of such base units into one of the analogs, and the like. When multiple counter units counter a single base unit, each counter unit may approximate only a portion of the base unit. When multiple counter units are to counter multiple base units, such counter units may approximate the base units into the analogs of the same dimension or into various analogs provided in different dimensions. It is appreciated that those analogs conform to the base units and, accordingly, that the analogs may define rather straight or curved shapes depending upon the shapes of the base units. It is also appreciated that the analogs preferably maintain similarity with the base units, where such similarity may be maintained in terms of lengths of such counter and base units, widths thereof, heights thereof, thicknesses thereof, diameters or radii thereof, radii of curvature thereof, numbers of revolutions or turns thereof, ratios of such lengths, ratios of such widths, ratios of such thicknesses or heights, ratios of such diameters or radii, ratios of such numbers, and the like. When a single base unit is countered by a single counter unit, such configurational parameters are defined in each of the base and counter units. When a single counter unit counters multiple base units, such configurational parameters are defined in the counter unit, in an array of all of such base units, in an array of at least two but not all of such base units, and the like. When multiple counter units counter a single base unit, such configurational parameters are defined in the base unit, in an array of all of such counter units, in an array of at least two but not all of such counter units, and the like. When multiple counter units counter the same or different number of base units, such configurational parameters are also defined individually or in arrays as described above.

When the single or multiple counter units are shaped similar or identical to the single or multiple base units, the counter units are instead arranged to provide details to such base units, not in a sense of adding structures not existing in the base units but in the context of streamlining the wavefronts of such counter waves for the better purpose of matching the wavefronts of such counter waves with those of the harmful waves. For example, one or multiple small counter units may be disposed around (or inside) one or more major counter units for manipulating outer (or inner) edges of the wavefronts of a sum of the counter waves emitted by the major counter units. In another example, one or multiple small counter units may also be disposed closer to (or away from) one or more major counter units to manipulate the radii of curvature of the wavefronts of a sum of the counter waves which are emitted by the major counter units. Such small or minor counter units may be incorporated in various relations with respect to one or more major counter units for other purposes as well, as far as incorporation of such minor counter units may improve matching between the counter and harmful waves in the target space. Accordingly, when the system includes multiple counter units, all of the counter units may be arranged to approximate the base unit(s), all of such counter units may be arranged to provide details to the base unit(s), or some but not all of the counter units may approximate the base unit(s).

The counter unit may be arranged to define various cross-sections along a longitudinal or long axis thereof, its short axis which may be perpendicular or otherwise transverse to the long axis, and the like. In one example, the counter unit is arranged to define an uniform cross-section along at least one of such axes so that the counter waves emitted thereby also define the wavefronts defining the same shapes along such axes. In another example, the counter unit may be constructed to change its cross-section along at least one of such axes so that the counter waves emitted thereby also define the wavefronts varying their shapes along at least one of such axes. When the system has multiple counter units, all of such units may define the same shape or at least two of such counter units may define different shapes.

The counter unit may be arranged to have various sizes, where such a counter unit may emit the counter waves of proper amplitudes capable of effectively countering the harmful waves thereby. For example, the counter unit disposed in the front arrangement may define a smaller size than at least one of the base units due to its closer disposition toward the target space, whereas the counter unit disposed in the rear arrangement may define a larger size than at least one of the base units due to a greater distance toward the target space. However, the size of the counter unit may be decided by other factors such as, e.g., the shape of the counter unit, amplitudes of electric energy (i.e., electric current and/or voltage) supplied thereto, and the like. Therefore, the counter unit disposed in the front arrangement may have a size larger than at least one of such base units while emitting a less amount of the counter waves per an unit area, whereas the counter unit in the rear arrangement may have a size smaller than the base unit while emitting a greater amount of the counter waves per an unit area, and so on. That is, the size of the counter unit may be deemed as a secondary parameter which is in turn decided by various factors such as, e.g., the shape of the counter unit, amplitudes of the electric energy supplied thereto, distances to the base unit and/or target space, arrangement of such counter units, orientation thereof, and the like.

The counter unit may be arranged to have various sizes along its longitudinal axis and/or short axis. In one example, the counter unit is arranged to define an uniform size along at least one of such axes so that the counter waves emitted thereby also define the wavefronts defining the same shapes along such axes, assuming that the same amount of the electric energy is supplied thereto. In another example, the counter unit may be constructed to change its size along at least one of the axes so that the counter waves emitted thereby also define the wavefronts varying their shapes along such axes. In addition, the counter unit may maintain the same size along at least one of such axes while varying its shapes therealong. When the system includes multiple counter units, such counter units may have the same size or at least two of such units may define different sizes.

Multiple counter units may also be incorporated in various arrangements, where such counter units are arranged to emit the counter waves capable of automatically matching such harmful waves due to the arrangement. In one example, such counter units may be incorporated into an arrangement which conforms to the shape of a single base unit or conform to another arrangement of multiple base units such that the counter waves match the harmful waves in the target space. In another example, the counter units may be incorporated in an arrangement which does not conform to the shape of the single base unit or does not conform to the arrangement of multiple base units. This arrangement may be embodied when multiple counter units counter a single base unit or when multiple counter units are to counter a different number of multiple base units. It is appreciated in such an arrangement that the counter unit(s) may be provided with proper electrical energy (e.g., current or voltage) for emitting the counter waves which are capable of matching and countering the harmful waves in the target space. The counter units may be in an arrangement symmetric to at least one of the base units and/or target space so that such counter waves emitted thereby match the symmetric harmful waves. Conversely, the counter units may be disposed in an arrangement which is asymmetric to at least one of the base units and/or target space so that asymmetric counter waves counter the asymmetric harmful waves in the target space. The single counter unit or multiple counter units may be in an arrangement which encloses therein at least a portion of one or multiple base units. Conversely, the single counter unit or multiple counter units may be incorporated in another arrangement in which at least a portion of such a counter unit(s) may be enclosed by one or multiple base units. It is appreciated that the arrangement generally connotes a pattern of multiple counter units but that such an arrangement may also mean an orientation and/or alignment of a single counter unit. The counter may also be provided in various dispositions which generally refer to orientations, alignments, distances, mobilities, and the like. In general, such disposition of the counter unit depends on the countering modes (such as the source or wave matching), the countering mechanisms (such as the front, rear or lateral arrangement, local or global countering, and the like), the configurations of the counter unit, and the like, each of which generally depend on the configurational characteristics of at least one of the base units, wave characteristics of the harmful waves, and so on. In addition, the dispositions of the counter unit depend upon the shapes, sizes, orientation, and/or dispositions of the target spaces defined on one side of the counter unit. It is to be understood as rules of thumb that the counter unit(s) may be typically disposed closer to the base unit(s) in the local countering mechanism, while the counter unit(s) may be disposed farther away from the base unit(s) in the global countering mechanism.

The counter unit may be disposed in various orientations such that the counter waves emitted thereby may be properly oriented with and counter such harmful waves. In one example, the counter unit may be disposed in an orientation defined with respect to a direction of propagation of the harmful waves, e.g., by orienting its long axis normal to the direction of such propagation. In another example, the counter unit may be disposed in another orientation which is defined with respect to a direction of the electric current or voltage, e.g., by orienting its long axis parallel to, normal to or in a preset angle with respect to the direction of the electric energy. In another example, the counter unit may instead be disposed in another orientation which is defined with respect to the longitudinal and/or short axes of at least one of the base units. It is appreciated that such orientations of the counter unit generally depend on other configurations of at least one of the base units, particularly when such a base unit is arranged to irradiate the harmful waves in a direction which is different from at least one of its axes or which is different from a winding direction of its coil or other parts. When such a system includes multiple counter units, all of such counter units may be disposed in the same orientation, each counter unit may be disposed in a different orientation, at least two but not all of the counter units may also be disposed in the same orientation, and the like.

The counter unit may be disposed in various alignments such that the counter waves emitted thereby may be properly aligned with and counter such harmful waves. In one example, the counter unit may be aligned with one or more of the above directions and/or axes, may be wound in the same direction as at least one of such base units, and the like. In another example, such a counter unit may be misaligned with at least one of such directions and/or axes, may be wound in a direction different from that of at least one of the base units, and the like. When such a system includes multiple counter units, all of such counter units may be aligned in the same direction and/or axis, each counter unit may be aligned in a different direction or axis, at least two but not all of such counter units may be aligned in the same direction or axis, and the like. When the system includes multiple counter units, all of such counter units may be disposed in the same alignment, each counter unit may be disposed in a different alignment, and/or at least two but not all of the counter units may be aligned in the same orientation.

The counter unit may further be disposed in a lateral alignment, an axial alignment, a concentric alignment, and the like. In the lateral alignment, one or multiple counter units may be disposed side by side with respect to at least one of the base units or between at least two of the base units along the long and/or short axes thereof. In the axial alignment, one or multiple counter units are disposed along a direction of one or more of such axes in a preset distance from at least one of the base units. In the concentric alignment, one or multiple counter units may be disposed inside the single base unit, may be surrounded with multiple base units, may enclose the single or multiple base units, and the like.

The counter unit may also be disposed in various distances from at least one of the base units and/or target space. In one example, the counter unit may fixedly couple with the system in a preset distance from at least one of the base units in order to emit such counter waves with the wavefronts matching those of such harmful waves. When desirable, the counter unit may be arranged to receive variable electrical energy (i.e., current or voltage) such that the amplitudes of the counter waves may vary based thereon for countering the harmful waves of varying amplitudes, to define different target spaces, and the like. In another example, the counter unit may be movably coupled to the system and to translate and/or rotate between two positions so as to emit the counter waves and then to dispose their wavefronts in different locations with respect to the harmful waves with or without varying the amplitudes of the counter waves. Thus, the counter unit counters the harmful waves by the counter waves of the wavefronts of which characteristics vary according to the position of the counter unit relative to at least one of the base units and/or target space. In another example, such a system may include multiple counter units and manipulate wave emitting operation of each of the counter units. By properly recruiting all or some of such counter units with or without manipulating the amplitudes of the counter waves emitted thereby, the system may counter the harmful waves while defining the target space in various locations relative to at least one of the base units. When the system includes multiple counter units, all of such units may be fixedly incorporated thereinto, all of such units may be movably incorporated therein, or at least two but not all of such units may be movable incorporated therein.

The disposition of the counter unit may be assessed in terms of the distances measured along the longitudinal axis of at least one of the base units, along the short axis thereof, around at least one of the axes, and so on. The counter unit may be disposed closer to the target space than at least one of the base units as in the front arrangement, farther away from the target space than at least one of the base units as in the rear arrangement or flush with the target space as in the lateral arrangement. When the system includes multiple counter units, all of the counter units may be disposed in the same arrangement or at least two of such units may be disposed in different arrangements. In addition, all of the counter units may be disposed in an equal distance from the base units or, alternatively, at least two of such counter units may be disposed in different distances therefrom. It is appreciated that the counter unit is preferably disposed on the same side of at least one of such base units with respect to the target space. Even when the counter unit is disposed on an opposite side of at least one of the base units with respect to the target space, the counter unit may still be able to counter such harmful waves, although such a disposition may not be the preferred embodiment.

The counter unit may be incorporated into various parts of the system and disposed in various exposures as well. When the system includes the body, the counter unit may be disposed on or over an exterior surface of the body, on or below an interior surface of the body, embedded into the body, and/or inside the body. The counter unit may instead be disposed on or over an exterior surface of the wave source, on or below an interior surface of such a wave source, embedded between such surfaces of the wave source, inside the wave source, and so on. The counter unit may be disposed on or over an exterior surface of at least one of such base units, on or below an interior surface of at least one of the base units, embedded between such surfaces of at least one of the base unit, inside at least one of the base units, and the like. In addition, the counter unit may be disposed and enclosed by at least a portion of at least one of the base units. Similarly, at least a portion or an entire portion of the counter unit may also be exposed through the system, through its body, through its wave source, through at least one of the base units, and the like. Moreover, the counter unit may fixedly or movably couple with one or more existing parts of the system, wave source, and/or base unit or, alternatively, may couple therewith by a coupler. Similarly, the counter unit may be spaced away from the system, its wave source, and/or at least one of its base units or may form an unitary article therewith.

The counter unit may be made of and./or include various materials in order to emit the counter waves having proper amplitudes in response to the electric energy supplied thereto and matching the harmful waves. In one example, the counter and base units may be made of and/or include the same materials so that such units may emit the same amount of the counter and harmful waves per an unit amount of such electric energy. In another example, the counter and base units may include at least one common material and at least one different material so that such units may emit the similar but not identical amount of the counter and harmful waves per the unit amount of the electric energy. In yet another example, the counter and base units may be made of and/or include different materials so that the counter and base units emit different amounts of waves per the unit amount of the electric energy. In general, various characteristics of the counter and base units determined by their compositions may be electric resistance or conductivity, magnetic permittivity, resonance frequency, and the like. Thus, the counter unit may be arranged to define the same, similar or different conductivity, permittivity, and resonance frequency based on its composition. An entire portion of the counter unit may be arranged to have an identical composition or, alternatively, various portions of the counter unit may be arranged to have different compositions which may vary along the long or short axis thereof. When the system includes multiple counter units, all of such counter units may have the same composition, at least two but not all of the counter units may have the same composition, or all of such counter units may have different compositions, thereby also maintaining or varying the above properties therealong.

As described hereinabove, precisely matching the phase angles (either opposite or similar) of the counter and harmful waves is a prerequisite for countering such harmful waves irradiated from at least one of the base units with the counter waves emitted by the counter unit. This phase matching may be attained by supplying proper electric energy (i.e., electric current or voltage) to the base and counter units and also optionally electrically coupling the counter and base units with each other. For illustration purposes, the electric energy supplied to such base units is to be referred to as a "source energy" hereinafter, and the electric current and voltage of the "source energy" are to be referred to as "source current" and "source voltage" hereinafter, respectively. In one example, identical source current or voltage may be supplied to the base and counter units either sequentially or simultaneously so that the phase angles of such harmful and counter waves are properly synchronized. In another example, the counter unit is supplied with only a portion of the source current or voltage sequentially or simultaneously, where the phase angles of such harmful and counter waves are still synchronized as well. In another example, the base units are first supplied with the source current or voltage, while the system thereafter modifies the amplitudes and/or directions of such source current or voltage and then supplies the modified current or voltage to the counter unit. As long as the phase angles of such source energy is maintained during modification, such counter and harmful waves are properly phase synchronized. In another example, the base units are first supplied with the source energy, and the system provides an analog of such source energy and supplies the analog energy to the counter unit with or without modifying the amplitudes and/or directions thereof, where such a system may employ various electronic components, circuits, and/or controllers to provide such an analog. As long as the phase angles of the electric energy is kept in the analog energy, such counter and harmful waves are phase synchronized as well. In another example, the counter unit is electrically coupled to such base units in a series mode, in a parallel mode or in a hybrid mode, where the counter unit is supplied with such source energy, modified source energy or analog energy as described hereinabove and where the counter unit may be supplied with such energy sequentially or simultaneously with the base units. When the system has multiple counter units, all of such counter units may be supplied with the same energy, at least two but not all of such units may be supplied with the same energy, each unit may be supplied with different energy, and the like. When the system includes multiple base units which are supplied with different source energies, the single counter unit may be supplied with only one of such energies, with a combination of at least two of such energies, and the like. When the system includes multiple counter units, such counter units may couple with the single or multiple base units in the same mode or different modes, the counter units may instead be supplied with the same energy or different energies sequentially or simultaneously, and the like. It is appreciated in all of the above examples that the phase matching also depends upon other configurations and/or dispositions of the counter unit so that a direction of winding of the counter unit, orientation of the counter unit, and/or alignment thereof may have to be considered to accomplish the proper phase matching.

Further details of the source and wave matching are to be provided hereinafter. As described above, it is appreciated in such source matching that there does not exist any one-to-one correlations between the configuration of the counter unit and the configuration (or wave characteristics) of such counter waves. That is, the counter waves defining a certain configuration (or wave characteristics) may be obtained by a single counter unit which defines a certain shape and size and is provided in a certain arrangement, by another counter unit which defines a similar shape and size but is provided in another arrangement, by another counter unit which has a different shape and size but is provided in a similar arrangement, by at least two counter units defining preset shapes and sizes and provided in a preset arrangement, by the same number of counter units defining different shapes and/or sizes or in a different arrangement, by a different number of counter units defining similar shapes and/or sizes or in a similar arrangement, and the like. It is appreciated in such wave matching that there does not exist an one-to-one correlation between the disposition of the counter unit and the wavefronts of the counter waves emitted by the counter unit. In other words, the wavefronts with certain shapes may be obtained by a single counter unit which defines a certain configuration and is disposed in a certain position with respect to at least one of such base units and/or target space, by another single counter unit which defines another configuration and is disposed in another position, by at least two counter units which define preset configurations and are disposed in preset positions, by the same number of counter units having different configurations and disposed in different positions, by a different number of counter units defining different configurations and disposed in different positions, and so on. There are, however, a few heuristic rules which may apply not only to such source matching but also to the wave matching. The first rule is that the counter unit incorporated in the front arrangement preferably has a characteristic dimension which is greater than that of at least one of the base units when other things equal in order to increase the radii of curvature of the wavefronts of the counter waves and to attain better matching between the counter and harmful waves. The second rule is the reverse of the first rule and dictates that the counter unit which is disposed in the rear arrangement preferably has a characteristic dimension less than that of at least one of the base units so as to decrease the radii of curvature of the wavefronts of the counter waves and to attain better matching between the counter and harmful waves. In order to match the amplitudes of such counter and harmful waves, however, the longer or wider counter unit in the front arrangement is arranged to emit the counter waves of the amplitudes less than those of the harmful waves. Similarly, the shorter or narrower counter unit in the rear arrangement is arranged to emit such counter waves of the amplitudes greater than those of the harmful waves. The third rule says that disposing multiple counter units emitting the counter waves of the same or similar phase angles tends to flatten the wavefronts of a sum of the counter waves and to increase the radii of curvature of the wavefronts of the counter waves. The fourth rule is then the reverse of the third rule and says that disposing a less number of counter units tends to sharpen the wavefronts of the sum of the counter waves and to further decrease the radii of curvature of the wavefronts of the counter waves. The fifth rule says that the wavefronts of the sum of the counter waves may be sharpened and the radii of curvature of such wavefronts may be decreased when at least one but not all of multiple counter units may emit the counter waves of the phase angles opposite to those of other counter units. It is appreciated that these rules do not generally apply to the counter units emitting the counter waves with the wavefronts defining the shapes different from the shape of the counter unit, and that those rules do not generally apply to the counter units with the non-uniform emitting power either which will be described in greater detail below.

A main purpose of the source matching is to manipulate the configuration of the counter unit to match that of at least one of the base units such that the counter waves emitted from the counter unit better match the harmful waves irradiated from the base unit. When a system preferentially depends upon the source matching to counter the harmful waves, its counter unit may preferably be disposed in a preset or reasonable distance from at least one of the base units, for any advantages which may be obtainable by the similarly configured counter unit may be lost otherwise. It is appreciated that the source matching is most useful when at least one of the base units defines a simple and/or symmetric configuration or when it is reasonably feasible to provide a replica of at least one of the complex base units. When the system has a single wave source with multiple base units or multiple waves sources each including at least one base unit, a single counter unit may be arranged to accomplish the source matching with respect to multiple base units or, alternatively, multiple counter units may be arranged to accomplish the source matching with respect to multiple base units. The source matching may include a shape matching, size matching, arrangement matching, disposition matching, intensity matching, and other configurational matching.

Some details of the shape matching have been disclosed heretofore. For example, the counter unit may be provided as a 3-D or bulk analog which corresponds to a replica or an approximation of a single or multiple 3-D base units, may be provided as a 2-D or planar analog which is an approximation of a single or multiple 3-D or 2-D base units or which is a replica of a single or multiple 2-D base units, may be formed as an 1-D or linear analog which is an approximation of a single or multiple 3-D, 2-D or 1-D base units or which is a replica of a single or multiple 1-D base units, and so on. Similarly, multiple counter units may be constructed as 3-D analogs which are the replica or approximation of a single or multiple 3-D base units, may be fabricated as the 2-D analogs which are the approximation of a single or multiple 3-D or 2-D base units or which are the replica of a single or multiple 2-D base units, may be fabricated as the 1-D analogs which are the approximation of a single or multiple 3-D, 2-D or 1-D base units or which are the replica of one or multiple 1-D base units, and the like. Such analogs may define continuous shapes or may have shapes defining multiple holes or openings, may form solid shapes or deformable shapes, may define symmetric or asymmetric shapes, and the like. The shapes of any of such analogs may be determined based upon the above countering mechanisms or, conversely, such shapes may dictate other configurations of such analogs, may decide proper countering mechanisms adopted thereby, and the like.

The size matching may be embodied by defining the counter unit to be larger than, similar to or smaller than at least one of the base unit whether or not the counter unit may maintain such similarity between the configurations of the counter and base units. Whether or not the counter unit may emit the counter waves defining the wavefronts with the similar shapes as the counter unit itself, the size of the counter unit determines an extent of dispersion and/or flattening of such counter waves, edge characteristics of the wavefronts, and the like. As described above, the size of such a counter unit is also determined by various countering mechanisms adopted thereby, disposition thereof, amplitudes of the electrical energy supplied thereto, and the like. Conversely, the size of such a counter unit may dictate the selection of other configurations thereof, proper countering mechanisms, and the like.

The disposition matching may be embodied by manipulating the orientation of the counter unit, alignment thereof, distance to at least one of the base units and/or target space therefrom, its mobility, and the like. As described herein, the counter unit may be oriented in the preset relations with respect to such axes and/or various directions, may be disposed in the front, rear or lateral arrangement, may be aligned or misaligned with such directions and/or axes, may be aligned or misaligned with at least one of the base units axially, radially, angularly, concentrically, laterally, and the like. The disposition of the counter unit may also be dictated by various countering mechanisms adopted thereby, shapes and sizes thereof, amplitudes of the electrical energy supplied thereto, and the like. Conversely, the disposition of the counter unit may dictate other configurations of the counter unit, proper countering mechanisms employed thereby, and the like.

The intensity matching may be embodied by manipulating the amplitudes of the counter waves emitted by the counter unit. For example, the counter waves may define the amplitudes greater than, similar to or less than those of the harmful waves when measured in a certain distance from at least one of the base units, when measured across the target space or in a preset position inside the target space, and the like. The amplitudes of the counter waves are further dictated by various countering mechanisms employed thereby, shapes and/or sizes thereof, disposition thereof, amplitudes of such electrical energy supplied thereto, and the like. Conversely, the amplitudes of the counter waves may determine other configurations of the counter unit, proper countering mechanisms, and the like.

A main purpose of the wave matching is to dispose the counter unit along at least one of such wavefronts of the harmful waves and to emit the counter waves defining the wavefronts capable of matching and countering those of the harmful waves. When a system preferentially depends on the wave matching to counter such harmful waves, its counter unit may be disposed anywhere around at least one of the base units in any distance as long as the counter wavefronts may match the harmful wavefronts. It is appreciated that the wave matching is most powerful when at least one of the base units defines a rather complex or asymmetric configuration or when it is impossible to form a replica or approximation of such a complex base unit. When the system has a single wave source with multiple base units or includes multiple waves sources each including at least one base unit, a single counter unit may be arranged to attain the wave matching with multiple base units or multiple counter units may instead be arranged to perform the wave matching with multiple base units. The only disadvantage or complication as to the wave matching is that detailed shapes and distribution of the wavefronts of the harmful waves have to be assessed a priori.

In one type of the wave matching, the counter waves are emitted by at least one counter unit defining an uniform emitting capacity in which amplitudes per an unit configuration of the counter unit such as, e.g., its length, its width, its radius or diameter, its area, and/or its weight is maintained to be uniform thereacross. Therefore, such a counter unit emits the counter waves having the wavefronts which are similarly shaped as the counter unit itself and, when disposed along the wavefront of the harmful waves, counters the counter waves while defining the target space. In another type of the wave matching, such counter waves are emitted by another counter unit with a non-uniform emitting capacity in which amplitudes per the unit configuration of the counter unit vary thereacross. In such an arrangement, the counter unit emits the counter waves of the wavefronts which are not similar to the shape of the counter unit. Therefore, the counter unit of this non-uniform capacity are disposed not along a single wavefront of the harmful waves but across at least two of such wavefronts so as to emit the counter waves capable of matching the harmful waves and defining the target space.

It is appreciated that the counter units with the uniform emitting capacity may also be disposed along at least two wavefronts of the harmful waves as exemplified in FIG. 2E. When multiple counter units are disposed in different wavefronts of the harmful waves, such units may also be arranged to emit the counter waves of different amplitudes in order to compensate discrepancies in the distances to the base unit therefrom. Such compensation may be attained by various means, e.g., by adjusting the shapes and sizes of the counter units, by manipulating the amount of the electric energy supplied thereto, by controlling the orientations and/or alignments of such counter units, and the like. As far as a sum of the counter waves defines the wavefronts which match those of the harmful waves in the target space, such counter units may be disposed along adjacent or space-apart wavefronts of such harmful waves in various configurations and/or dispositions.

Similar to their counterparts in the case of the source matching, the counter unit for the wave matching may similarly define a shape of a wire, a strip, a sheet, a tube, a coil, a spiral, and/or a mesh, may also define a combination of two or more of such shapes without defining any holes or openings therethrough, may define an array of two of more of such shapes while defining multiple holes and/or openings therethrough, and so on, where examples of such combinations and/or arrays may include, but not be limited to, a bundle of multiple identical or different shapes bundling each other, a braid of multiple identical or different shapes braided along each other, and the like. The counter unit may then be disposed along the single or multiple wavefronts of the harmful waves.

Various EMC microwave heating systems of the present invention are specifically designed to counter such harmful waves in a carrier frequency range or an extremely low frequency range from about 50 Hz to about 60 Hz or another frequency range of less than about 300 Hz. Therefore, in the preferred embodiment of this invention, various counter units of the EMC microwave heating systems are arranged to emit the counter waves in such carrier frequency range or extremely low frequency range of from about 50 Hz to about 60 Hz or the frequency range of less than about 300 Hz, thereby effectively countering the harmful waves in the comparable frequency ranges. Considering various medical findings and/or presumptions that a main culprit of the harmful EM waves are those in these frequency ranges, these counter units are believed to effectively eliminate those harmful frequency components from the harmful waves from the base units of various electric and electronic devices.

Although not preferred, various counter units of the EMC systems of the present invention may also be arranged to emit the counter waves in an ultra low frequency range of less than about 2 kHz or about 3 kHz, the counter waves in a very low frequency range of less than about 30 kHz, and the counter waves in a low frequency range of less than about 300 kHz to counter the harmful waves in the same or similar frequency ranges. The counter units may be arranged emit the counter waves in other frequency ranges such as, e.g., the radio waves of frequencies ranging from about $5\times10^2$ Hz to about $10^8$ Hz, microwaves of frequencies ranging from about $10^8$ Hz to about $10^{12}$ Hz, and the like, in order to counter the harmful waves of similar frequency ranges. When desirable, such counter units may be arranged to emit the counter waves defining higher frequencies such as, e.g., ultraviolet rays of frequencies ranging from about $7.5\times10^{14}$ Hz to about $10^{17}$ Hz, X-rays of frequencies ranging from about $7\times10^{18}$ Hz to about $10^{19}$ Hz, gamma rays in a frequency range beyond $5\times10^{18}$ Hz, and the like, for countering the harmful waves of similar frequency ranges.

Such counter units may further be arranged to selectively counter specific components of the harmful waves or, alternatively, to specifically preserve specific components of such harmful waves while countering (i.e., canceling and/or suppressing) the rest of the harmful waves. For example and particularly when the harmful waves include higher frequency components, the counter units may be specifically arranged to preserve beneficial waves such as, e.g., infrared rays including far infrared rays in a frequency range from about 300 gHz to about 10 tHz, medium infrared rays in a frequency range from about 10 tHz to about 100 tHz, near infrared rays in a frequency range from about 100 tHz to about 700 tHz, and the like, while countering the rest of the harmful waves including those of the carrier frequency range and extremely low frequency ranges. Conversely, the counter units may be arranged to emit the infrared rays including such far-, medium-, and/or near-infrared rays as well.

In another aspect of the present invention, various counter units may also be implemented into various conventional microwave heating devices and convert such devices into the EMC microwave heating systems in which the harmful device EM waves which are irradiated by their base units may be countered (i.e., canceled and/or suppressed) by the counter waves emitted by their counter units.

In one exemplary embodiment of this aspect of the present invention, the counter units may be implemented into any base units shaped as electrically conductive wires, strips, sheets, tubes, coils, spirals, and/or meshes or, in the alternative, to any electrically semiconductive and/or insulative wires, strips, sheets, tubes, coils, spirals, and/or meshes for minimizing the irradiation of the harmful waves by countering such harmful waves by the counter waves, e.g., by canceling at least a portion of the harmful waves in the target space and/or suppressing the harmful waves from propagating to such a target space. Such counter units may be made of and/or include at least one material which may then be electrically conductive, insulative or semiconductive. The counter units may be implemented to any of the base units which have the shapes formed by one or multiple wires, strips, sheets, tubes, coils, spirals, and/or meshes, by modifying the shapes of one or multiple wires, strips, sheets, tubes, coils, spirals, and/or meshes, where a few examples of the modified shapes may be a solenoid and a toroid each formed by modifying the shape of the coil. In general, the counter units of this embodiment may be disposed in any of the foregoing arrangements and may counter the harmful waves by any of the foregoing mechanisms. Accordingly, a similarly or identically shaped and/or sized counter unit may be disposed lateral or side by side to one or more base units, may be axially, radially or angularly aligned with one or more base units, may enclose therein one or more base units, may be enclosed by one or more base units, may wind around one or more base units, may be wound by one or more base units, and the like, based on the source matching. In the alternative, a similarly or differently shaped and/or sized counter unit may be disposed along one or more wavefronts of the harmful waves irradiated by one or more base units for the wave matching. In addition, such counter units may be employed in a proper number and/or arrangement to counter the harmful waves according to the local countering or global countering.

In another exemplary embodiment of this aspect of the present invention, the counter units may also be implemented into any conventional electric and/or electronic elements such as, e.g., resistors, inductors, capacitors, diodes, transistors, amplifiers, fuses, triacs, and other signal processors and/or regulators in order to counter the harmful waves irradiated by the elements, where the electric and/or electronic elements function to manipulate at least one input signal supplied thereto and to produce at least one output signal at least partially different from the input signal. All of the above electric and/or electronic elements may qualify as the base units within the scope of the present invention when the unsteady current flows therein or when the unsteady voltage is applied thereacross. In addition, the above elements may also qualify as the base units within the scope of this invention when any of the elements produces the unsteady output signal (i.e., the electric current or voltage) in response to the input signal which may be steady or unsteady. Therefore, any of the above prior art elements and/or microwave heating devices including such elements may be converted into the EMC elements and/or EMC microwave heating systems by incorporating thereinto various counter units defining any of the above configurations in any of the above dispositions and/or arrangements, thereby countering such harmful waves in any of the above mechanisms. It is noted that such counter units may be provided in any dimension so that such EMC elements may be provided in a range of microns or nanometers.

Figure 3A:
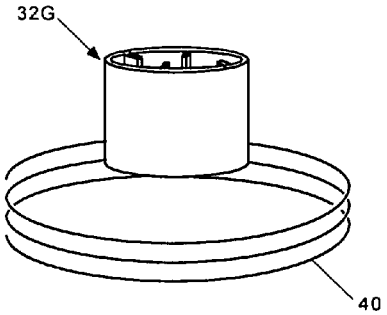
FIGS. 3A to 3R are schematic perspective views of exemplary counter units incorporated into a magnetron tube of an EMC system according to the present invention.
Figure 3D:
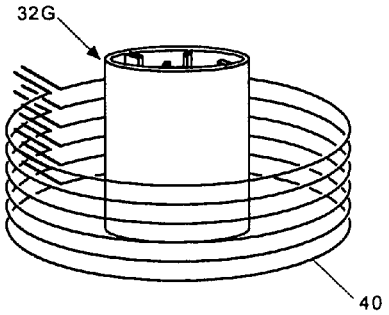

As described above, the microwave heating device includes various primary base units such as the resonance cavities of the magnetron tube, various common and/or individual spaces defined in such a tube, the waveguide, and the like. When the counter unit is arranged to approximate only one of such base units, the counter unit may be shaped as one or more of various analogs approximating one of the base units and counter such harmful waves irradiated by only one of the base units. Two or more of such analogs may be disposed in various locations around at least one of such base units or, in the alternative, may be mechanically and/or electrically coupled to each other, supplied with the electric energy in a preset pattern, and disposed in a preset location for countering the harmful waves irradiated by two or more of the base units. Such counter units may be provided as an unitary article which approximates two or more of such primary base units. For example, FIGS. 3A to 3R represent schematic perspective views of exemplary counter units each approximating a single or multiple base units and provided in various configurations based on the source and/or wave matching according to the present invention. It is to be understood in each of the figures that the counter unit is arranged to approximate the magnetron tube which is deemed as an assembly of its various primary base units.

In one example of FIG. 3A, the magnetron tube 32G is approximated as a coil along a periphery of which the electric current flows as illustrated in FIG. 1F. Accordingly, a counter unit 40 is provided as a shape analog of a coil in which the electric current flows in a direction similar (or identical) to that of the magnetron tube 32G. In this embodiment, the analog 40 may have a size which is also similar to that of the magnetron tube 32G, although the analog 40 may define a different size depending upon its disposition with respect to the target space and/or tube 32G as described above. In this example, the counter unit 40 is disposed farther away from the target space to be defined at the bottom of the tube 32G and, therefore, defines the configuration of a characteristic dimension (e.g., its diameter) which is larger than that of the magnetron tube 32G. The counter unit 40 may be made of and/or include the same material as the tube 32G or, in the alternative, such an analog 40 may be made of and/or include at least one material which is not present in the tube 32G. An entire portion of the analog 40 may also be made of the materials different from the transformer 26 as long as the counter unit 40 may emit the counter waves and counter the harmful waves irradiated by the tube 32G. It is to be understood that the arrangement shown in this figure corresponds to the vertical arrangement and, more specifically, the vertically stacked arrangement. It is also appreciated that the counter unit 40 of this embodiment generally operates in the overall countering mechanism in that a single counter unit 40 counters all of the base units of the magnetron tube 32G.

Such an analog 40 provided in the shape matching may define a shape which is different from that of the magnetron tube 32G. For example, the analog 40 may form an annular circular sheet, may form an annular oval sheet or sheet of other polygonal cross-sectional shapes, may define its center hole with a different shape, may have the center hole with a similar (or different) shape which may be provided not in the center but in another portion of the analog 40, and the like. The analog 40 may also define a size which is different from that of the magnetron tube 32G. For example, the center hole may be bigger (or smaller) than that of the magnetron tube 32G, the length and/or width of the analog 40 may be longer (or shorter) than those of the magnetron tube 32G, and the like. In addition, the coils of the analog 40 may be wound in the same (or different) directions with respect to a direction of the electric current in the magnetron tube 32G, may further be wound at an uniform (or non-uniform) pitch therealong, and the like. The coil 40 may be provided in the same (or different) arrangement as such a tube 32G or, alternatively, an entire analog 40 may be in the same (or different) arrangement as such a tube 32G. In addition, the analog 40 may be disposed it variable distances from the tube 32G, where the exact distance is determined based upon (or determines) the configurations and/or dispositions of the counter unit 40 and base units of the magnetron tube 32G. As long as the analog 40 may emit the counter waves capable of countering the harmful waves, the analog 40 may define any other suitable configurations which may be at least partially different from that of the magnetron tube 32G.

It is appreciated that such a counter unit 40 may be disposed as illustrated in the figure while forming the target space in various directions with respect thereto. For example, the counter unit 40 may emit the counter waves which preferentially match the harmful waves in its bottom (or top) and form the target space downwardly (or upwardly). The counter unit 40 may emit the counter waves which preferentially counter the harmful waves on its side, front or rear and define the target space on the side, front or rear thereof, respectively. To this end, the configuration and/or disposition of the counter unit 40 may be adjusted so as to manipulate the wave characteristics of the counter waves, the amplitudes and/or directions of the electric voltage and/or current supplied to the counter unit 40 may be controlled, at least a portion of the counter unit 40 may then be electrically coupled to at least a portion of the transformer 26, and the like.

Figure 3B:
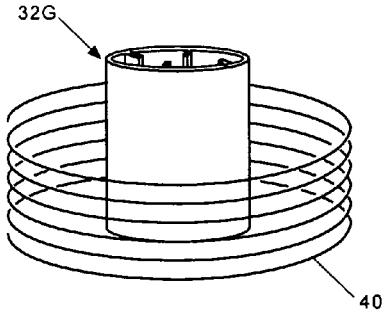
Figure 3E:
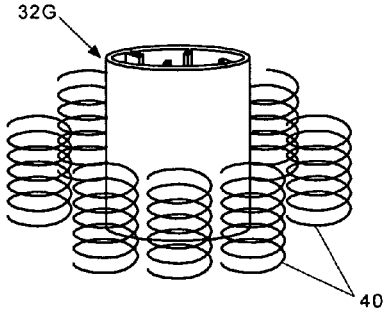

In another example of FIG. 3B, the magnetron tube 32G is similarly approximated as a coil along the periphery of which the electric current flows, and the counter unit 40 is also provided as a shape analog of the tube 32G similar to that shown in FIG. 3A. The counter unit 40, however, extends along a height which is greater than that of FIG. 3A and encloses therein at least a portion of the magnetron tube 32G in the concentric arrangement. Contrary to the counter unit of FIG. 3A which is disposed in a preset distance from the tube, the counter unit 40 of this example may generate the magnetic fields which penetrate into the magnetron tube 32G and adversely affect the wave generating operation of such a tube 32G. Accordingly, an overlapping depth between the counter unit 40 and magnetron tube 32G may have to be carefully selected to minimize such adverse effects. Other configurational and/or operational characteristics of the counter unit 40 of FIG. 3B may be similar or identical to those of the counter unit of FIG. 3A.

Figure 3C:
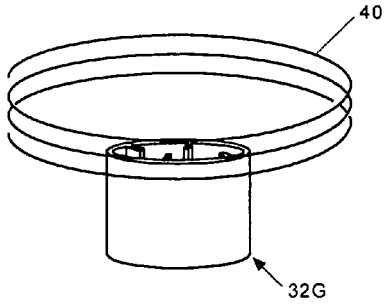

In another example of FIG. 3C, the magnetron tube 32G is similarly approximated as a coil along the periphery of which the electric current flows, and the counter unit 40 is also provided as a shape analog of the tube 32G similar to that shown in FIG. 3A. Such a counter unit 40, however, is disposed on top of the magnetron tube 32G and defines the characteristic dimension which is greater than that of the tube 32G, thereby forming the target space preferably over the top of the magnetron tube 32G. It is appreciated that the waveguide is preferably disposed over the top of the magnetron tube 32G in order to guide such microwaves from the tube 32G into the cooking chamber of the EMC microwave heating system. Accordingly, the analog 40 may be disposed inside the waveguide for countering the harmful waves along the propagation paths of the microwaves, may be disposed outside but over the waveguide for countering the harmful waves which escape out of the waveguide, may be disposed around the waveguide for countering such harmful waves inside and outside the waveguide, and the like. Other configurational and/or operational characteristics of the counter unit 40 of FIG. 3C may be similar or identical to those of the counter units of FIGS. 3A and 3B.

In another example of FIG. 3D, the magnetron tube 32G is similarly approximated as a coil along the periphery of which the electric current flows, and the counter unit 40 is also provided as a shape analog of the tube 32G similar to those of FIGS. 3A to 3C. Such a counter unit 40, however, consists of multiple loops of wire, where each loop encloses the magnetron tube 32G therein and where such loops are disposed parallel to each other and in a preset distance from each other. In addition, such loops are electrically connected to each other in a proper mode to emit the counter waves capable of matching and then countering the harmful waves from the magnetron tube 32G. Other configurational and/or operational characteristics of the counter unit 40 of FIG. 3D are similar or identical to those of the counter units of FIGS. 3A to 3C.

Figure 3F:
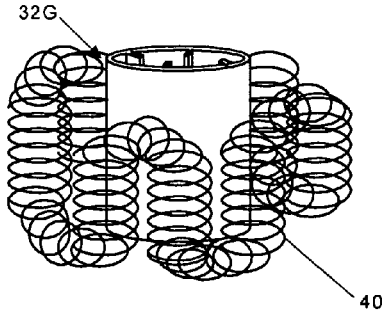

In another example of FIG. 3E, the magnetron tube 32G is approximated as multiple base units arranged parallel to each other, and multiple counter units 40 are provided as shape analogs for each of such base units. As described hereinabove, the primary base units of the magnetron tube 32G are the resonance cavities formed along the length of the tube 32G and, accordingly, each counter unit 40 may be viewed as a shape analog of each of multiple resonance cavities of the magnetron tube 32G. In this context, the counter units 40 of this example may preferentially operate in the local countering mechanism. Contrary to other analogs of FIGS. 3A to 3D, the analogs 40 of FIG. 3E individually extend along a longitudinal axis of the magnetron tube 32G and emit the counter waves propagating in either an upward or downward direction. By supplying the electric energy in proper directions, the counter units 40 may, therefore, approximate alternating polarities of the resonance cavities of the magnetron tube 32G. It is to be understood that such shape analogs 40 may be provided in the same number as the resonance cavities of the magnetron tube 32G or, in the alternative, may be provided in a different number as well. Such analogs 40 may be electrically coupled to each other in a proper mode as long as the counter waves emitted by such analogs 40 may match and counter such harmful waves in the target space. Further configurational and/or operational characteristics of the counter units 40 of FIG. 3E are similar or identical to those of the counter units of FIGS. 3A to 3E. In another example of FIG. 3F, the magnetron tube 32G is approximated as multiple base units arranged parallel to each other, and multiple counter units 40 are provided as shape analogs for each of such base units. In contrary to those of FIG. 3E, such analogs 40 of this example physically couple with each other in a series mode in order to emit the counter waves in an alternating polarities around the periphery of the tube 32G. Accordingly, the counter units 40 may also approximate the alternating polarity pattern of the resonance cavities of the tube 32G. Further configurational and/or operational characteristics of the counter units 40 of FIGS. 3F are similar or identical to those of the counter units of FIGS. 3A to 3E.

Figure 3G:
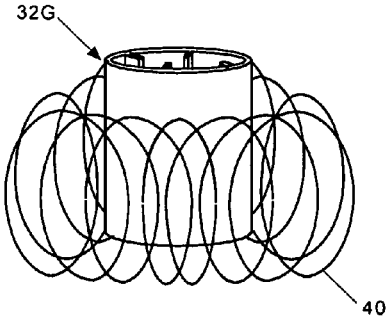
Figure 3J:
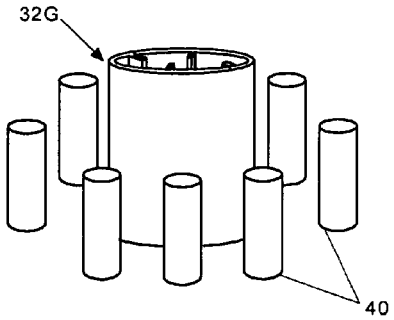

In another example of FIG. 3G, the magnetron tube 32G is also approximated into multiple base units arranged parallel to each other around its periphery, and a counter unit 40 is provided as another shape analog for such a tube 32G. It is appreciated, however, that the electric current typically flows in the magnetron tube 32G in a direction defined on a plane perpendicular to the long axis of the tube 32G as described in FIG. 1F. In order to match such flow pattern, the analog 40 may define an aspect ratio less than 1.0 (i.e., its horizontal diameter is greater than its vertical diameter) so that the electric current flows along horizontal paths which are defined along the analog 40 and are also longer than vertical paths thereof. The coil-shaped analog 40 of this example may define other configurations as described in conjunction with those shown in FIGS. 3A to 3C. Other configurational and/or operational characteristics of the counter unit 40 of FIG. 3G are similar or identical to those of the counter units of FIGS. 3A to 3F.

Figure 3H:
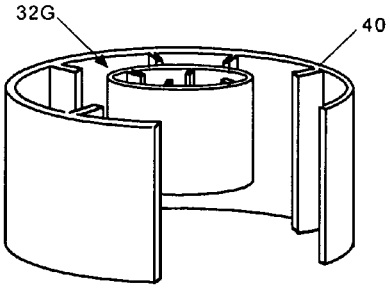

In another example of FIG. 3H which is a partly cutaway view, another single counter unit 40 is provided as a shape analog of the magnetron tube 32G or, more specifically, a replica of the tube 32G. Accordingly, the analog 40 includes an annular tube which corresponds to the anode of such a tube 32G and multiple protrusions each of which corresponds to the vane of the tube 32G. Contrary to the magnetron tube 32G, the analog 40 may not include the cathode as illustrated in this example or, in the alternative, may include another annular cylinder which may be interposed between the annular tube of the analog 40 and tube 32G. In addition, the analog 40 is shapes, sized, and disposed in such a manner to enclose at least a portion of the magnetron tube 32G therein according to the concentric arrangement. By supplying the energy to its parts in various modes similar to those of the magnetron tube 32G, such an analog 40 may simulate the operation of the tube 32G and emit the counter waves capable of matching and countering the harmful waves. It is to be understood that the analog 40 may also be disposed in the front or rear arrangement or, alternatively, to be disposed flush with the tube 32G, where the amplitudes of the counter waves may then be determined based on such disposition. Other configurational and/or operational characteristics of the counter unit 40 of FIG. 3H are similar or identical to those of the counter units of FIGS. 3A to 3G.

In another example of FIG. 31 which is also a partly cutaway view, a single counter unit 40 is provided as a shape analog of the magnetron tube 32G or, more specifically, an approximation of the tube 32G. Therefore, the analog 40 includes an annular tube corresponding to the anode of the tube 32G and may also include the cathode as illustrated in the previous example. In addition, the analog 40 is shapes, sized, and disposed in such a manner to enclose at least a portion of the magnetron tube 32G therein according to the concentric arrangement. By supplying the energy in the proper direction, such an analog 40 may simulate the operation of the tube 32G and emit the counter waves capable of matching and countering such harmful waves. It is appreciated that the analog 40 may be disposed in the front or rear arrangement or, in the alternative, to be disposed flush with the tube 32G, where the amplitudes of the counter waves may be determined based on such disposition. Other configurational and/or operational characteristics of the counter unit 40 of FIG. 31 may be similar or identical to those of the counter units of FIGS. 3A to 3H.

In another example of FIG. 3J, the magnetron tube 32G is also approximated into multiple base units arranged parallel to each other around its periphery, and multiple counter units 40 are formed as shape analogs disposed parallel to each other and angularly around the magnetron tube 32G. In this context, each analog 40 may be viewed as the shape analog of each of the resonance cavities of the magnetron tube 32G, and such counter units 40 of this example may preferentially operate in the local countering mechanism. Similar to those of FIG. 3E, the analogs 40 of FIG. 3E individually extend along the long axis of the magnetron tube 32G and emit the counter waves propagating in either an upward or downward direction. By supplying the energy in proper directions, the analogs 40 may, therefore, approximate alternating polarities of the resonance cavities of the tube 32G. It is appreciated that the shape analogs 40 may be provided in the same number as the resonance cavities of the magnetron tube 32G or, in the alternative, may be provided in a different number as well. Such analogs 40 may be electrically coupled to each other in a proper mode as long as the counter waves emitted by such analogs 40 may match and counter such harmful waves in the target space. Further configurational and/or operational characteristics of the counter units 40 of FIG. 3J are similar or identical to those of the counter units of FIGS. 3A to 3I.

Figure 3K:
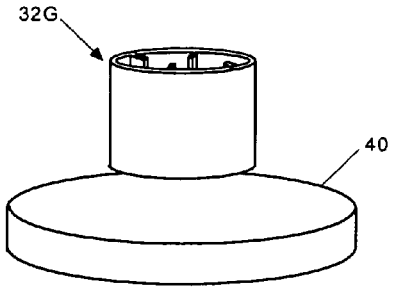
Figure 3I:
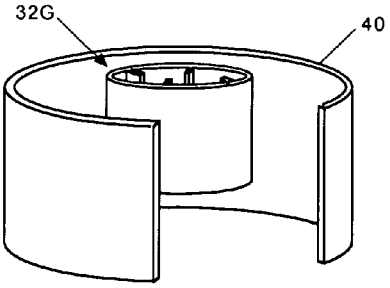

In another example of FIG. 3K, the magnetron tube 32G is approximated as a single bulk of the electrically conductive and wave generating article, whereas a single counter unit 40 is provided as a shape analog or, more particularly, a planar analog of the tube 32G. Therefore, the analog 40 may be shaped as a cylindrical slab or plate through which the electric energy is supplied in proper directions. When desirable, the analog 40 may form multiple sections which are electrically separated from each other, and the electric energy may be supplied to each of such sections in preset directions, in preset sequences, in preset amplitudes, and the like. Other configurational and/or operational characteristics of the counter unit 40 of FIG. 3K are similar or identical to those of the counter units of FIGS. 3A to 3J.

Figure 3L:
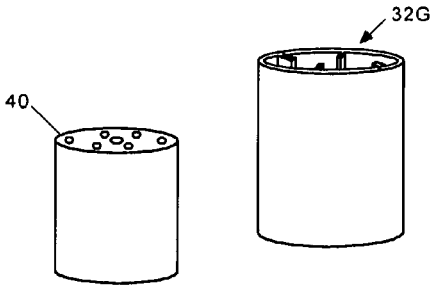

In another example of FIG. 3L, the magnetron tube 32G is also approximated as an assembly of multiple base units such as the anode, cathode, and resonance cavities, while a single counter unit 40 is provided as a shape analog which includes various parts each corresponding to each of the base units but defining a configuration which is simplified from the actual shape of each of such base units. In addition, the counter unit 40 is spaced apart from the magnetron tube 32G and disposed in the rear (or flush) arrangement in order to emit the counter waves capable of matching and countering such harmful waves. Other configurational and/or operational characteristics of the counter unit 40 of FIG. 3L are similar or identical to those of the counter units of FIGS. 3A to 3K.

Figure 3M:
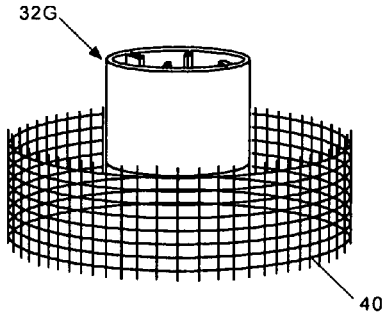

In another example of FIG. 3M, a single counter unit 40 is fabricated as a planar mesh which is wrapped around the sides of the magnetron tube 32G in an equal distance, thereby enclosing at least a portion of the tube 32G therein. In general, such a counter unit 40 operates on the wave matching and is therefore aligned with at least a portion of at least one wavefronts of the harmful waves such that the counter waves emitted by the counter unit 40 automatically match at least a portion of at least one of the wavefronts of the harmful waves in the target space. Such a mesh 40 may define various configurations for the wave matching, e.g., by incorporating preset numbers of horizontal and vertical wires in an uniform spacing or in different pitches, by defining an uniform diameter or varying diameter along the long axis of the magnetron tube 32G, by receiving the electric energy of different amplitudes along the horizontal and vertical wires or along different portions of such horizontal or vertical wires, and the like. Other configurational and/or operational characteristics of the counter unit 40 of FIG. 3M are similar or identical to those of the counter units of FIGS. 3A to 3L.

Figure 3P:
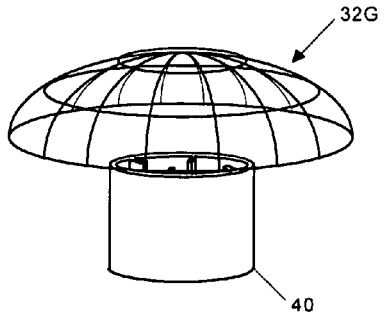
Figure 3N:
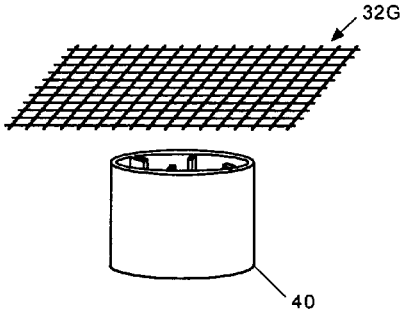
Figure 3Q:
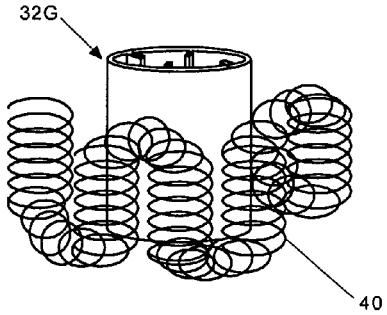
Figure 3O:
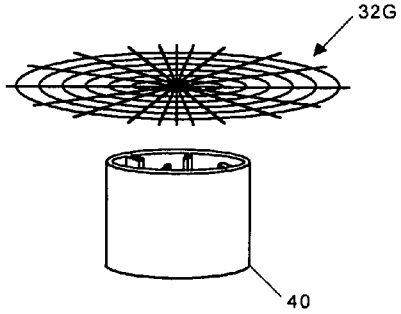
Figure 3R:
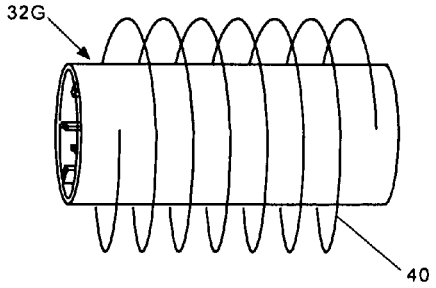

In another example of FIG. 3N, another single counter unit 40 is also provided as a planar mesh which is incorporated on top (or bottom) of the magnetron tube 32G in a preset distance in the vertical arrangement. This counter unit 40 also operates on the wave matching and, therefore, is preferably aligned with at least a portion of at least one wavefront of such harmful waves irradiated from the top of the magnetron tube 32G. In a similar example of each of FIGS. 30 and 3P, a single counter unit 40 is provided as a planar spiral (as in FIG. 30) or a curved mesh (as in FIG. 3P) which is disposed over (or below) or on top (or bottom) of the magnetron tube 32G in a preset distance based on the vertical arrangement, where each counter unit 40 emits the counter waves at least a portion of which may be capable of matching at least a portion of at least one of the wavefronts of such harmful waves inside the target space. It is appreciated that selection of the counter units 40 of FIGS. 3N to 3P depends on the detailed characteristics of the harmful waves such as, e.g., shapes and sizes of the wavefronts of the harmful waves. Accordingly, the counter units 40 may be provided with various configurations and/or dispositions as long as the counter waves emitted by such counter units 40 may better match and then counter the harmful waves inside the target space. Other configurational and/or operational characteristics of the counter units 40 of FIGS. 3N to 3P are similar or identical to those of the counter units of FIGS. 3A to 3M.

Various counter units of the above examples may be incorporated over, below, and/or around only a portion of the magnetron tube. For example and as exemplified in FIG. 3Q, multiple counter units 40 of FIG. 3F are disposed only around the front of the magnetron tube 32G, while defining the target space toward the front of such a tube 32G. Such an arrangement may be preferred when the user is to be situated only in a preset portion or direction of the magnetron tube 32G. Further configurational and/or operational characteristics of the counter unit 40 of FIG. 3Q may be similar or identical to those of the counter units of FIGS. 3A to 3P.

The counter units of the above examples may further be implemented onto the magnetron tube which is not incorporated in the usual upright disposition. For example and as exemplified in FIG. 3R, the magnetron tube 32G is disposed horizontally so that its long axis and resonance cavities extend horizontally as well. Any of the single counter units 40 of FIGS. 3A to 3D may then be disposed about the periphery of the magnetron tube 32G horizontally for countering such harmful waves in the target space. As will be disclosed below, the horizontal disposition of the magnetron tube 32G may yield a variety of benefits which have not been achieved in the prior art microwave heating devices. Other configurational and/or operational characteristics of the counter unit 40 of FIG. 3R may also be similar or identical to those of the counter units of FIGS. 3A to 3Q.

Various counter units of the present invention may also be incorporated into other parts of the EMC microwave heating system in order to counter the harmful waves which are irradiated therefrom and/or transmitted therethrough. For example, various counter units may be employed for countering the harmful waves irradiated by the actuator of the EMC system as disclosed in one of the co-pending Applications entitled "Electromagnetically-Countered Actuator Systems and Methods" and bearing the Serial Number, U.S. Ser. No. 12/318,539 which issued to U.S. Pat. No. 8,148,872. In another example, various counter units may also be employed to counter the harmful waves irradiated by the transformer of the EMC system as disclosed in another of the co-pending Applications which is entitled "Electromagnetically-Countered Transformer Systems and Methods" and bears the Serial Number, U.S. Ser. No. 12/318,543. In another example, various counter units may be employed to counter the harmful waves which are irradiated from various electric and/or electronic components of the EMC system as disclosed hereinabove. In another example, the counter units may also be incorporated into the body and/or door of the EMC system in order to counter such harmful waves transmitted therethrough. As described above, the EMC microwave heating system include various primary and secondary base units and, therefore, such harmful waves which may be transmitted through the body and/or door of the EMC system may be more likely than not a sum of the harmful waves irradiated from their primary and/or secondary base units. When such an EMC system includes at least one counter unit for any of such base units, the harmful waves irradiated by such a base unit are expected to be reasonably countered by the counter unit and, accordingly, the residual harmful waves transmitted through the body and/or door of the system may preferentially include the harmful waves irradiated by the rest of such base units. When the system includes multiple counter units incorporated into different wave sources, the residual harmful waves transmitted through such a body and/or door of the system may preferentially include the harmful waves irradiated by the rest of such base units. In any case, it is preferred that the EMC microwave heating system include such counter units in the body and/or door in order to counter the residual harmful waves irradiated by the base units not countered by any counter unit and/or by the base unit which is not properly countered.

Accordingly and in another aspect of this invention, various counter units are incorporated into a door of an EMC microwave heating system for countering the harmful waves transmitted to a target space therethrough. FIGS. 4A to 4L show schematic perspective views of exemplary counter units incorporated into a door of an EMC system according to the present invention. It is to be understood in all of these figures that such counter units may similarly be incorporated into other portions of a body of the EMC system for similar purposes.

Figure 4A:
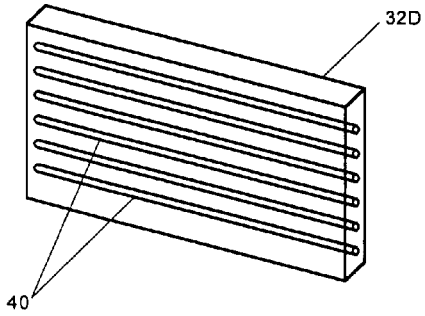
FIGS. 4A to 4L are schematic perspective views of exemplary counter units incorporated into a door of an EMC system according to the present invention.
Figure 4D:
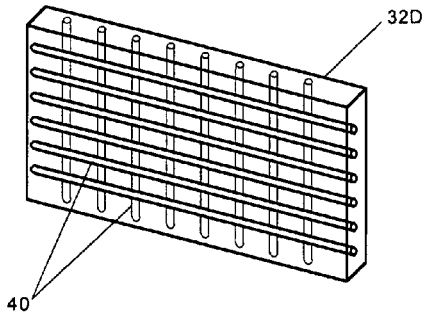
Figure 4B:
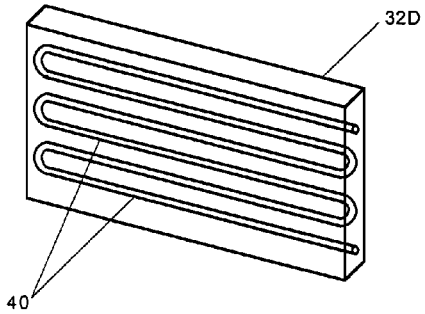
Figure 4E:
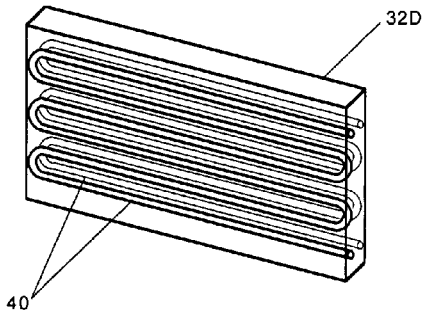
Figure 4C:
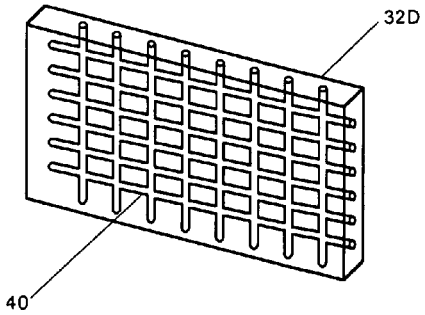

In one exemplary embodiment of such an aspect of the invention, a single counter unit may be incorporated on or in a door of an EMC microwave heating system. In one example of FIG. 4A, such a counter unit is provided as an array of multiple wires incorporated into a door 32D of an EMC system. More specifically, multiple wires of the counter unit 40 are disposed parallel to each other and spaced in an uniform interval. The wires receive the electric energy of preset amplitudes in preset directions and emit such counter waves capable of countering the harmful waves transmitted through the door 32D. When desirable, at least one of the wires of the counter unit 40 may be supplied with the energy of different amplitudes along a direction different from the rest of the wires. It is appreciated that the wavefronts of the harmful waves may define complex configurations and that such wavefronts may also vary their configurations without any preset patterns due to an existence of food in the cooking chamber. It is, therefore, desirable that the amplitudes and/or directions of the energy supplied to the counter unit 40 may be adaptively controlled in proportion to those of such harmful waves transmitted through the door 32D of the system. In another example of FIG. 4B, a single counter unit 40 is formed similar to that of FIG. 4A and incorporated into the door 32D of the system. However, opposing ends of adjacent wires of the counter unit 40 are physically and electrically coupled to each other, thereby defining a series of wires extending along opposite directions in adjacent rows. Other configurational and/or operational characteristics of the counter unit 40 of FIG. 4B may be similar or identical to those of the counter unit of FIG. 4A. In another example of FIG. 4C, a single counter unit 40 is provided as a planar mesh and incorporated into the door 32D of the system, where this mesh 40 may have various configurations similar to those meshes of FIGS. 3M to 3P. Further configurational and/or operational characteristics of the counter unit 40 of FIG. 4C are similar or identical to those of the counter units of FIGS. 4A and 4B.

Figure 4F:
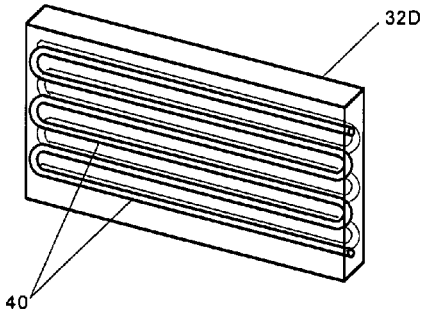
Figure 4G:
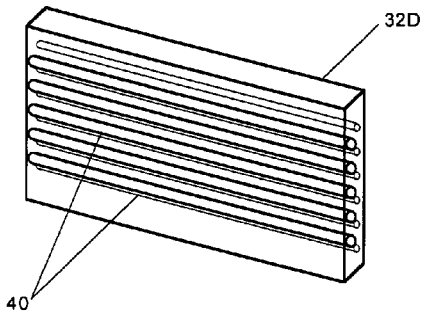

In another exemplary embodiment of this aspect of the invention, multiple counter units may be incorporated on or in a door of an EMC microwave heating system based on various arrangements or dispositions for countering the harmful waves transmitted therethrough. In one example of FIG. 4D, a pair of counter units 40 are incorporated into a door 32D of the system, where a first counter unit 40 is similar to that of FIG. 4A and disposed horizontally, while a second counter unit 40 is also similar to that of FIG. 4A but oriented vertically. Therefore, the counter units 40 define an overall configuration which is similar to that of FIG. 4C, except that the horizontal wires and vertical wires are separated by a preset distance. In contrary to that of FIG. 4C, such counter units 40 of this example are electrically isolated from each other and, therefore, may be supplied with the energy of various amplitudes along various directions. Further configurational and/or operational characteristics of the counter unit 40 of FIG. 4D are similar or identical to those of such counter units of FIGS. 4A to 4C. In another example of FIG. 4E, the system includes another pair of counter units 40 each of which is identical to that of FIG. 4B and both of which are incorporated in the same disposition. In another example of FIG. 4F, such a system includes another pair of counter units 40 which are identical to those of FIG. 4D but which are incorporated in opposite dispositions. Accordingly, such counter units 40 of FIG. 4E extend along the same direction and also bend in the same positions, while the counter units 40 of FIG. 4F extend along opposite directions and bend in opposite positions with respect to the door 32D. The counter units 40 of either example may receive the electric energy of various amplitudes in various directions as far as the counter waves emitted therefrom may match and counter the harmful waves transmitted through the door 32D. Other configurational and/or operational characteristics of the counter units 40 of FIGS. 4E and 4F are similar or identical to those of the counter units of FIGS. 4A to 4D. In another example of FIG. 4G, another pair of counter units 40 are incorporated to a door 32D of the system similar to that of FIG. 4A. However, a front counter unit 40 includes therein a less number of wires than a rear counter unit 40, while the wires of the front counter unit 40 are typically thicker than those of the rear counter unit 40. By manipulating the amplitudes and/or directions of the energy supplied to their wires, such counter units 40 may emit the counter waves capable of countering the harmful waves in the target space. Other configurational and/or operational characteristics of the counter unit 40 of FIG. 4G are similar or identical to those of the counter units of FIGS. 4A to 4F.

Figure 4J:
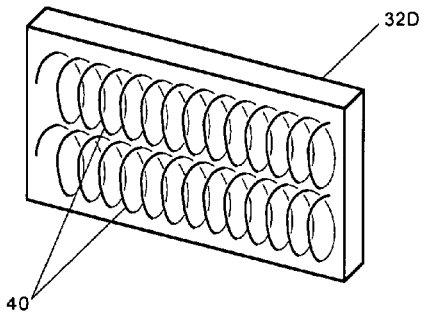
Figure 4H:
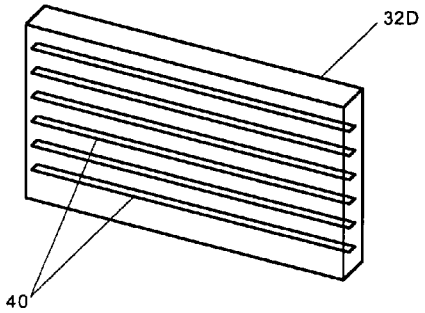

In another exemplary embodiment of this aspect of the invention, such counter units for a door of an EMC microwave heating system may be provided in various configurations defined not by wires but by other shapes such as, e.g., strips, sheets, tubes, coils, spirals, and the like. In one example of FIG. 4H, a single counter unit 40 is formed as an array of rectangular strips. More specifically, multiple strips of the counter unit 40 are disposed parallel to each other, spaced away from each other in an uniform interval, and incorporated into a door 32D. The strips receive the energy of preset amplitudes in preset directions and emit the counter waves which counter the harmful waves transmitted through the door 32D. When desirable, at least one of such strips of the counter unit 40 may be supplied with the electric energy of different amplitudes and in a direction different from the rest of the strips. Other configurational and/or operational characteristics of the counter unit 40 shown in FIG. 4H are similar or identical to those of the counter units of FIGS. 4A to 4G. In another example of FIG. 41, another single counter unit 40 is formed as a curved spiral and incorporated into a door 32D in a disposition convex (or concave) to the cooking chamber of the system, where an exact alignment and disposition of such a counter unit 40 may also depend upon the characteristics of the harmful waves transmitted through the door 32D. Other configurational and/or operational characteristics of the counter unit 40 of FIG. 41 are similar or identical to those of the counter units of FIGS. 3M to 3P and FIGS. 4A to 4H.

Figure 4K:
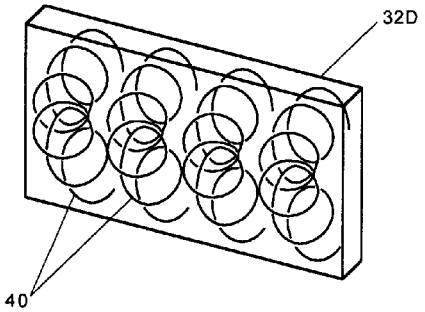
Figure 4I:
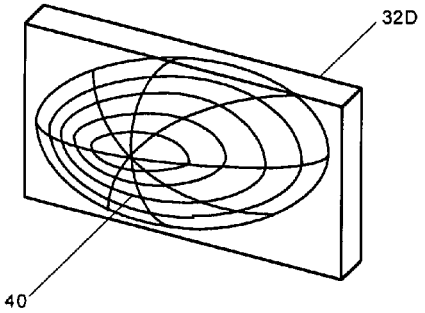
Figure 4L:
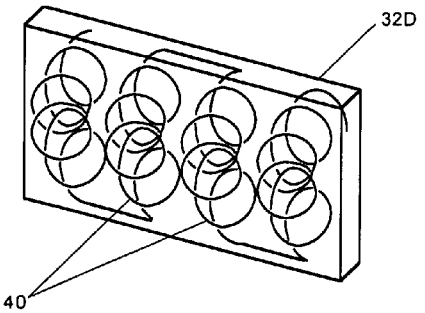

In another exemplary embodiment of this aspect of the invention, the system may include one or multiple counter units each of which includes at least one coil which is defined along a curvilinear center axis which is in turn aligned and/or disposed in various arrangements. In one example of FIG. 4J, the system includes a pair of counter units 40 each defining a coil. More specifically, each counter unit 40 is formed by winding a single wire along the center axis which is horizontally defined across an interior of a door 32D. In addition, the counter units 40 are disposed parallel to each other and also spaced away from each other in an uniform distance. Such coils 40 may be wound along the same direction or in opposite directions, where the electric energy may further be supplied thereto in proper directions to emit the counter waves capable of countering the harmful waves transmitted through the door 32D. Other configurational and/or operational characteristics of the counter unit 40 of FIG. 4J are similar or identical to those of the counter units of FIGS. 3A to 3E as well as FIGS. 4A to 4I. In another example of FIG. 4K, the system includes multiple counter units 40 of coils. More specifically, each coil 40 is wound beginning from a top portion of a door 32D, extended outwardly, bent at about 180° and downwardly, and extended back to a bottom portion of the door 32D. In a sense, such a counter unit 40 corresponds to a toroid cut into one half and disposed over the door 32D. As the electric energy is supplied thereto, each coil 40 emits the counter waves from one of its ends and counters the harmful waves inside the cooking chamber of the system. It is appreciated that these counter units 40 offer unique advantages over other counter units of this invention in that these units 40 always emit such counter waves along only one direction, i.e., into the cooking chamber. Accordingly, these counter units 40 may minimize transmission of the harmful waves through the door 32D while minimizing such counter waves from propagating in an anterograde direction toward the user. Other configurational and/or operational characteristics of the counter unit 40 of FIG. 4K are similar or identical to those of the counter units of FIGS. 4A to 4J. In another example of FIG. 4L, the system include multiple counter units 40 similar to those of FIG. 4K, except that such counter units 40 are physically and electrically coupled to each other. Other configurational and/or operational characteristics of the counter unit 40 of FIG. 4L are similar or identical to those of the counter units of FIGS. 4A to 4K.

Configurational and/or operational variations of the EMC systems and/or their counter units as well as configurational and/or operational modifications of the EMC systems and/or their counter units as exemplified in FIGS. 2A to 2L, FIGS. 3A to 3R, and FIGS. 4A to 4L as well as those not exemplified in such figures but disclosed in conjunction therewith also fall within the scope of the present invention.

As described hereinabove, the waveguide of the EMC microwave heating system constitutes another wave source transmitting the harmful waves therealong and thereacross. Accordingly, any of the above counter units may be incorporated on or over the waveguide. It is appreciated that such transmission of the harmful waves through the waveguide may also be minimized by incorporating the waveguide in different dispositions. For example, the waveguide may be fabricated while minimizing formation of sharp turns or bends, thereby preventing formation of discontinuities therealong. Such a waveguide may preferably be extended along a direction in which the waveguide least transmit such harmful waves thereacross. Accordingly, when the waveguide is arranged to transmit a substantial amount of the magnetic waves of various frequency ranges thereacross, the waveguide is extended preferentially toward the front of such an EMC system, thereby delivering the maximum amount of the microwaves into the cooking chamber while minimizing the propagation of the magnetic waves to the user. Conversely, as the waveguide is arranged to transmit only a negligible amount of the magnetic waves thereacross, the waveguide may be extended in any direction.

The EMC microwave heating system of the present invention may employ a novel waveguide which may minimize transmission of the harmful waves toward the user. In one example, the system may include a single waveguide which originates from the magnetron tube and bifurcates into multiple branch guides, where such branch guides are coupled to different portions of the cooking chamber in order to deliver the microwaves from such portions of the chamber, e.g., from opposite sides and/or corners thereof. The microwaves cook the food as they impinge thereupon, while canceling the rest of the microwaves when they impinge upon each other. In another example, the system may include a similar waveguide which bifurcates into two or more branch guides, where at least one but not all of the branch guides is arranged to reflect the harmful waves, thereby changing their phase angles at least substantially opposite to such harmful waves which are not reflected therealong. By delivering such harmful waves of opposite phase angles toward the food in the cooking chamber, the food may be cooked by the harmful waves regardless of their phase angles. However, the rest of the harmful waves which are not consumed in cooking the food impinge upon and cancel each other. Although this latter example may look similar to the previous example of this paragraph, the branch guides of the latter example may be disposed in any portions of the cooking chamber and deliver the harmful waves from any directions therein. Similar to the waveguide, the magnetron tube may further be incorporated into the system based on various dispositions including the usual upright disposition, a novel horizontal disposition, an angled disposition, and the like. Accordingly, such a magnetron tube may be disposed in various novel arrangements and/or dispositions as the waveguide as disclosed in this paragraph.

It is appreciated that any of the counter units described hereinabove may not be supplied with the electric energy and, therefore, may not actively emit the counter waves in response to the energy. Rather, the counter units may define the above configurations and may be in the above disposition so that the harmful waves irradiated by various base units may be absorbed into such counter units and converted to the electric voltage and/or current, thereby reducing the amount of such harmful waves propagating to the target space. Therefore, the EMC system may include one or multiple counter units all of which may serve as the passive counter units (i.e., those not receiving the electric energy), may include at least one passive counter unit and at least one active counter unit (i.e., one receiving such electric energy) or may include one or multiple counter units all of which serve as the active counter units. When desirable, at least one counter unit may also be arranged to serve as both of the active and passive counter units from time to time.

It is also appreciated that all of the aforementioned EMC microwave heating system includes the magnetron tube as the source of the microwaves but that such EMC systems may instead include Klystron tubes instead of the magnetron tubes, despite the low efficiencies of the former. In addition, various counter units of the EMC microwave heating systems of this invention may be incorporated to various prior art radar devices and convert such devices into EMC radar systems, where examples of such radar systems may include any systems capable of emitting the electromagnetic waves defining a desirable frequency ranges and then receiving such waves reflected by an object in a distance for the purpose of assessing various informations such as a distance to the object, a shape and/or a size thereof, and the like.

In another aspect of the present invention, any of such EMC microwave heating systems may include at least one electric shield and/or magnetic shield. In one example, the electric and/or magnetic shields (will be referred to as the "ES" and "MS" hereinafter, respectively) may be implemented to, on, over or below various portions of the EMC microwave heating system. In another example, such ES and/or MS may be implemented as described above and may also be employed in conjunction with any of the above counter units of this invention. In general, the ES may be made of and/or include at least one electrically conductive material so that the electric waves of the harmful waves may be absorbed thereinto and then rerouted therealong. When desirable, such an ES may be grounded as well so that the absorbed and rerouted electric waves may be eliminated. The MS may similarly be made of and/or include at least one magnetically permeable path member which may in turn be made of and/or include at least one highly magnetically permeable material, which may be able to absorb the magnetic waves of the harmful waves thereinto and then to reroute the magnetic waves therealong. When desirable, the MS may include at least one magnet member which may magnetically couple with the path member and terminate the absorbed and rerouted magnetic waves in at least one magnetic pole of the magnet member such as the S pole. The MS may include at least one optional shunt member which may also be magnetically permeable and shield its magnet member, thereby confining magnetic fields from such a magnet member closer thereto. Other details of such ES and MS have already been provided in the above co-pending Applications such as, e.g., "Shunted Magnet Systems and Methods" which bears a Ser. No. 11/213,703, "Magnet-Shunted Systems and Methods" which also bears a Ser. No. 11/213,686, and "Electromagnetic Shield Systems and Methods" which bears a Serial Number U.S. Ser. No. 60/723,274. It is appreciated that the details of these co-pending Applications may be modified so that the heating elements of such co-pending Applications may be replaced by various counter units of the present invention and that the ES and/or MS may be incorporated to the counter units of this invention as such ES and/or MS have been incorporated into various heating elements of the above co-pending Applications. It is appreciated that the ES and/or MS may also be incorporated into various portions of the EMC systems of this invention as the counter units are incorporated into such portions of the EMC systems of this invention.

The ES and/or MS may be provided to define the configuration which is identical to or similar to those of various counter units of this invention. The ES and/or MS may also be disposed in, on, over, around, and/or through the counter units and/or at least one of the base units. The ES and/or MS may define the configuration at least partially conforming to that of the counter units and/or at least one of the base units or, in the alternative, may define the configuration at least partially different from those of the ES and/or MS.

The path member of the MS may define the relative magnetic permeability greater than 1,000 or 10,000, 100,000 or 1,000,000. The shunt member may be arranged to directly or indirectly contact the magnet member and to define a relative magnetic permeability greater than 1,000, 10,000, 100,000 or 1,000,000. The ES and/or MS described hereinabove or disclosed in the co-pending Applications may further be incorporated into any of the prior art devices with or without any of the above counter units and define such EMC systems of this invention. The ES and/or MS may define the configuration which may be maintained to be uniform along the longitudinal or short axis of the base and/or counter units or which may vary therealong. Such configurations of the ES and/or MS may be identical to, similar to or different from those of the base and/or counters. The EMC system may include multiple ES and/or MS, where at least two of the MS and/or ES may shield against the magnetic waves and/or electric waves of the same or different frequencies in same or different extents. The ES and/or MS may be disposed over at least a portion (or entire portion) of the base and/or counter units. The EMC system may also include therein one or more of any of the above counter units as well as the ES and/or MS, where the base and/or counter units may operate on AC or DC.

As described above, the EMC systems of this invention may be provided with multiple defense mechanisms against the harmful waves which are irradiated by various base units of such a system. In one example, the counter unit may be incorporated into various portions of such an EMC system as described above. Accordingly, a single or multiple counter units may be provided in any of the above configurations and incorporated in any of the above dispositions. In another example, such ES and/or MS may be incorporated into various portions of the EMC system and shield against the electric and/or magnetic waves of such harmful waves, respectively, where dispositions of the ES and/or MS have been described in the above co-pending Applications. In another example, not only the counter units but also at least one of the ES and/or MS may be implemented into the EMC system so that the counter unit may counter at least a portion of such harmful waves and that the ES and/or MS may absorb and reroute the rest thereof. FIGS. 5A to 5F are schematic perspective views of exemplary EMC systems incorporating at least one of the above counter units and at least one shield according to the present invention.

Figure 5A:
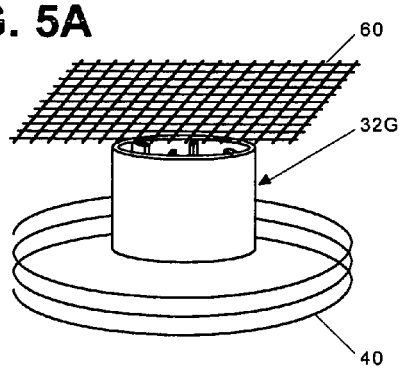
FIGS. 5A to 5F are schematic perspective views of exemplary EMC systems including counter units and electric and/or magnetic shields according to the present invention.
Figure 5D:
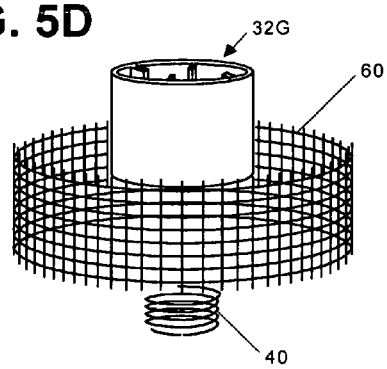
Figure 5B:
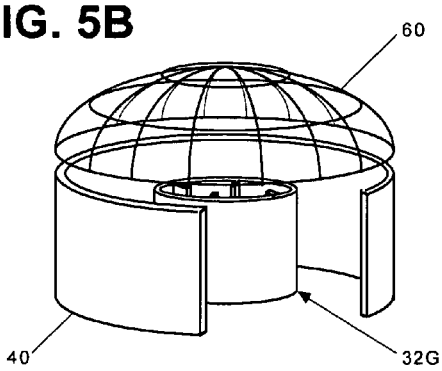
Figure 5E:
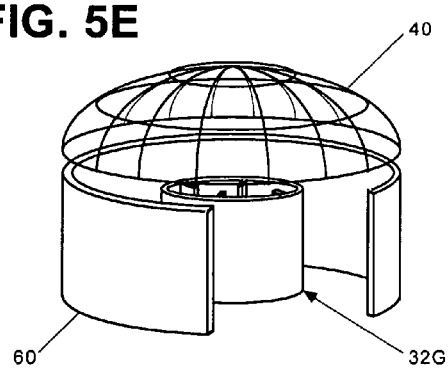
Figure 5C:
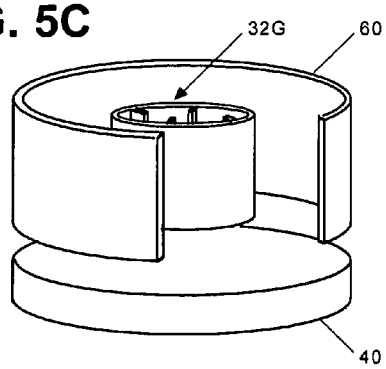
Figure 5F:
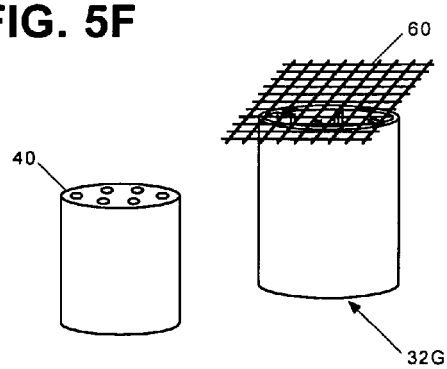

In one example of FIG. 5A, a magnetron tube 32G is countered by the counter unit 40 shown in FIG. 3A, while a mesh-shaped planar shield (i.e., an ES, MS or combination thereof) 60 is disposed on top of or over the tube 32G. Because the shield 60 serves to absorb the electric waves (i.e., EWs) or magnetic waves (i.e., MWs) of the harmful waves, such a shield 60 is preferably implemented outside the magnetron tube 32G and outside the waveguide and to absorb and terminate any residual harmful waves which may not be properly countered by the counter unit 40. In another example of FIG. 5B, a magnetron tube 32G is countered by the counter unit of FIG. 31 and a curved mesh-shaped shield 60 is disposed on top of the tube 32G. It is appreciated that selection of the planar shield of FIG. 5A and the curved shield of FIG. 5B may depend on the detailed characteristics of the wavefronts of the residual harmful waves. In another example of FIG. 5C, a magnetron tube 32G is countered by the counter unit 40 of FIG. 3K, and an annular shield 60 is disposed over the counter unit 40 and around the magnetron tube 32G. In contrary to the ES or MS of FIGS. 5A and 5B for absorbing and terminating such residual harmful waves propagating along the longitudinal axis of the magnetron tube 32G, the shield 60 of this example preferentially serves to absorb and to terminate the residual harmful waves which propagate through the sides of the magnetron tube 32G. In another example of FIG. 5D, a magnetron tube 32G is countered by the counter unit 40 of FIG. 3A which, however, has a smaller characteristic dimension and is disposed below the tube 32G. Accordingly, such a rear arrangement is preferable for defining the target space on top of the magnetron tube 32G. A mesh-shaped planar shield 60 is then disposed to enclose the sides of the tube 32G to absorb and to terminate the residual harmful waves irradiated around the sides of the magnetron tube 32G. In another example of FIG. 5E which is a partly cutaway view, a magnetron tube 32G is countered by the counter unit 40 of FIG. 3P, and an annular shield 60 is disposed below the counter unit 40 and encloses the tube 32G in order to absorb and to terminate the residual harmful waves irradiated around the sides of the tube 32G. In another example of FIG. 5F, a magnetron tube 32G is countered by the counter unit 40 of FIG. 3L, and a shield 60 is disposed above the magnetron tube 32G but not over the counter unit 40. Accordingly, such a shield 60 preferentially absorbs and terminates the residual harmful waves irradiated from the top of the tube 32G.

As exemplified in FIGS. 5A to 5F, the EMC microwave heating systems of this invention may be equipped with multiple lines of countering and shielding the harmful waves irradiated by the base units of the wave sources. When such an EMC system includes at least one of such counter units as well as at least one of such shields (i.e., MS and/or ES), the counter unit may serve as the primary line of defense against the harmful waves, while the shield may play the role of shielding the residual portion of the harmful waves. In the alternative, the EMC system may be arranged that the shield may serve as the primary line of defense against the harmful waves, while the counter unit may play the role of countering (i.e., canceling and/or suppressing) the residual portion of the harmful waves. In another alternative, the EMC system may instead be arranged that the counter unit and shield may counter and shield approximately same amounts of the harmful waves. Therefore, the shapes, sizes, dispositions, and/or arrangements of the counter unit and shield may be determined by the intended extents of the countering and shielding operations thereof.

It is appreciated that any of the above counter units are provided while using the least amount of such electrically conductive, semiconductive, and/or insulative materials, while minimizing a volume, a size, and/or a mass of such counter units. Accordingly, such counter units may be fabricated with less materials at lower costs and may be easily implemented into various locations of the EMC system. It is also appreciated that any of the above counter units are provided to emit the counter waves while using the least amount of electrical energy, e.g., by drawing the least amount of the electric current or voltage. Therefore, such counter units are not only energy-efficient but also least affecting operation of other parts of the EMC systems and their intended functions. In addition, these requirements of this paragraph may minimize electric resistances of the counter units and, therefore, minimize voltage drop across the counter units.

Unless otherwise specified, various features of one embodiment of one aspect of the present invention may apply interchangeably to other embodiments of the same aspect of this invention and/or embodiments of one or more of other aspects of this invention. Therefore, any of the counter units of FIGS. 2A to 2F may be incorporated into the EMC microwave heating systems of FIGS. 3A to 3R, FIGS. 4A to 4L, FIGS. 5A to 5F, and other systems which have not been exemplified in the figures but have been exemplified in conjunction therewith. Moreover, any of such counter units which operate on the source matching may be converted to operate based on the wave matching or vice versa, where the source-matched counter units may be disposed along one or more wavefronts of the harmful waves irradiated by at least one of the base units or where the wave-matched counter units may similarly be disposed in the preset relation to at least one of the base units or may be disposed in the arrangement similar to that of at least one of the base units. In addition, any of the ES and/or MS disclosed in FIGS. 6A to 6F and disclosed in the co-pending Applications may also be incorporated to any counter units disclosed in FIGS. 2A to 2L, FIGS. 3A to 3R, FIGS. 4A to 4L, and FIGS. 5A to 5F.

Various EMC microwave heating systems of this invention operate on the AC electric energy while countering the harmful EM waves with their counter units. When desirable, such EMC systems may operate on the DC power while similarly countering the harmful waves. It is appreciated that the EMC systems may use any conventional modalities capable of shielding and/or canceling the harmful waves. Accordingly, it is preferred that any of wires, strips, plates, sheets, and other electric and/or electronic parts of the EMC microwave heating systems may also be braided, bundled, concentrically fabricated or otherwise treated in order to minimize irradiation of the harmful waves.

It is to be understood that, while various aspects and/or embodiments of the present invention have been described in conjunction with the detailed description thereof, the foregoing description is intended to illustrate and not to limit the scope of the invention, which is defined by the scope of the appended claims. Other embodiments, aspects, advantages, and modifications are within the scope of the following claims as well.

What is claimed is:

1. An electromagnetically-countered microwave heating system which is configured to include a plurality of wave sources each having base units and which is also capable of countering harmful electromagnetic waves irradiated by said base units of said wave sources by at least one of suppressing said harmful waves from propagating toward a target space and canceling said harmful waves in said target space, wherein said base units are configured to represent only portions of said wave source responsible for at least one of irradiating said harmful waves and affecting propagation paths of said harmful waves therethrough, wherein said target space is defined between at least one of said base units and an user of said system and wherein said harmful waves define a frequency range of said microwave comprising:

at least one magnetron tube which is one of said wave sources and which is also configured to form a plurality of resonance cavities therein and to irradiate said harmful waves from each of said cavities, wherein at least one of said cavities serves as one of said base units;

at least one transformer which is another of said wave sources and which is also configured to include at least one primary coil and at least one secondary coil and to convert electric energy of a first voltage into electric energy of a second higher voltage, wherein both of said coils serve as two of said base units;

at least one actuator which is yet another of said wave sources and which is also configured to have at least one rotor and at least one stator and to generate rotation of said rotor by said electric energy, wherein at least one of said rotor and stator serves as one of said base units; and at least one counter unit which is configured to define a configuration similar to at least one of said base units and to emit counter electromagnetic waves which are configured to define phase angles opposite to those of said harmful waves irradiated from at least one of said base units, to define wave characteristics similar to those of said harmful waves irradiated by said at least one of said base units due to said configuration and, accordingly, to counter said harmful waves irradiated by said at least one of said base units.

2. The system of claim 1, wherein said system includes a single counter unit which is configured to have one of a first shape similar to only one of said coils, a second shape similar to an assembly of said coils, and a third shape similar to said transformer.

3. The system of claim 1, wherein said system includes a single counter unit which is configured to define one of a first shape similar to only one of said rotor and stator, a second shape similar to an assembly of said rotor and stator, and a third shape similar to said actuator.

4. The system of claim 1, wherein said system includes a single counter unit which is configured to define one of a first shape similar to only one of said cavities, a second shape similar to an assembly of at least two but not all of said cavities, a third shape similar to an assembly of all of said cavities, and then a fourth shape which is also similar to said magnetron tube.

5. The system of claim 4, wherein said counter unit is also configured to be disposed in one of a plurality of arrangements one of which is a lateral arrangement in which said counter unit is disposed side by side with at least one of said base units, a second of which is another lateral arrangement in which said counter unit is laterally stacked beside at least one of said base units, a third of which is a vertical arrangement in which said counter unit is disposed one of over and below at least one of said base units, a fourth of which is a concentric arrangement in which said counter unit is disposed in at least one of said base units, and a fifth of which is yet another concentric arrangement in which said counter unit is enclosing at least a portion of at least one of said base units.

6. The system of claim 1, wherein said system includes at least two counter units one of which is configured to define a shape similar to at least one of said base units of said magnetron tube and another of which is configured to define a shape similar to at least one of the rest of said base units.

7. The system of claim 6, wherein at least one of said counter units is configured to be disposed in one of a plurality of arrangements one of which is a lateral arrangement in which said at least one of said counter units is disposed side by side with respect to at least one of said base units, a second of which is a lateral arrangement in which said at least one of said counter units is laterally stacked beside at least one of said base units, a third of which is a vertical arrangement in which said at least one of said counter units is disposed one of over and below at least one of said base units, a fourth of which is a concentric arrangement in which said at least one of said counter units is disposed in at least one of said base units, and a fifth of which is another concentric arrangement in which said at least one of said counter units is enclosing at least a portion of at least one of said base units.

8. The system of claim 7, wherein at least two of said counter units are configured to be coupled to each other by at least one of a mechanical coupling, a magnetic coupling, and an electrical coupling.

9. The system of claim 8, wherein said coupling is in one of a series mode, a parallel mode, and a hybrid mode which is a combination of said series and parallel modes.

10. The system of claim 1, wherein said counter unit is configured to be incorporated between at least one of said base units and target space and to emit said counter waves of amplitudes less than amplitudes of said harmful waves for countering said harmful waves in said target space.

11. The system of claim 10, wherein said configuration of said counter unit is a dimension which is configured to be longer than that of each of said base units and to also match at least a portion of radii of curvature of said counter waves with at least a portion of radii of curvature of said harmful waves in said target space.

12. The system of claim 1, wherein said counter unit is configured to be disposed on an opposite side of said target space with respect to at least one of said base units and then to emit said counter waves of amplitudes greater than amplitudes of said harmful waves in order to counter said harmful waves in said target space.

13. The system of claim 12, wherein said configuration of said counter unit is a dimension which is configured to be shorter than that of each of said base units and to match at least a portion of radii of curvature of said counter waves with at least a portion of radii of curvature of said harmful waves in said target space.

14. The system of claim 1, wherein said counter waves propagate while defining a plurality of first wavefronts therealong, wherein said harmful waves propagate while defining a plurality of second wavefronts therealong, and wherein said counter unit is configured to emit said counter waves in a manner that at least a portion of at least one of said first wavefronts is configured to match at least a portion of at least one of said second wavefronts in said target space.

15. An electromagnetically-countered microwave heating system which is configured to include a plurality of wave sources each having base units and which is also capable of countering harmful electromagnetic waves irradiated by said base units of said wave sources by at least one of suppressing said harmful waves from propagating toward a target space and canceling said harmful waves in said target space, wherein said base units are configured to represent only portions of said wave source responsible for at least one of irradiating said harmful waves and affecting propagation paths of said harmful waves therethrough, wherein said target space is defined between at least one of said base units and an user of said system and wherein said harmful waves define a frequency range of said microwave comprising:

at least one magnetron tube which is one of said wave sources and which is also configured to form a plurality of resonance cavities therein and to irradiate said harmful waves from each of said cavities, wherein at least one of said cavities serves as one of said base units;

at least one transformer which is another of said wave sources and which is also configured to include at least one primary coil and at least one secondary coil and to convert electric energy of a first voltage into electric energy of a second higher voltage, wherein both of said coils serve as two of said base units;

at least one actuator which is yet another of said wave sources and which is also configured to have at least one rotor and at least one stator and to generate rotation of said rotor by said electric energy, wherein at least one of said rotor and stator serves as one of said base units; and at least one counter unit which is configured to define a configuration different from at least one of said base units, to be incorporated in a preset disposition, and to be supplied with electric voltage in a manner for emitting counter electromagnetic waves which define phase angles opposite to those of said harmful waves, which also have wave characteristics matching those of said harmful waves due to said disposition and, accordingly, which further counter said harmful waves due to said phase angles and wave characteristics in said target space.

16. The system of claim 15, wherein said counter waves propagate to said space while defining a plurality of first wavefronts therealong, wherein said harmful waves propagate thereto while defining a plurality of second wavefronts therealong, and wherein said counter unit is configured to emit said counter waves in a manner that at least a portion of at least one of said first wavefronts is configured to match at least a portion of at least one of said second wavefronts in said target space.

17. An electromagnetically-countered microwave heating system which is configured to include a plurality of wave sources each having base units and which is also capable of countering harmful electromagnetic waves irradiated by said base units of said wave sources by at least one of suppressing said harmful waves from propagating toward a target space and canceling said harmful waves in said target space, wherein said base units are configured to represent only portions of said wave source responsible for at least one of irradiating said harmful waves and affecting propagation paths of said harmful waves therethrough, wherein said target space is defined between at least one of said base units and an user of said system, wherein said harmful waves have a frequency range of said microwave, and wherein said harmful waves propagate toward said target space while forming a plurality of wavefronts, said system comprising:

at least one magnetron tube which is one of said wave sources and which is also configured to form a plurality of resonance cavities therein and to irradiate said harmful waves from each of said cavities, wherein at least one of said cavities serves as one of said base units;

at least one transformer which is another of said wave sources and which is also configured to include at least one primary coil and at least one secondary coil and to convert electric energy of a first voltage into electric energy of a second higher voltage, wherein both of said coils serve as two of said base units;

at least one actuator which is yet another of said wave sources and which is also configured to have at least one rotor and at least one stator and to generate rotation of said rotor by said electric energy, wherein at least one of said rotor and stator serves as one of said base units; and at least one counter unit which is configured to be disposed in an arrangement defined along at least one of said wavefronts and to be supplied with at least one of electric current and voltage in such a manner for emitting counter electromagnetic waves which have phase angles opposite to those of said harmful waves, propagate toward said target space while defining another plurality of wavefronts, and to counter said harmful waves due to said arrangement and said phase angles in said target space by matching at least a portion of at least one of said wavefronts of said harmful waves with at least a portion of at least one of said wavefronts of said counter waves.

18. The system of claim 17, wherein said counter unit is incorporated in a preset distance from at least one of said base units and target space such that said counter unit is configured to extend along a length greater than that of said at least one of said base units when disposed closer to said target space than said at least one of said base units and that said counter unit is configured to extend along another length which is less than that of said at least one of base units when disposed farther away from said target space than said base unit.

19. The system of claim 17, wherein said system is configured to have a plurality of said counter units at least two of which are configured to be disposed in said arrangement for at least one of said canceling and suppressing.

20. The system of claim 17, wherein said system is configured to have a plurality of said counter unit, wherein each of said wavefronts is configured to define a radius of curvature, and wherein at least two of said counter units are configured to manipulate said phase angles of said counter waves in such a manner that said at least two of said counter units emit counter waves with identical phase angles for increasing said radii of said curvature of said counter waves and that said at least two of said counter units emit counter waves having opposite phase angles for decreasing said radii of said curvature of said counter waves.

* * * * *